US007901861B2

(12) United States Patent
Shitara et al.

(10) Patent No.: US 7,901,861 B2
(45) Date of Patent: Mar. 8, 2011

(54) ELECTROPHOTOGRAPHIC IMAGE FORMING METHOD

(75) Inventors: Yasutada Shitara, Numazu (JP); Minoru Masuda, Numazu (JP); Yasuaki Iwamoto, Numazu (JP); Hyo Shu, Mishima (JP)

(73) Assignee: Ricoh Company Limited, Tokyo (JP)

( * ) Notice: Subject to any disclaimer, the term of this patent is extended or adjusted under 35 U.S.C. 154(b) by 488 days.

(21) Appl. No.: 11/950,114

(22) Filed: Dec. 4, 2007

(65) Prior Publication Data

US 2009/0142677 A1 Jun. 4, 2009

(51) Int. Cl.
*G03G 15/20* (2006.01)

(52) U.S. Cl. ..... 430/124.37; 430/124.3

(58) Field of Classification Search ..... 430/48, 430/124.34, 124.36, 124.37, 124.3; 399/325
See application file for complete search history.

(56) References Cited

U.S. PATENT DOCUMENTS

| | | | | |
|---|---|---|---|---|
| 4,841,331 | A | 6/1989 | Nakayama et al. | |
| 4,945,022 | A | 7/1990 | Nakayama et al. | |
| 4,980,258 | A | 12/1990 | Aoki et al. | |
| 5,225,303 | A | 7/1993 | Tomita et al. | |
| 5,514,511 | A | 5/1996 | Iwamoto et al. | |
| 5,721,083 | A | 2/1998 | Masuda et al. | |
| 5,840,456 | A | 11/1998 | Tomita et al. | |
| 6,183,926 | B1 | 2/2001 | Kuroda et al. | |
| 6,258,502 | B1 | 7/2001 | Nakamura et al. | |
| 6,303,257 | B1 | 10/2001 | Hasegawa et al. | |
| 6,363,229 | B1 * | 3/2002 | Shiraishi et al. | 399/68 |
| 6,368,765 | B2 | 4/2002 | Izu et al. | |
| 6,406,826 | B1 | 6/2002 | Suzuki et al. | |
| 6,468,706 | B2 | 10/2002 | Matsuda et al. | |
| 6,503,681 | B2 | 1/2003 | Makino et al. | |
| 6,544,704 | B1 | 4/2003 | Matsuda et al. | |
| 6,593,048 | B2 | 7/2003 | Sasaki et al. | |
| 6,667,141 | B2 | 12/2003 | Iwamoto et al. | |
| 6,699,632 | B2 | 3/2004 | Higuchi et al. | |
| 6,770,411 | B2 | 8/2004 | Masuda et al. | |
| 6,790,575 | B2 | 9/2004 | Sasaki et al. | |
| 6,811,944 | B2 | 11/2004 | Higuchi et al. | |
| 6,813,461 | B2 | 11/2004 | Higuchi et al. | |
| 6,818,369 | B2 | 11/2004 | Sugiura et al. | |
| 6,828,075 | B2 | 12/2004 | Suzuki et al. | |
| 6,835,517 | B2 | 12/2004 | Kondo et al. | |
| 6,856,781 | B2 | 2/2005 | Matsuda et al. | |
| 6,861,191 | B2 | 3/2005 | Mochizuki et al. | |
| 6,898,406 | B2 | 5/2005 | Suzuki et al. | |
| 6,911,289 | B2 | 6/2005 | Higuchi et al. | |
| 6,924,073 | B2 | 8/2005 | Higuchi et al. | |
| 6,934,484 | B2 | 8/2005 | Suzuki et al. | |
| 6,946,229 | B2 | 9/2005 | Suzuki et al. | |
| 7,024,140 | B2 | 4/2006 | Masuda et al. | |
| 7,029,816 | B2 | 4/2006 | Sasaki et al. | |
| 7,125,638 | B2 | 10/2006 | Suzuki et al. | |
| 7,162,187 | B2 | 1/2007 | Koichi et al. | |
| 7,163,773 | B2 | 1/2007 | Sugiura et al. | |
| 7,163,774 | B2 | 1/2007 | Shiraishi et al. | |
| 7,166,403 | B2 | 1/2007 | Ichikawa et al. | |
| 7,169,522 | B2 | 1/2007 | Sugiura et al. | |
| 7,169,525 | B2 | 1/2007 | Sugiura et al. | |
| 7,172,844 | B2 | 2/2007 | Umemura et al. | |
| 7,177,555 | B2 | 2/2007 | Shu et al. | |
| 7,183,029 | B2 | 2/2007 | Masuda et al. | |
| 7,217,485 | B2 | 5/2007 | Hasegawa et al. | |
| 7,258,959 | B2 | 8/2007 | Nakayama et al. | |
| 7,261,989 | B2 | 8/2007 | Sugiura et al. | |
| 7,273,688 | B2 | 9/2007 | Suzuki et al. | |
| 7,288,353 | B2 | 10/2007 | Sugiura et al. | |
| 2002/0039698 | A1 | 4/2002 | Sasaki et al. | |
| 2003/0152857 | A1 | 8/2003 | Sugiura et al. | |
| 2003/0190543 | A1 | 10/2003 | Sugiura et al. | |
| 2004/0058260 | A1 | 3/2004 | Katoh et al. | |
| 2004/0109710 | A1 | 6/2004 | Sawahata et al. | |
| 2005/0026064 | A1 | 2/2005 | Sugiura et al. | |
| 2005/0030595 | A1 | 2/2005 | Koichi et al. | |
| 2005/0089786 | A1 | 4/2005 | Sugiura et al. | |
| 2005/0089787 | A1 | 4/2005 | Uchinokura et al. | |
| 2005/0208403 | A1 | 9/2005 | Shu et al. | |
| 2005/0208408 | A1 | 9/2005 | Uchinokura et al. | |

(Continued)

FOREIGN PATENT DOCUMENTS

| | | |
|---|---|---|
| EP | 1 065 569 A2 | 1/2001 |

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner* — Christopher RoDee
(74) *Attorney, Agent, or Firm* — Oblon, Spivak, McClelland, Maier & Neustadt, L.L.P.

(57) ABSTRACT

An image forming method including electrostatic image forming step, developing step, transferring step, fixing step and oil application step for applying an oil to a fixing member, wherein the toner includes a binder resin, a colorant and a wax, and the relationship $(A2/A1)\times100<200$ is satisfied, wherein A1 represents the area of the oil dropped on a pellet of the toner measured 30 seconds after dropping the oil, and A2 represents the area of the dropped oil measured 24 hours after dropping the oil. Alternatively, the relationships $(X1-X2)<0.5$ atomic percent, $X1>1.0$ atomic percent, and $X2>1.0$ atomic percent, are satisfied, wherein X1 and X2 represent amounts of Si atoms of the silicone oil measured by subjecting the toner image to X-ray photoelectron spectroscopy at times 5 minutes and 24 hours, respectively, after fixing the toner image.

11 Claims, 16 Drawing Sheets

U.S. PATENT DOCUMENTS

| | | | | |
|---|---|---|---|---|
| 2005/0287460 | A1* | 12/2005 | Moffat et al. | 430/108.22 |
| 2006/0051692 | A1 | 3/2006 | Hasegawa et al. | |
| 2006/0063092 | A1 | 3/2006 | Hasegawa et al. | |
| 2006/0068306 | A1 | 3/2006 | Shu et al. | |
| 2006/0093943 | A1 | 5/2006 | Shu et al. | |
| 2006/0110543 | A1 | 5/2006 | Gervasi et al. | |
| 2006/0165989 | A1 | 7/2006 | Takikawa et al. | |
| 2006/0166123 | A1 | 7/2006 | Masuda | |
| 2006/0204883 | A1 | 9/2006 | Nakayama et al. | |
| 2006/0222995 | A1 | 10/2006 | Moriyama et al. | |
| 2006/0240350 | A1 | 10/2006 | Shu et al. | |
| 2007/0031748 | A1 | 2/2007 | Kotsugai et al. | |
| 2007/0184377 | A1 | 8/2007 | Shu et al. | |
| 2007/0248380 | A1 | 10/2007 | Iwamoto et al. | |
| 2007/0275315 | A1 | 11/2007 | Nagatomo et al. | |

FOREIGN PATENT DOCUMENTS

| | | | |
|---|---|---|---|
| EP | 1 111 474 | A2 | 6/2001 |
| EP | 1 168 089 | A1 | 1/2002 |
| EP | 1 172 703 | A2 | 1/2002 |
| EP | 1 291 726 | A2 | 3/2003 |
| JP | 60-90344 | | 5/1985 |
| JP | 62-63940 | | 3/1987 |
| JP | 64-15755 | | 1/1989 |
| JP | 2-82267 | | 3/1990 |
| JP | 3-41470 | | 2/1991 |
| JP | 3-229264 | | 10/1991 |
| JP | 11-249339 | | 9/1999 |
| JP | 11-305486 | | 11/1999 |
| JP | 2001-222138 | | 8/2001 |
| JP | 2002-214833 | | 7/2002 |
| JP | 2005-107387 | | 4/2005 |
| JP | 2006-330320 | | 12/2006 |
| JP | 2007-47738 | | 2/2007 |

OTHER PUBLICATIONS

U.S. Appl. No. 11/755,484, filed May 30, 2007, Watanabe, et al.
U.S. Appl. No. 11/755,517, filed May 30, 2007, Iwamoto, et al.
U.S. Appl. No. 12/210,536, filed Sep. 15, 2008, Shu, et al.
Office Action issued Aug. 4, 2010 in EP Application No. 07 121 966.1-1217.

* cited by examiner

ELECTROPHOTOGRAPHIC IMAGE FORMING METHOD

BACKGROUND OF THE INVENTION

1. Field of the Invention

The present invention relates to an electrophotographic image forming method and an electrophotographic image forming apparatus.

2. Discussion of the Background

Recently, a need exists for an electrophotographic image forming method by which high quality images can be produced at a high speed. In order to produce high quality images fixation of toner images is an important factor. Specifically, when high speed image formation is performed, the fixing property of fixed toner images deteriorates. Therefore, it is a problem to be solved that toner images are sufficiently fixed even at a high speed image forming (fixing) speed.

There is a technique in that the fixing temperature is increased as the image forming speed is increased in order to prevent deterioration of the fixing property of toner images. However, the technique causes other problems such that the inner temperature of the image forming apparatus increases, resulting in deterioration of the image forming materials such as toners, and photoreceptors; the life of the fixing members shortens; and a large amount of energy is consumed. Namely, the technique is not satisfactory. Therefore, a need exists for a toner which can be well fixed in a small amount of energy even when high speed image formation is performed.

Various attempts have been made to develop such a toner. For example, techniques in that the thermal properties of binder resins used for toner is controlled have been investigated. Specifically, published unexamined Japanese patent applications Nos. (hereinafter referred to as JP-As) 60-90344, 64-15755, 02-82267, 03-229264, 03-41470, and 11-305486 have disclosed to use polyester resins as binder resins instead of styrene-acrylic resins which have been conventionally used as binder resins. This is because polyester resins are superior to styrene-acrylic resins with respect to low temperature fixability and high temperature preservability.

JP-A 62-63940 discloses a toner including a specific crystalline non-olefin polymer, which can be sharply melted at the glass transition temperature thereof, as one of binder resins. JP-As 11-249339 and 2001-222138 have disclosed to use a crystalline polyester resin having a sharp melting property as one of binder resins. In addition, JP-A 2002-214833 discloses to use a combination of a crystalline polyester resin and a non-crystalline polyester resin as binder resins, which form a phase separation structure (i.e. island-sea structure) and which include tetrahydrofuran-soluble components having a specific differential scanning calorimetry (DSC) curve such that a maximum endothermic peak is observed at a specific temperature to impart good combination of low temperature fixability and high temperature preservability to the toner.

On the other hand, fixing devices often cause problems in that when image fixation is performed, the surface of a fixing member is contaminated with toner particles, which are transferred from toner images to be fixed on a receiving material sheet, and thereby the toner particles are re-transferred to the sheet or another sheet, thereby soiling images, or a receiving material sheet is wound around the fixing member by being affixed to the melted toner particles on the fixing member, resulting in occurrence of a jamming problem. In attempting to prevent such problems, techniques in that a releasing oil is applied to a fixing member have been proposed and used.

Recently, toner including a release agent is used. However, even when such toner is used for high speed image forming apparatus, it is necessary to use a fixing device equipped with an oil applicator for the apparatus although the coating amount of oil can be decreased compared to a case where toner including no release agent is used.

Various oil applicators have been disclosed. For example, oil application devices including an oil application roller having a heat resistant felt or a porous layer on the surface thereof, which is soaked with an oil, is pressed to a fixing member to apply the oil thereto have been proposed and used. However, when the oil application devices are used for high speed image forming apparatus, toner images on a receiving material cannot be well fixed due to insufficient fixation energy although the fixing member has good releasability from the toner images, resulting in prevention of occurrence of an offset problem.

Because of these reasons, a need exists for an image forming method and apparatus by which high quality images having good fixing property can be formed using a toner including a release agent and a fixing device having an oil applicator.

SUMMARY OF THE INVENTION

As an aspect of the present invention, an image forming method is provided which includes:

forming an electrostatic image on an image bearing member;

developing the electrostatic image with a developer including a toner to form a toner image on the image bearing member;

transferring the toner image onto a receiving material optionally via an intermediate transfer medium;

fixing the toner image to the receiving material with a fixing member; and applying an oil to the fixing member.

In this image forming method, the toner includes a binder resin, a colorant and a wax, and satisfies the following relationship (A):

$$OSP=(A2/A1)\times 100<200, \quad (A)$$

wherein OSP represents an oil spreading property of the toner, A1 represents the area of the oil dropped on a pellet of the toner measured soon (30 seconds) after dropping the oil, and A2 represents the area of the dropped oil measured 24 hours after dropping the oil.

The oil spreading property (OSP) is determined by a method including:

pressing about 2 g of the toner at a pressure of 100 kg/cm$^2$ to form the pellet of the toner having a cylindrical form with a diameter of 40 mm and a thickness of 2 mm;

heating the pellet on a hot plate heated to 180° C. for 5 minutes under an environmental condition of 23° C. and 55% RH;

setting the pellet on a horizontal plane so that a flat surface of the pellet faces upward to cool the pellet under the environmental condition;

dropping 9 mg of the oil on the flat surface of the pellet from a point 1 cm above the flat surface of the pellet; and measuring the area of the oil dropped on the flat surface of the pellet soon (30 seconds) after dropping the oil and 24 hours after dropping the oil to determine the oil spreading property (OSP).

Alternatively, in the image forming method, the oil is a silicone oil and the following relationship (B) may be satisfied:

$$(X1-X2)<0.5 \text{ atomic percent, wherein } X1>1.0 \text{ atomic percent, and } X2>1.0 \text{ atomic percent,} \quad (B)$$

wherein X1 represents the amount of Si atoms of the silicone oil measured by subjecting the toner image fixed on the receiving material to X-ray photoelectron spectroscopy soon (5 minutes) after the toner image is fixed, and X2 represents the amount of Si atoms of the silicone oil measured by subjecting the toner image fixed on the receiving material to X-ray photoelectron spectroscopy 24 hours after the toner image is fixed.

Another aspect of the present invention, an image forming apparatus is provided which includes:

an image bearing member;

a latent image forming device configured to form an electrostatic latent image on the image bearing member;

a developing device configured to develop the electrostatic latent image with a developer to form a toner image on the image bearing member;

a transfer device configured to transfer the toner image onto a receiving material optionally via an intermediate transfer medium;

a fixing device configured to fix the toner image on the receiving material with a fixing member; and an oil applicator configured to apply an oil to the fixing member of the fixing device, wherein the image forming apparatus uses at least one of the image forming methods mentioned above.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
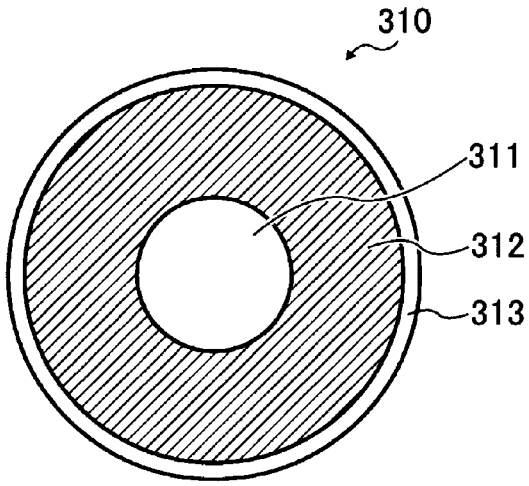
FIG. 1 is a schematic view illustrating a charging roller for use in the image forming apparatus of the present invention.

Conventionally, fixing devices with an oil applicator are typically used for effectively fixing images of toner including no release agent (such as waxes). In this case, the releasability of the fixing member from toner can be enhanced, but another problem is caused by the applied oil. Therefore, recently combinations of toner including a release agent and a fixing device without an oil applicator are typically used. In this case, it is impossible to produce high quality images having good fixing property at a high speed.

The present inventors have been studying to solve the problems mentioned above. As a result of the study, the following knowledge can be attained. Specifically, as a result of experiments in which an oil is dropped on pellets of various toners to determine the oil spreading property thereof, it is found that the smaller oil spreading property a toner has, the better fixability the toner has. Further, it is found that by using a combination of toner having a small oil spreading property (i.e., satisfying the above-mentioned relationship (A)) with a fixing device having an oil applicator or a combination of toner satisfying the above-mentioned relationship (B) with a fixing device having an oil applicator applying a silicone oil, the above-mentioned problems can be solved.

Next the image forming apparatus and method of the present invention will be explained in detail.

The image forming apparatus of the present invention includes at least an image bearing member; a latent image forming device (such as combinations of a charging device and a light irradiating device) configured to form an electrostatic latent image on the image bearing member; a developing device configured to develop the electrostatic latent image with a developer including a toner to form a toner image on the image bearing member; a transfer device configured to transfer the toner image onto a receiving material optionally via an intermediate transfer medium; a fixing device configured to fix the toner image on the receiving material; and an oil applicator configured to apply an oil (such as silicone oils) to a fixing member of the fixing device.

The image forming apparatus can optionally include a cleaning device configured to clean the surface of the image bearing member; a discharging device configured to discharge charges remaining on the surface of the image bearing member after the image transfer operation; a toner recycling device configured to recycle the toner particles collected by the cleaning device; a controller configured to control the image forming operations of the image forming apparatus; etc.

The image forming method of the present invention includes at least a latent image forming process (such as combinations of a charging process and a light irradiating process), a developing process, an image transfer process, and a fixing process. The image forming method can optionally include a cleaning process, a discharging process, a toner recycling process, a controlling process, etc.

The image forming method is preferably performed using the image forming apparatus of the present invention, and the latent image forming process, developing process, image transfer process, and fixing process are preferably performed by the latent image forming device (such as combinations of a charging device and a light irradiating device), developing device, transfer device, and fixing device of the present invention. The cleaning process, discharging process, toner recycling process and controlling process are performed by the cleaning device, discharging device, toner recycling device, and controller.

In the present invention, the toner includes at least a binder resin, a colorant, and a wax.

The toner has the following property. Specifically, at first, about 2 g of the toner is subjected to a compression molding at a pressure of 100 kg/cm$^2$ to form a cylindrical pellet of the toner having a diameter of about 40 mm and a thickness of about 2 mm. The pellet is then heated for 5 minutes on a hot plate heated to 180° C. under an environmental condition of 23° C. and 55% RH. The pellet is then set on a horizontal plate under the environmental condition so that the flat surface of the cylindrical pellet faces upward, to be cooled. Nine (9) milligrams of the oil used for the oil applicator is dropped on the flat surface of the pellet from a point 1 cm above the flat surface of the pellet. The area (W1) of the oil dropped on the flat surface is measured soon (within 30 seconds) after the oil is dropped. In addition, the area (W2) of the dropped oil is also measured 24 hours after the oil dropping operation. In this regard, the oil spreading property (OSP) is defined by the following equation:

$$OSP(\%)=(W2/W1)\times 100.$$

The method for determining the oil spread property (OSP) is explained later in detail.

The oil spreading property is less than 200%, preferably not greater than 150%, and more preferably not greater than 125%. When the oil spreading property is too large, an abrasion problem in that fixed toner images are easily abraded by receiving material sheets and the toner powder formed by the abrasion of the toner images is adhered to the receiving material sheet or image forming members such as rollers, resulting in soiling of the backside of copies and contamination of the image forming members.

Alternatively, the toner may have the following property. Specifically, a toner image including a solid image is produced using the image forming apparatus of the present invention having an oil applicator applying an oil including a silicone oil to the fixing member of the fixing device. The fixed solid image is subjected to X-ray photoelectron spectroscopy (XPS) soon (within 10 minutes) after the toner image is fixed to determine the initial amount (X1) of silicon (Si) atoms of the silicone oil present on and/or in the solid image. In addition, at a time 24 hours after fixation of the toner image, the solid image is also subjected to X-ray photoelectron spectroscopy (XPS) to determine the amount (X2) of silicon atoms at the time. Each of the amounts X1 and X2 is greater than 1.0 atomic percent, and preferably from 1.5 to 3.0 atomic percent. In addition, the following relationship is satisfied:

$$(X1-X2)<0.5 \text{ atomic percent.}$$

The difference (X1−X2) is preferably less than 0.3 atomic percent.

When the amounts X1 and X2 are too small, the fixed toner image has poor abrasion resistance. Therefore, the above-mentioned abrasion problem occurs. When the difference (X1−X2) is too large, the abrasion resistance of the images deteriorates with time.

The amount of the silicone oil present on the surface of the fixed toner image and in a surface portion of the fixed toner image can be determined by subjecting the toner image to XPS. By using XPS, only the information on the surface and the surface portion of the fixed toner image can be obtained.

In this regard, the penetration depth of the XPS is generally few nanometers. Namely, the amount of silicon atoms present on the surface of the toner image and in a surface portion of the toner image, which portion has a depth of about few nanometers is determined.

The method for determining the amounts X1 and X2 is explained later in detail.

Figure 21:
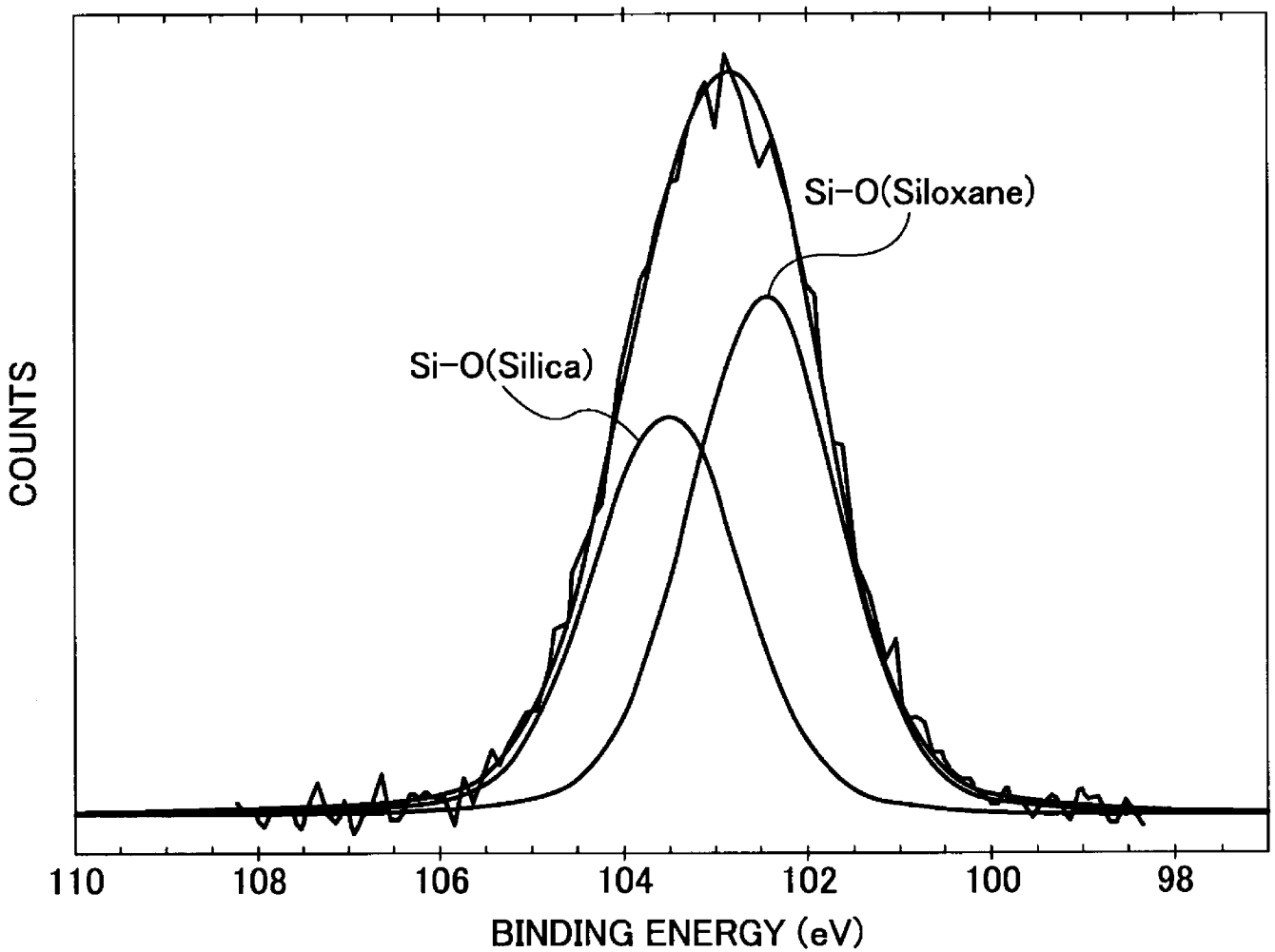
FIG. 21 is a graph of XPS in which a Si peak of a silicone oil is separated from a Si peak of a silica included in the toner as an external additive.

In this regard, there is a case where the toner used includes a silica as an external additive. Therefore, when the toner image is subjected to XPS, a peak of Si atoms included in the silica is observed. However, as illustrated in FIG. 21, the position of the peak of Si atoms included in the silica is different from the position of the peak of Si atoms included in the silicone oil, and therefore the peak of Si atoms of the silicone oil can be separated from the peak of Si atoms of the silica, namely, the amount of the Si atoms included in the silicone oil can be determined.

The solid image produced for determining the amounts X1 and X2 is preferably an image having the highest image density among the images produced by the image forming apparatus. In general, the weight of the solid image is preferably from 0.3 to 1.5 mg/cm$^2$.

The toner preferably includes an amide wax, and the amount of nitrogen atoms of the amide wax in a pellet of the toner determined by the following XPS method is from 0.5 to 3.0 atomic % based on the total of the detected atoms. The method for determining the amount of nitrogen atoms of the amide wax includes:

pressing about 30 mg of the toner for 1 minute at a pressure of 100 kg/cm$^2$ to form the pellet of the toner having a cylindrical form with a diameter of about 5 mm;

heating the pellet for 5 minutes on a hot plate heated to 180° C. under an environmental condition of 23° C. and 55% RH;

cooling the pellet;

subjecting a flat surface of the pellet to an X-ray photoelectron spectroscopy (XPS) to determine the amount of nitrogen atoms present on the surface and in a surface portion of the pellet of the toner.

When the amount of nitrogen atoms is too small, the fixability improving effect can be hardly produced. In contrast, when the amount of nitrogen atoms is too large (i.e., when the added amount of amide wax is too large), problems in that a film of the wax is formed on image forming members and the toner has poor fluidity occur.

In the present application, the conditions for XPS are as follows.

Instrument: QUANTUM 2000 from PHI using an electron neutralization gun

X-ray source: AlK $\alpha$

The amount of nitrogen atoms can be determined from the strength of the peak specific to nitrogen atoms. When the amounts X1 and X2 are calculated, the data of the relative sensitivity factors provided by PHI are used.

As mentioned above, the penetration depth of the XPS is generally few nanometers.

The image forming apparatus of the present invention has a system linear speed of from 500 to 2000 mm/sec, and preferably from 1000 to 1800 mm/sec. When the system linear speed is too low, the effects of the present invention cannot be well produced. In contrast, when the system linear speed is too high, the developing process, transfer process and fixing process are insufficiently performed.

Next, the devices and toner used for the image forming apparatus of the present invention, and the processes of the image forming method of the present invention will be explained in detail.

Image Bearing Member

The image bearing member of the image forming apparatus of the present invention is not particularly limited with respect to the constitutional materials, shape, structure, size, etc. For example, with respect to the shape, drum-form, sheet-form, and endless belt-form image bearing members can be used. With respect to the structure, single-layered structures and multi-layered structures can be adopted. The size is determined depending on the specification of the image forming apparatus.

The image bearing member is typically a photoreceptor such as inorganic photoreceptors including an inorganic photosensitive material such as amorphous silicon, selenium, CdS, and ZnO; and organic photoreceptors (OPCs) including an organic photosensitive material such as polysilane and phthalopolymethine.

Amorphous silicon photoreceptors for use in the present invention are typically prepared by the following method. A substrate is heated to a temperature of from 50 to 400° C., and an amorphous silicon layer is formed thereon by a method such as vacuum deposition methods, sputtering methods, ion plating methods, thermal CVD (chemical vapor deposition) methods, photo-assisted CVD methods, and plasma CVD methods. Among these methods, plasma CVD methods are preferably used. Specifically, raw gaseous materials are decomposed by glow discharge using direct current (DC), high frequency waves, or microwaves to form an amorphous silicon layer on the substrate.

Organic photoreceptors are typically used because of having:

(1) good optical properties such as wide light absorption range and large light absorbency;
(2) good electric properties such as high sensitivity and stable charge properties;
(3) a wide material selectivity (i.e., various materials can be used therefor);
(4) good productivity (i.e., capable of being easily produced);
(5) low costs; and
(6) low toxicity.

The organic photoreceptors are classified into photoreceptors having a single-layered photosensitive layer, and photoreceptors having a multi-layered photosensitive layer.

The single-layered photoreceptors include a single-layered photosensitive layer formed on a substrate, and optionally include one or more other layers such as protective layers, and intermediate layers.

The multi-layered photoreceptors include a multi-layered photosensitive layer, which is formed on a substrate and which includes plural layers such as charge generation layers and charge transport layers, and optionally include one or more other layers such as protective layers, and intermediate layers.

Charging Process and Charging Device

In the charging process, the image bearing member is charged with a charging device.

The charging device is not particularly limited as long as the device can uniformly charge an image bearing member. The charging device is broadly classified into (1) contact charging devices which charges an image bearing member by contacting a charging member therewith; and (2) noncontact charging devices which charges an image bearing member using a noncontact charging member.

(1) Contact Charging Device

Specific examples of the contact charging devices include devices which charge an image bearing member using a charging member such as charging rollers, magnetic brushes, fur brushes, films, and rubber blades. Among these members, charging rollers are preferably used because the amount of ozone generated by the charging process can be dramatically decreased. Therefore, an image bearing member can be stably used repeatedly, and thereby high quality images can be repeatedly produced.

Magnetic brushes for use in contact charging devices typically include a non-magnetic electroconductive sleeve bearing thereon a particulate ferrite such as Zn—Cu ferrites, and a magnet roller arranged inside the sleeve.

Fur brushes for use in contact charging devices typically include a support such as metal shafts and metal wires, and a fur which is wound around or affixed to the support and is subjected to an electroconductive treatment using carbon, copper sulfide, a metal or a metal oxide.

FIG. 1 illustrates the cross section of a charging roller. Referring to FIG. 1, a charging roller 310 includes a cylindrical substrate 311, a resistivity controlling layer 312 formed on the substrate, and a protective layer 313 formed on the resistivity controlling layer to protect the layer and to prevent occurrence of a leaking problem in that a large current flows between the charging roller and (a defect of) the photoreceptor.

The resistivity controlling layer 312 is typically formed on the surface of a substrate by subjecting a thermoplastic resin including a polymeric ion conducting agent to extrusion molding or injection molding.

The volume resistivity of the resistivity controlling layer 312 is preferably from $10^6$ to $10^9$ Ω·cm. When the volume resistivity is too high, the quantity of charge formed on the photoreceptor decreases, and thereby a desired potential needed for forming uneven images cannot be formed on the surface of the photoreceptor. In contrast, when the volume resistivity is too low, the leaking problem occurs.

The material of the resistivity controlling layer 312 is not particularly limited. Specific examples of the material include polyethylene, polypropylene, polymethyl methacrylate, polystyrene, styrene copolymers (e.g., acrylonitrile-styrene copolymers (AS), and acrylonitrile-butadiene-styrene copolymers (ABS)), etc.

Suitable polymeric ion conducting agents include materials having a volume resistivity of from $10^6$ to $10^9$ Ω·cm. Specific examples thereof include compounds including a polyether ester amide component. The added amount of such compounds is 30 to 70 parts by weight per 100 parts by weight of the thermoplastic resin used to control the resistivity of the resistivity controlling layer 312 in the preferable range. In addition, polymers having a quaternary ammonium salt group (such as polyolefins having a quaternary ammonium salt group) can also be used as a polymeric ion conducting agent. The added amount of such polymers is 10 to 40 parts by weight per 100 parts by weight of the thermoplastic resin used.

When a polymeric ion conducting agent is dispersed in a thermoplastic resin, kneaders such as double-axis kneaders are preferably used. In this case, molecules of the polymeric ion conducting agent are uniformly dispersed in the thermoplastic resin, and therefore the resultant resistivity controlling layer has a less resistivity variation than conventional resistivity controlling layers including an electroconductive pigment therein. In addition, since a polymeric ion conducting agent is used, a bleed-out problem such that an electroconductive material included in a layer bleeds from the layer is hardly caused.

The protective layer 313 has a higher resistivity than the resistivity controlling layer 312 to prevent occurrence of the leaking problem. However, when the resistivity of the protective layer is too high, the charging efficiency of the charging roller deteriorates. The difference in resistivity between the protective layer and the resistivity controlling layer is preferably not greater than $10^3$ Ω·cm.

Resins are typically used for the protective layer 313 because of having a good film formability. For example, non-tacky resins such as fluorine-containing resins, polyamide resins, polyester resins, and polyvinyl acetal resins are used for the protective layer to prevent toner particles from adhering thereto. However, such resins are typically insulators, and therefore a charging roller having a protective layer made of only such a resin does not fulfill the requirements for the charging roller. Therefore it is preferable to control the resistivity of the protective layer 313 by adding an electroconductive material thereto. In addition, it is preferable to mix a reactive crosslinking agent such as isocyanates with the resin used for the protective layer 313 to improve the adhesion of the protective layer to the resistivity controlling layer 312.

A power source is connected with the charging roller 310 to apply a predetermined voltage such as DC voltages and combinations of DC and AC voltages. By using a DC voltage overlapped with an AC voltage, the surface of an image bearing member (e.g., photoreceptors) can be evenly charged.

Figure 2:
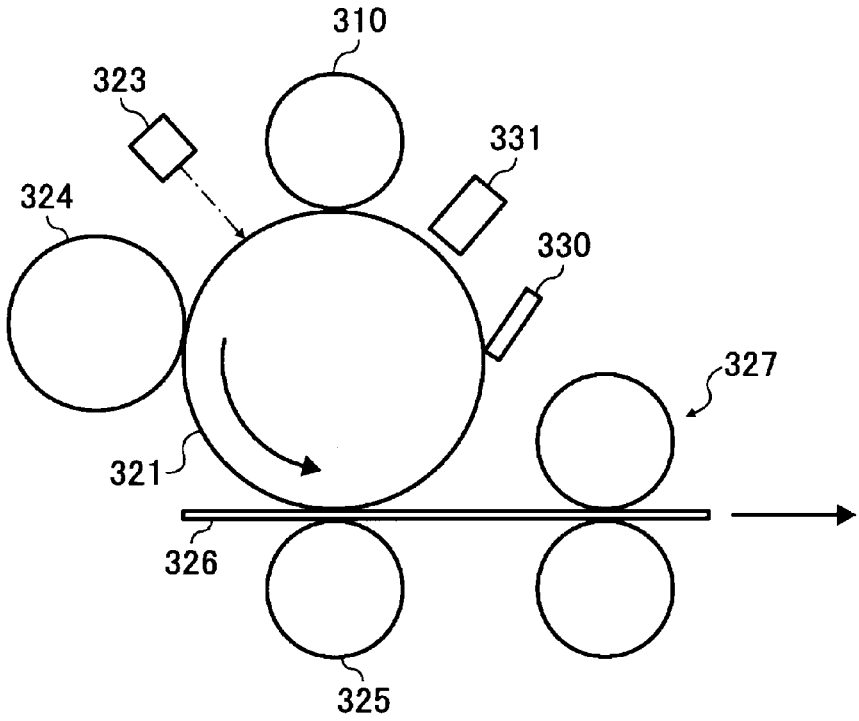
FIG. 2 is a schematic view illustrating an example of the image forming apparatus using the charging roller as a contact charger.

FIG. 2 illustrates an image forming apparatus using the contact charging roller 310 as a contact charging member. The image forming apparatus illustrated in FIG. 2 has a photoreceptor drum 321 serving as an image bearing member, and a charging device including the charging roller 310 for charging the photoreceptor drum, a light irradiator 323 configured to irradiate the charged photoreceptor with imagewise light to form an electrostatic latent image on the photoreceptor drum, a developing device 324 configured to develop the electrostatic latent image with a developer including a toner to form a toner image on the photoreceptor drum, a transfer device 325 configured to transfer the toner image on a receiving material sheet 326, a fixing device 327 configured to fix the toner image on the receiving material sheet, a cleaning device 330 configured to remove toner particles remaining on the photoreceptor drum, and a discharging device 331 configured to discharge charges remaining on the photoreceptor drum. These devices are arranged around the photoreceptor drum 321. The charging roller 310 illustrated in FIG. 1 is used as a contact charging member.

Noncontact Charging Device

Specific examples of the noncontact charging devices include noncontact chargers utilizing corona discharging, chargers having a needle electrode or a solid state discharging element, chargers including an electroconductive or semiconductive charging roller set close to an image bearing member, etc.

Chargers utilizing corona discharging cause corona discharging in the air to generate positive or negative ions, thereby charging an image bearing member. Specific examples thereof include corotron chargers supplying charges with a constant charge quantity, and scorotron chargers supplying charges to form a constant potential on an image bearing member.

Corotron chargers include a discharging wire and a casing set above the wire to surround the upper space of the discharging wire. Scorotron chargers is the same as the corotron chargers except that a grid is arranged below the wire. The distance between the grid and the surface of the image bearing member is generally from 1.0 to 2.0 mm.

Figure 3:
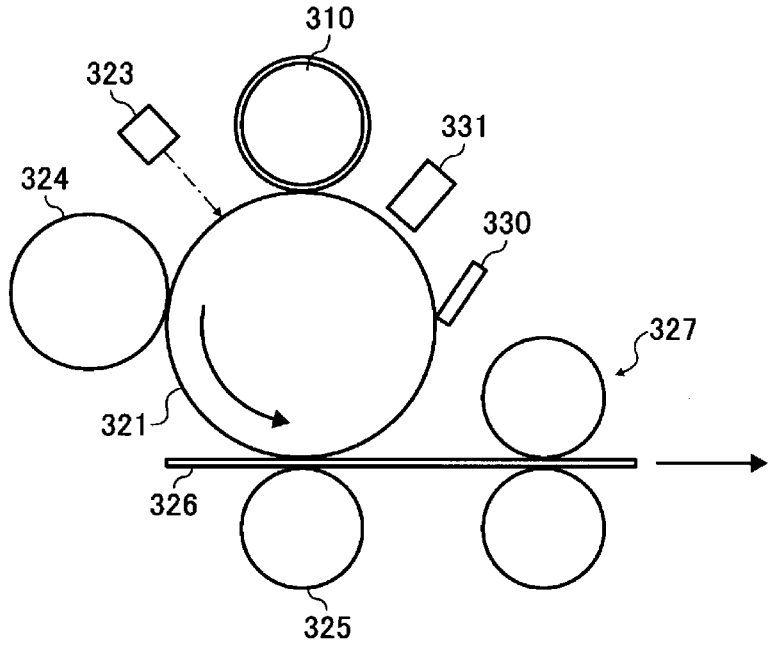
FIG. 3 is a schematic view illustrating an example of the image forming apparatus using the charging roller as a short range charger.

FIG. 3 illustrates an image forming apparatus using the charging roller 310 as a noncontact charging member. The charging roller is set close to the surface of the photoreceptor drum 321 while a gap of from 10 to 200 μm (preferably from 10 to 100 μm) is formed therebetween.

Figure 4:
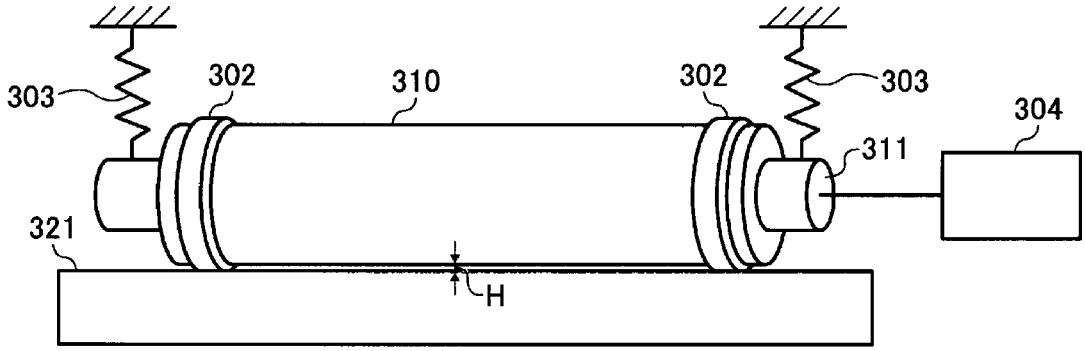
FIG. 4 is a side view illustrating the short range charger illustrated in FIG. 3.

FIG. 4 is a side view of the charging device illustrated in FIG. 3. The charging roller 310 is set near the photoreceptor drum 321 while a small gap H is formed therebetween by spacers 302. The spacers 302 are contacted with non-image-forming areas of the photoreceptor drum 321. The spacers are formed by winding a film on both end portions of the charging roller 310. Numeral 304 denotes a power source for applying a voltage (e.g., a DC voltage overlapped with an AC voltage) to the charging roller. By applying such a voltage to the charging roller 310, discharging is caused in the air gap H, and thereby the photoreceptor is charged. By pressing a shaft 311 of the charging roller 310 with springs 303, the gap H can be stably maintained.

The spacers 302 may be formed by an integral molding method when the charging roller is prepared. In this regard, the surface of the spacers is made of an insulator to prevent occurrence of discharging at the contact points between the spacers and the photoreceptor drum. By preventing occurrence of discharging, a problem in that discharge products are adhered to the surface of the spacers and thereby the gap H is widened can be avoided. A heat shrinkable tube may be used for the spacers 302. Specific examples thereof include SUMITUBE F105° C. from Sumitomo Chemical Co., Ltd., which can be used at 105° C.

Light Irradiating Process and Light Irradiating Device

In the light irradiation process, a light irradiating device irradiates the charged image bearing member with imagewise light to form an electrostatic latent image on the image bearing member. The light irradiation device is broadly classified into analogue optical devices and digital optical devices. In analogue optical devices, light reflected from an original image is directly projected on an image bearing member (such as photoreceptors) to form an electrostatic image of the original image. In digital optical devices, an original image is changed to electric signals. The digital optical devices irradiate an image bearing member according to the signals to apply optical signals thereto.

The light irradiating device is not particularly limited, and any known devices can be used. Specific examples thereof include optical systems for use in copiers, rod lens arrays, optical systems using a laser, a liquid crystal shutter, a LED, or the like.

Light irradiating methods in which light irradiates an image bearing member from the inside of the image bearing member can also be used.

Developing Process and Developing Device

In the developing device, an electrostatic latent image formed on an image bearing member is developed with a developer including a toner using a developing device.

The developing device is not particularly limited, and any developing devices can be used as long as the devices develop an electrostatic image with a developer including a toner. For example, devices which contain a developer including a toner and which applies the toner to an electrostatic image by contacting the toner with the electrostatic image or without contacting the toner with the electrostatic image.

Toner

The toner for use in the image forming apparatus includes at least a binder resin, a colorant and a wax, and optionally includes a charge controlling agent, an external additive, etc.

Binder Resin

The binder resin is not particularly limited, and known resins can be used therefor. Suitable resins for use as the binder resin include copolymers obtained by two or more kinds of vinyl monomers such as styrene-based monomers, acrylic monomers, and methacrylic monomers; polyester resins, polyol resins, phenolic resins, silicone resins, polyurethane resins, polyamide resins, furan resins, epoxy resins, xylene resins, terpene resins, coumarone-indene resins, polycarbonate resins, petroleum resins, etc.

Specific examples of the styrene-based monomers include styrene derivatives such as styrene, o-methylstyrene, m-methylstyrene, p-methylstyrene, p-phenylstyrene, p-ethyl styrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene.

Specific examples of the acrylic monomers include acrylic acid, methyl acrylate, ethyl acrylate, propyl acrylate, n-butyl acrylate, iso-butyl acrylate, n-octyl acryalte, n-dodecyl acrylate, 2-ethylhexyl acryalte, stearyl acrylate, 2-chloroethyl acrylate, phenyl acrylate, esters of these acrylic monomers, etc.

Specific examples of the methacrylic monomers include methacrylic acid, methyl methacrylate, ethyl methacrylate, propyl methacrylate, n-butyl methacrylate, iso-butyl methacrylate, n-octyl methacryalte, n-dodecyl methacrylate, 2-ethylhexyl methacryalte, stearyl methacrylate, phenyl methacrylate, diethylaminoethyl methacrylate, esters of these methacrylic monomers, etc.

Specific examples of other monomers used for preparing copolymers for use as the binder resin include the following monomers.

(1) mono-olefin monomers such as ethylene, propylene, butylenes, and isobutylene;
(2) poly-ene monomers such as butadiene, and isoprene;
(3) halogenated vinyl monomers such as vinyl chloride, vinylidene chloride, vinyl bromide, and vinyl fluoride;
(4) vinyl ester monomers such as vinyl acetate, vinyl propionate, and vinyl benzoate;
(5) vinyl ether monomers such as vinyl methyl ether, vinyl ethyl ether, and vinyl isobutyl ether;
(6) vinyl ketone monomers such as vinyl methyl ketone, vinyl hexyl ketone, and methyl isopropenyl ketone;
(7) N-vinyl monomers such as N-vinyl pyrrole, N-vinyl carbazole, N-vinyl indole, and N-vinyl pyrrolidone;
(8) vinyl naphthalene monomers;
(9) (meth)acrylic acid derivatives such as acrylonitrile, methacrylonitrile, and acrylamide;
(10) unsaturated dibasic acids such as maleic acid, citraconic acid, itaconic acid, alkenylsuccinic acid, fumaric acid, and mesaconic acid;
(11) unsaturated dibasic acid anhydrides such as maleic anhydride, citaraconic anhydride, itaconic anhydride, and alkenylsuccinic anhydrides;
(12) monoesters of unsaturated dibasic acids such as monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate, and monomethyl mesaconate;
(13) esters of unsaturated dibasic acids such as dimethyl maleate, and dimethyl fumarate;
(14) α, β-unsaturated acids such as crotonic acid, and cinnamic acid;
(15) α, β-unsaturated acid anhydrides such as crotonic anhydride, and cinnamic anhydride;
(16) monomers having a carboxyl group such as anhydrides of α, β-unsaturated acids and lower fatty acids, alkenyl malonic acid, alkenylglutaric acids, alkenyladipic acids, and anhydrides and monoesters of these acids;
(17) hydroxyalkyl esters of (meth)acrylic acid such as 2-hydroxyethyl (meth)acrylate, and 2-hydroxypropyl methacrylate; and
(18) monomers having a hydroxyl group such as 4-(1-hydroxy-1-methylbutyl)styrene, and 4-(1-hydroxy-1-methylhexyl)styrene.

Among these resins, styrene copolymers and styrene-acrylic copolymers are preferably used as the binder resin.

The binder resin of the toner can have a crosslinked structure formed by using a crosslinking agent having two or more vinyl groups. Specific examples of such a crosslinking agent include aromatic divinyl compounds such as divinyl benzene, and divinyl naphthalene; di(meth)acrylate compounds, in which (meth)acrylate compounds are connected with an alkyl chain, such as ethylene glycol di(meth)acrylate, 1,3-butylene glycol di(meth)acrylate, 1,4-butanediol di(meth)acrylate, 1,5-pentanediol di(meth)acrylate, 1,6-hexanediol di(meth) acrylate, and neopentylglycol di(meth)acrylate; di(meth) acrylate compounds, in which (meth)acrylate compounds are connected with an alkyl chain having an ether bond, such as diethylene glycol di(meth)acrylate, triethylene glycol di(meth)acrylate, tetraethylene glycol di(meth)acrylate, polyethylene(400)glycol di(meth)acrylate, polyethylene (600)glycol di(meth)acrylate, and dipropyleneglycol di(meth)acrylate; di(meth)acrylate compounds, in which (meth)acrylate compounds are connected with an aromatic group or an ether bond; polyester diacrylates such as MANDA from Nippon Kayaku Co., Ltd.; etc.

Specific examples of polyfunctional crosslinking agents include pentaerythritol tri(meth)acrylate, trimethylolethane tri(meth)acrylate, trimethylolpropane triacrylate, tetramethylolmethane tetraacrylate, oligoester acrylate, triaryl cyanurate, triaryl trimellitate, etc.

Among these crosslinking agents, aromatic divinyl compounds (preferably divinyl benzene) and diacrylate compounds having a chain including an aromatic group and an ether bond are preferably used because of imparting a good combination of fixability and offset resistance to the toner.

The added amount of these crosslinking agents is from 0.01 to 10 parts by weight, and preferably from 0.03 to 5 parts by weight, per 100 parts by weight of monomers used for preparing the binder resin.

Specific examples of polymerization initiators for use in polymerization of the above-mentioned monomers include 2,2'-azobisisobutylonitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane), ketone peroxides (e.g., methyl ethyl ketone peroxide, acetylacetone peroxide, and cyclohexane peroxide), 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, dicumyl peroxide, α-(tert-butylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropylperoxy dicarbonate, di-2-ethylhexylperoxy dicarbonate, di-n-propylperoxy dicarbonate, di-2-ethoxyethylperoxy dicarbonate, di-ethoxyisopropylperoxy dicarbonate, di(3-methyl-3-methoxybutyl)peroxy dicarbonate, acetylcyclohexylsulfonyl peroxide, tert-butylperoxy acetate, tert-butylperoxy isobutyrate, tert-butylperoxy-2-ethyl hexyarate, tert-butylperoxy laurate, tert-butyl-oxy benzoate, tert-butylperoxy isopropylcarbonate, di-tert-butylperoxy isophthalate, tert-butylperoxy arylcarbonate, isoamylperoxy-2-ethyl hexanoate, di-tert-butylperoxy hexahydroterephthalate, tert-butylperoxy azelate, etc.

When styrene-acrylic resins are used as the binder resin, the resins preferably include tetrahydrofuran-soluble components having a molecular weight distribution (determined by gel permeation chromatography (GPC)) such that at least one peak is present in a number average molecular weight range of from 3,000 to 50,000 and at least one peak is present in a range of not less than 100,000. In this case, a good combination of fixabililty, offset resistance and preservability can be imparted to the toner. Among these resins, resins including tetrahydrofuran-soluble components having a molecular weight of not greater than 100,000 in an amount of from 50 to 90% by weight are preferably used. Further, resins including tetrahydrofuran-soluble components having a molecular weight distribution such that a main peak is present in a range of from 5,000 to 30,000 and preferably from 5,000 to 20,000 are more preferably used.

Further, when vinyl resins such as styrene-acrylic resins are used as the binder resin, the resins preferably have an acid value of from 0.1 to 100 mgKOH/g, preferably from 0.1 to 70 mgKOH/g, and more preferably from 0.1 to 50 mgKOH/g.

Suitable polyester resins for use as the binder resin include polyester resins obtained by reacting one or more alcohol components with one or more acid components.

Specific examples of alcohol components include dihydric alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentylglycol, 2-ethyl-1,3-hexanediol, hydrogenated bisphenol A, and diols obtained by reacting a ring ether (e.g., ethylene oxide and propylene oxide) with bisphenol A; and polyhydric alcohols having three or more hydroxyl groups such as sorbitol, 1,2,3,6-hexanetetraol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylol ethane, trimethylol propane, 1,3,5-trihydroxybenzene, etc.

Specific examples of the acid components include dibasic acids such as benzene dicarboxylic acids such as phthalic acid, isophthalic acid, terephthalic acid, and their anhydrides; alkyldicarboxylic acid such as succinic acid, adipic acid, sebacic acid, azelaic acid, and their anhydrides; and unsaturated dibasic acids such as maleic acid, citraconic acid, itaconic aicd, alkenylsuccinic acid, fumaric acid, mesaconic acid, and their anhydrides; and polybasic acids having three or more carboxyl groups such as trimellitic acid, pyromellitic acid, 1,2,4-benzentricarboxylic acid, 1,2,5-benzentricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxy)methane, 1,2,7,8-octanetetracarboxylic acid, trimers of embole, and anhydrides and lower alkyl esters of these acids.

When polyester resins are used as the binder resin, the resins preferably include tetrahydrofuran-soluble components having a molecular weight distribution (determined by GPC) such that at least one peak is present in a molecular weight range of from 3,000 to 50,000. In this case, a good combination of fixabililty, offset resistance and preservability can be imparted to the toner. Among these resins, polyester resins including tetrahydrofuran-soluble components having a molecular weight of not greater than 100,000 in an amount of from 60 to 100% by weight are preferably used. Further, polyester resins including tetrahydrofuran-soluble components having a molecular weight distribution such that at least one peak is present in a range of from 5,000 to 20,000 are more preferably used.

Polyester resins having an acid value of from 0.1 to 100 mgKOH/g, preferably from 0.1 to 70 mgKOH/g, and more preferably from 0.1 to 50 mgKOH/g, are preferably used as the binder resin.

When a combination of a polyester resin and a vinyl resin are used as the binder resin, at least one of the polyester resin and vinyl resin can include a unit having a group which is reactive with the other resin. Specific examples of the monomers for forming the polyester resin and having a group reactive with vinyl resins include unsaturated dicarboxylic acids such as phthalic acid, maleic acid, citraconic acid, itaconic acid, anhydrides of the acids, etc. Specific examples of the monomers for forming the vinyl resin and having a group reactive with polyester resins include monomers having a carboxyl group or a hydroxyl group, esters of (meth)acrylic acid, etc.

When a combination of a polyester resin, a vinyl resin and another kind of resin are used as the binder resin, the combined binder resin preferably includes resins having an acid value of from 0.1 to 50 mgKOH/g in an amount of not less than 60% by weight. The acid value is determined by the method described in JIS K0070, which is as follows.

(1) At first, about 0.5 to 2.0 g of a sample (a binder resin) is precisely measured. In this regard, when the sample includes other materials such as additives, the acid values and contents of the other materials are previously determined. For example, when the acid value of the binder resin included in a toner, which further includes a colorant and additives such as magnetic materials, is determined, the acid values of the colorant and the additives are previously determined and then the acid value of the toner is determined. The acid value of the binder resin is calculated from these acid value data.

(2) The sample is mixed with 150 ml of a mixture solvent of toluene and ethanol (mixed in a ratio of 4:1) to be dissolved.

(3) The thus prepared solution is subjected to a potentiometric titration using a 0.1 mol/l ethanol solution of potassium hydroxide (KOH).

The acid value (AV) of the sample is calculated by the following equation (1).

$$AV(mgKOH/g)=(S-B)\times f\times 5.61/W \quad (1)$$

wherein S represents the amount of KOH consumed in the titration, B represents the amount of KOH consumed in the titration when a blank (i.e., a toluene/ethanol mixture solvent) is subjected to the titration, f represents the factor of N/10 potassium hydroxide, and W represents the precise weight of the sample.

Each of the binder resin of the toner and the toner preferably has a glass transition temperature (Tg) of from 55 to 70°

C., and more preferably from 57 to 70° C. In this case, the toner has good preservability. When the Tg is too low, the toner deteriorates under high temperature conditions, and causes an offset problem in a fixing process. In contrast, when the Tg is too high, the fixability of the toner deteriorates.

The toner of the present invention can include a crystalline polyester resin to improve the low temperature fixability thereof.

Among the crystalline polyester resins, crystalline aliphatic polyester resins having the following formula (1) (i.e., an ester bond) in a main chain in an amount of not less than 60% by mole are preferable.

$$—OCO—R—COO—(CH_2)_n— \quad \text{formula (1)}$$

In formula (1), R represents the residual group of an unsaturated linear fatty acid (dicarboxylic acid), which has 2 to 20 carbon atoms, and preferably from 2 to 4 carbon atoms; and n is an integer of from 2 to 20 and preferably from 2 to 6.

Whether or not a resin has the structure having formula (1) can be determined by solid $^{13}C$-NMR.

Specific examples of the unsaturated linear fatty acids having a formula —OCO—R—COO— include maleic acid, fumaric acid, 1,3-n-propenedicarboxylic acid, 1,4-n-butenedicarboxylic acid, etc.

In formula (1), $—(CH_2)_n—$ represents the residual group of a dihydric linear aliphatic alcohol. Specific examples of such linear aliphatic alcohols include ethylene glycol, 1,3-propylene glycol, 1,4-butanediol, 1,6-hexanediol, etc.

Polyester resins prepared by using an unsaturated linear dicarboxylic acid form a crystalline structure more easily than polyester resins prepared by using an unsaturated aromatic dicarboxylic acid.

The crystalline polyester resins for use in the toner of the present invention can be produced by subjecting the following components (1) and (2) to a polycondensation reaction in a usual manner.

(1) a linear unsaturated aliphatic dicarboxylic acid or a reactive derivative thereof (such as anhydrides, alkyl (C1 to C4) esters and acid halides thereof); and (2) a linear aliphatic diol.

In this case, a small amount of polycarboxylic acid can be used in combination with a polycarboxylic acid, if desired. Specific examples of the polycarboxylic acids include:

(1) unsaturated aliphatic dicarboxylic acids having a branched chain;

(2) saturated aliphatic polycarboxylic acids such as saturated aliphatic dicarboxylic acids and saturated aliphatic tricarboxylic acids; and (3) aromatic polycarboxylic acids such as aromatic dicarboxylic acids and aromatic tricarboxylic acids.

These polycarboxylic acids (1) to (3) can be included in an amount such that the resultant polyester resin does not lose the crystallinity. Specifically, the added amount thereof is generally not greater than 30% by mole, and preferably not greater than 10% by mole, based on the total amount of the carboxylic acids used.

Specific examples of the polycarboxylic acids to be optionally used include dicarboxylic acids such as malonic acid, succinic acid, glutaric acid, adipic acid, suberic acid, sebacic acid, citraconic acid, phthalic acid, isophthalic acid, and terephthalic acid; and tri- or more-carboxylic acid units such as trimellitic anhydride, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

In addition, a small amount of polyhydric alcohols such as branched dihydric alcohols, cyclic dihydric alcohols, and tri- or more-hydric alcohols can be included in combination with the above-mentioned polyhydric alcohols to an extent such that the resultant polyester resin does not lose the crystallinity. The added amount is generally not greater than 30% by mole, and preferably not greater than 10% by mole, based on the total amount of the alcohols used.

Specific examples of such polyhydric alcohols to be optionally added include 1,4-bis(hydroxymethyl)cyclohexane, polyethylene glycol, ethylene oxide adduct of bisphenol A, propylene oxide adduct of bisphenol A, glycerin, etc.

Crystalline polyester resins included in the toner preferably have a relatively low molecular weight and a sharp molecular weight distribution to impart good low temperature fixability to the toner. Specifically, crystalline polyester resins having a weight average molecular weight (Mw) of from 5,500 to 6,500, a number average molecular weight (Mn) of from 1,300 to 1,500 and a Mw/Mn ratio of from 2 to 5, which are determined from the molecular weight distributions of o-dichlorobenzen-soluble components of the resins determined by GPC, are preferably used.

The molecular weight distribution of a crystalline polyester resin can be determined from a molecular weight distribution graph in which the molecular weight of components in the logarithm unit (log M) is plotted on the horizontal axis and the weight percentage of the components is plotted on the vertical axis. Crystalline polyester resins having a peak, which preferably has a half width of not greater than 1.5, in a range of from 3.5 to 4.0 (% by weight) are preferably used as the binder resin of the toner of the present invention.

The glass transition temperature (Tg) and the softening point [T(F1/2)] of the crystalline polyester resin included in the toner are preferably as low as possible as long as the high temperature preservability of the resultant toner does not deteriorate. Specifically, the glass transition temperature of the crystalline polyester resin is generally from 80 to 130° C. and preferably from 80 to 125° C. The softening point [T(F1/2)] thereof is generally from 80 to 130° C., and preferably from 80 to 125° C. When the glass transition temperature and softening point are too high, the lowest fixable temperature of the toner increases, namely the low temperature fixability of the toner deteriorates.

Wax

Known waxes can be used as the wax included in the toner. Suitable waxes include waxes having a carbonyl group, polyolefin waxes, amide waxes, long chain hydrocarbons, salts of aliphatic carboxylic acids, etc.

Specific examples of the waxes having a carbonyl group include polyalkane acid esters such as camauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as tristearyl trimellitate, and distearyl maleate; polyalkylamides such as trimellitic acid tristearylamide; dialkyl ketone such as distearyl ketone, etc. Among these materials, polyalkane acid esters are preferable.

Specific examples of polyolefin waxes include polyethylene waxes and polypropylene waxes.

Specific examples of the amide waxes include lauramide, palmitamide, stearamide, ercamide, behenamide, N-stearylstearamide, methylolstearamide, methylolbehenamide, dimethytol amide, dimethyllauramide, dimethylstearamide, N-palmitylpalmitamide, ethylenbiscapronamide, methylenbisstearamide, ethylenebislauramide, hexamethylenebisoleamide, hexamethylenebisstearamide, butylenebisstearamide, m-xylylenebisstearamide, m-xylylenebis-12-hydroxystearamide, N,N'-dioleyladipamide, N,N'-distearyladipamide, N,N'-distearylisophthalamide, N,N'-distearylterephthalamide, N-butyl-N'-stearylurea, N-propyl-N'-stearylurea, N-aryl-N'-stearylurea, N-stearyl-N'-stearylurea, etc.

Specific examples of the long chain hydrocarbons include paraffin waxes, SAZOL waxes, etc.

Specific examples of the salts of aliphatic carboxylic acids include sodium laurate, potassium laurate, hydrogen potassium laurate, magnesium laurate, calcium laurate, zinc laurate, silver laurate, lithium myristate, sodium myristate, potassium hydrogen myristate, magnesium myristate, calcium myristate, zinc myristate, silver myristate, lithium palmitate, potassium palmitate, magnesium palmitate, magnesium palmitate, calcium palmitate, zinc palmitate, copper palmitate, lead palmitate, thallium palmitate, cobalt palmitate, sodium oleate, potassium oleate, magnesium oleate, calcium oleate, zinc oleate, lead oleate, thallium oleate, copper oleate, nickel oleate, sodium stearate, lithium stearate, magnesium stearate, calcium stearate, barium stearate, aluminum stearate, thallium stearate, lead stearate, nickel stearate, beryllium stearate, sodium isostearate, potassium isostearate, magnesium isostearate, calcium isostearate, barium isostearate, aluminum isostearate, zinc isostearate, nickel isostearate, sodium behenate, potassium behenate, magnesium behenate, calcium behenate, barium behenate, aluminum behenate, zinc behenate, nickel behenate, sodium montanate, potassium montanate, magnesium montanate, calcium montanate, barium montanate, aluminum montanate, zinc montanate, nickel montanate, etc.

Among these waxes, amide waxes are preferable. When a toner including an amide wax is used for image forming apparatus equipped with a fixing device having an oil coating device coating a silicone oil, the amide wax exuding from a toner image forms a film on the toner image. Since the film repels the silicone oil (i.e., the silicone oil does not penetrate into the toner image), the toner image has good abrasion resistance.

The content of the wax in the toner is preferably from 1.5 to 9 parts by weight, and more preferably from 2 to 8 parts by weight, per 100 parts by weight of the binder resin included in the toner. When the content is too low, the toner has poor releasability from fixing members. When the content is too high, the amount of wax in a surface portion of the toner increases, resulting in decrease of the charge quantity of the toner.

When an amide wax is included in the toner, the content of the amide wax in the toner is preferably from 0.5 to 5 parts by weight, and more preferably from 1 to 4 parts by weight, per 100 parts by weight of the binder resin included in the toner. When the content is too low, the fixability improving effect (i.e., oil spread preventing effect) cannot be produced. When the content is too high, problems in that the charge quantity of the toner decreases and a toner film is formed on carrier particles and image forming members such as developing rollers occur.

The melting point of the wax included in the toner is preferably from 70 to 165° C. When the melting point is too low, the toner has poor high temperature preservability. When the melting point is too high, the toner causes a cold offset in that when a toner image is fixed by a fixing member at a relatively low temperature, the toner image is transferred to the fixing member.

The melt viscosity of the wax included in the toner is preferably from 0.005 to 1 Pa·s (5 to 1000 cps), and more preferably from 0.01 to 0.1 Pa·s (10 to 100 cps). When the melt viscosity is too low, the toner has poor releasability. When the melt viscosity is too high, the hot offset resistance and low temperature fixability of the toner is hardly improved.

Colorant

The toner for use in the image forming apparatus of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The color of the colorant is not particularly limited, and black colorants and colorants having other colors can be used. As mentioned above, two or more colorants having different colors can be used in combination.

Specific examples of the black colorants include carbon blacks (C.I. Pigment Black 7) such as furnace black, lamp black, acetylene black, and channel black; metals and metal compounds such as copper, iron (C.I. Pigment Black 11) and titanium oxide; and organic pigments such as Aniline Black.

Specific examples of the magenta colorants include C.I. Pigment Red 1, 2, 3, 4, 5, 6, 7, 8, 9, 10, 11, 12, 13, 14, 15, 16, 17, 18, 19, 20, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209 and 211; C.I. Pigment Violet 19; C.I. Vat Red 1, 2, 10, 13, 15, 23, 29 and 35, etc.

Specific examples of the cyan colorants include C.I. Pigment Blue 2, 3, 15, 15:1, 15:2, 15:3, 15:4, 15:6, 16, 17 and 60; C.I. Vat Blue 6; C.I. Acid Blue 45; copper phthalocyanine pigments having one to five phthalimidemethyl groups connected with the phthalocyanine body; C.I. Pigment Green 7 and 36; etc.

Specific examples of the yellow colorants include C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154 and 180; C.I. Vat Yellow 1, 3 and 20; C.I. Pigment Orange 36; etc.

The content of the colorants in the toner for use in the present invention is preferably from 1 to 15% by weight, and more preferably from 3 to 10% by weight. When the content is too low, the resultant toner has low tinting power. When the content is too high, the colorants cannot be well dispersed in the toner, resulting in deterioration of the tinting power and electric properties of the toner.

Master batches, which are complexes of a colorant with a resin, can be used as the colorant of the toner of the present invention.

Specific examples of the resins for use as the binder resin of the master batches include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic acid resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent and water, if desired are removed from the mixture can be preferably used because the resultant wet cake can be used as it is without being dried. When performing the mixing and kneading process, dispersing devices capable of applying a high shearing force such as three roll mills can be preferably used.

Charge Controlling Agent

The toner for use in the present invention can include a charge controlling agent, if desired. Any known charge controlling agents can be used for the toner. It is preferable to use colorless or white charge controlling agents to prevent change of the color tone of the resultant toner.

Suitable examples of the charge controlling agents include Nigrosine dyes, triphenyl methane dyes, molybdic acid chelate pigments, Rhodamine dyes, alkoxyamines, quaternary ammonium salts, fluorine-containing quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON P-51 (quaternary ammonium salt), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, a quaternary ammonium group, etc.

The charge controlling agent is kneaded together with a masterbatch, and the mixture is used for preparing toner particles. Alternatively, the charge controlling agent is dissolved or dispersed in an organic solvent together with other toner constituents when toner particles are prepared by a wet method. It is also possible to adhere and fix a charge controlling agent to a surface of toner particles which are previously prepared.

The content of the charge controlling agent in the toner for use in the present invention is determined depending on the variables such as choice of binder resin, presence of additives, and dispersion method. In general, the content the charge controlling agent is preferably from 0.1 to 10 parts by weight, and more preferably from 0.2 to 5 parts by weight, per 100 parts by weight of the binder resin included in the toner. When the content is too low, a good charge property cannot be imparted to the toner. When the content is too high, the charge quantity of the toner excessively increases, and thereby the electrostatic attraction between the developing roller and the toner increases, resulting in deterioration of fluidity and decrease of image density.

External Additive

The toner for use in the present invention can include an external additive, which is typically present on the surface of toner particles. Known materials for use as the external additives for toner can be used.

Suitable materials for use as the external additive of the toner include silica, hydrophobized silica, fatty acid metal salts such as zinc stearate and aluminum stearate, metal oxides such as titanium oxide, aluminum oxide, tin oxide and antimony oxide, which may be hydrophobized, fluoropolymers, etc.

Among these materials, hydrophobized silica, titanium oxide, and hydrophobized titanium oxide are preferably used.

Specific examples of silica include HDK H 2000, HDK H 2000/4, HDK H 2050EP, HVK21 and HDK H 1303, which are manufactured by Hoechst AG; and R972, R974, RX200, RY200, R202, R805 and R812, which are manufactured by Nippon Aerosil Co. Specific examples of the titanium oxide include P-25 manufactured by Nippon Aerosil Co.; STT-30 and STT-65C-S, which are manufactured by Titan Kogyo K.K.; TAF-140 manufactured by Fuji Titanium Industry Co., Ltd.; MT-150W, MT-500B, MT-600B and MT-150A, which are manufactured by Tayca Corp.; etc. Specific examples of the hydrophobized titanium oxides include T-805 manufactured by Nippon Aerosil Co.; STT-30A and STT-65S-S, which are manufactured by Titan Kogyo K.K.; TAF-500T and TAF-1500T, which are manufactured by Fuji Titanium Industry Co., Ltd.; MT-100S and MT-100T, which are manufactured by Tayca Corp.; IT-S manufactured by Ishihara Sangyo Kaisha K.K.; etc.

Suitable hydrophobizing agents for use in the hydrophobizing treatment of inorganic materials (such as silica, titanium oxide and aluminum oxide) include silane coupling agents such as methyl trimethoxy silane, methyl triethoxy silane, octyl trimethoxy silane, dialkyldihalogenated silane, trialkylhalogenated silane, alkyltrihalogenated silane, hexaalkyldisilazane, silylation agents, silane coupling agents having a fluoroalkyl group; organic titanate coupling agents, aluminum coupling agents, silicone oils and silicone varnishes.

Specific examples of the silicone oils include dimethyl silicone oils, methylphenyl silicone oils, chrolophenyl silicone oils, methylhydrodiene silicone oils, alkyl-modified silicone oils, fluorine-modified silicone oils, polyether-modified silicone oils, alcohol-modified silicone oils, amino-modified silicone oils, epoxy-modified silicone oils, epoxy/polyether-modified silicone oils, phenol-modified silicone oils, carboxyl-modified silicone oils, mercapto-modified silicone oils, (meth)acrylic-modified silicone oils, α-methylstyrene-modified silicone oils, etc.

Inorganic materials, which are treated with a silicone oil upon application of heat if desired, can also be preferably used as the external additive. Specific examples of the particulate inorganic materials to be treated include silica, aluminum oxide, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Among these inorganic materials, silica and titanium oxide are preferably used.

The average primary particle diameter of the inorganic materials for use as the external additive is from 1 to 100 nm, and preferably from 3 to 70 nm. When the average primary particle diameter is too small, the inorganic materials tend to be embedded into toner particles, and thereby the function of the external additive cannot be fulfilled. In contrast, when the average primary particle diameter is too large, a problem in that the surface of the photoreceptor used is damaged by the external additive is caused.

When an inorganic material and a hydrophobized inorganic material are used in combination, the hydrophobized inorganic material preferably has an average primary particle diameter of from 1 to 100 nm, and more preferably from 5 to 70 nm. In addition, it is preferable to use at least two kinds of hydrophobized inorganic materials each having an average primary particle diameter of not greater than 20 nm, and at least one kind of inorganic material having an average primary particle diameter of not less than 30 nm for the external additive.

The inorganic materials for use as the external additive preferably have a specific surface area (measured by a BET method) of from 20 to 500 $m^2/g$.

The added amount of the external additive is from 0.1 to 5% by weight, and preferably from 0.3 to 3% by weight, based on the weight of the toner.

In addition, particulate polymers such as polymers and copolymers of styrene, methacrylate and acrylate, which are prepared by a method such as soap-free emulsion polymerization methods, suspension polymerization methods, and dispersion polymerization methods; polycondensation resins such as silicone resins, benzoguanamine resins and nylon resins; and thermosetting resins, can be used as external additives. By using such particulate resins in combination with another external additive, the charging properties of the toner can be improved. Specifically, the amount of reversely charged toner particles can be decreased, resulting in prevention of a background development problem in that the background of images is soiled with toner particles.

The added amount of such a particulate resin is from 0.01 to 5% by weight, and preferably from 0.1 to 2% by weight, based on the weight of the toner.

Other Additives

The toner for use in the present invention can include other additives such as fluidity improving agents, cleanability improving agents, magnetic materials, metal soaps, etc.

The fluidity improving agents are used for the toner such that the toner has good hydrophobicity and can maintain good fluidity and charge properties even under high humidity conditions. Specifically, fluidity improving agents are treated on the toner or external additive. Specific examples of the fluidity improving agents include silane coupling agents, silylation agents, silane coupling agents having a fluoroalkyl group; organic titanate coupling agents, aluminum coupling agents, silicone oils and modified silicone oils.

The toner for use in the present invention preferably includes a cleanability improving agent which can impart good cleaning property to the toner such that the toner remaining on the surface of an image bearing member such as photoreceptors even after a toner image is transferred can be easily removed. Specific examples of such cleanability improving agents include fatty acids and metal salts of fatty acids such as stearic acid, zinc stearate and calcium stearate; and particulate polymers such as polymethylmethacrylate and polystyrene, which are manufactured by a method such as soap-free emulsion polymerization methods.

Particulate resins having a relatively narrow particle diameter distribution and a volume average particle diameter of from 0.01 μm to 1 μm are preferably used as the cleanability improving agent.

Specific examples of the magnetic materials include known magnetic materials. Specific examples thereof include powders of iron, magnetite, ferrite, etc. Among these materials, white materials are preferably used as the magnetic material.

The toner for use in the present invention can be prepared by any known methods such as kneading/pulverization methods in which a toner composition mixture is melted and kneaded, followed by cooling, pulverization and classification, and other methods such as polymerization methods, solution suspension methods and spray granulation methods.

One example of the kneading/pulverization methods is as follows.

(1) toner constituents such as binder resins, colorants and release agents (such as waxes) are mechanically mixed (mixing process);
(2) the mixture is heated and kneaded (kneading process);
(3) the kneaded mixture is cooled and then pulverized (pulverization process); and
(4) the pulverized mixture is classified (classification process).

The melt kneading operation is performed using, for example, a kneader such as continuous single- or double-axis kneaders and batch kneaders such as roll mills. Specific examples thereof include KTK double-axis extruders manufactured by Kobe Steel, Ltd., TEM double-axis extruders manufactured by Toshiba Machine Co., Ltd., double-axis extruders manufactured by KCK, PCM double-axis extruders manufactured by Ikegai Corp., and KO-KNEADER manufactured by Buss AG.

It is preferable that the kneading operation is performed while controlling the kneading temperature such that the molecular chain of the binder resin used is not cut. Specifically, when the kneading temperature is higher than the softening point of the binder resin, the molecular chain is seriously cut. In contrast, when the kneading temperature is lower than the melting point, the dispersion operation cannot be well performed.

When the kneaded mixture is pulverized, it is preferable that the kneaded mixture is crushed at first, followed by pulverization. In the pulverization process, a method in which particles are collided to a plate using jet air; a method in which particles are collided to each other using jet air; and a method in which particles are pulverized at a narrow gap between a rotor and a stator are preferably used.

The thus prepared toner particles are then classified so that the resultant particles have the predetermined particle diameter. The classification treatment is performed using a cyclone, a decanter or a method utilizing centrifuge to remove fine particles therefrom.

After the pulverization operation and classification operation are performed, the pulverized material is subjected to classification in an air stream utilizing centrifuge to prepare toner particles having the predetermined particle diameter.

The thus prepared toner particles are mixed with an external additive. By mixing an external additive and the toner particles while agitating, the external additive is dissociated so as to cover the surface of the toner particles. In this regard, it is important to strongly affix the external additive (such as particulate inorganic materials and particulate resins) to the toner particles in order to impart good durability to the toner.

Polymerization Methods

Suitable polymerization methods include methods including dissolving or dispersing toner constituents including a colorant and a modified polyester resin (which can form a urea or urethane bond) in an organic solvent to prepare a toner constituent liquid; dispersing the toner constituent liquid in an aqueous medium; subjecting the modified polyester resin to addition polymerization; removing the solvent from the reaction product; and then washing the reaction product.

Suitable resins for use as the modified polyester resin include polyester prepolymers having an isocyanate group, which are prepared by reacting a polyisocyanate compound (PIC) with a polyester resin having a carboxyl group or a hydroxyl group at the end portion thereof. The polyester prepolymer is then subjected to a crosslinking reaction or a molecular chain growth reaction using an amine, etc. The thus prepared modified polyester resin having a urea or urethane bond can impart a good combination of low temperature fixability and hot offset resistance to the toner.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., $\alpha, \alpha, \alpha', \alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., the equivalence ratio [NCO]/[OH]) of the [NCO] group of a polyisocyanate (PIC) to the [OH] group of a polyester is from 5/1 to 1/1, preferably from 4/1 to 1.2/1 and more preferably from 2.5/1 to 1.5/1.

The average number of the isocyanate group included in a molecule of the polyester prepolymer is generally not less than 1, preferably from 1.5 to 3, and more preferably from 1.8 to 2.5.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine, etc. Specific examples of the amino alcohols (B3) include ethanol amine, hydroxyethyl aniline, etc. Specific examples of the amino mercaptan (B4) include aminoethyl mercaptan, aminopropyl mercaptan, etc. Specific examples of the amino acids (B5) include aminopropionic acid, aminocaproic acid, etc. Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc. Among these amines, diamines (B1) and mixtures of a diamine (B1) with a small amount of a polyamine (B2) are preferably used.

The mixing ratio (i.e., the equivalence ratio [NCO]/[NHx]) of the [NCO] group of the prepolymer having an isocyanate group to the [NHx] group of the amine is from 1/2 to 2/1, preferably from 1/1.5 to 1.5/1 and more preferably from 1/1.2 to 1.2/1.

By using such a polymerization method, toner having a small particle diameter and a spherical form can be manufactured at a low cost with low environmental load.

The color of the toner is not particularly limited. When full color images are produced, a combination of black, cyan, magenta and yellow color toners is preferably used. Such color toners can be prepared by properly selecting one or more colorants from the above-mentioned colorants.

The volume average particle diameter of the toner is not particularly limited. The volume average particle diameter is determined by, for example, the following method.

(1) Instrument: COULTER MULTISIZER II (from Beckman Coulter Inc.);
(2) Diameter of aperture: 100 μm;
(3) Analysis software: COULTER MULTISIZERACUCOMP VER. 1.19 (from Beckman Coulter Inc.);
(4) Electrolyte: ISOTON II (from Beckman Coulter Inc.);
(5) Dispersant: EMULGEN 109P (polyoxyethylene lauryl ether having HLB of 13.6 from Kao Corp., which is mixed with the electrolyte in a weight ratio of 5:95 (i.e., 5%));
(6) Dispersing method: Ten (10) mg of a sample (toner) is added to the dispersant, and the mixture is subjected to a supersonic dispersing treatment for 1 minute. The mixture is then mixed with 25 ml of the electrolyte and the mixture is subjected to a supersonic dispersing treatment for 1 minute to prepare a dispersion.
(7) Measuring method: The dispersion prepared above is mixed with 100 ml of the electrolyte in a beaker. The particle diameters of 30,000 particles in the dispersion are measured over 20 seconds using the instrument to determine the particle diameter distribution of the sample. The average particle diameter of the sample is determined by the particle diameter distribution.

Developer

The developer used for the image forming method of the present invention may be a one-component developer including the toner and no carrier or a two-component developer including the toner and a carrier. When the developer is used for high speed image forming apparatuses, the developer is preferably a two-component developer.

When the toner mentioned above is used as a one component developer, the developer has the following advantages.

(1) Even when the developer is used for a long time while a fresh developer (toner) is replenished, the particle diameter distribution of the developer hardly changes; and (2) Even when the developer is used for a long time, the developer does not cause a problem in that the developer is adhered and fixed to the developing roller and developer layer forming blade used, resulting in formation of a toner film thereon.

Therefore images having good image qualities can be produced for a long period of time.

When the toner is used for the two component developer, the developer has the following advantages.

(1) Even when the developer is used for a long time while a fresh toner is replenished, the particle diameter distribution of the toner hardly changes; and (2) Even when the developer is agitated in the developing device, the developer can maintain good developing ability.

Therefore images having good image qualities can be produced.

Carrier

The carrier for use in the two component developer of the present invention is not particularly limited, and one or more proper carriers are chosen while considering the application of the developer. However, it is preferable to use a carrier in which a core material is coated with a resin.

Suitable materials for use as the core material include manganese-strontium materials and manganese-magnesium materials, which have a saturation magnetization of from 50 to 90 $Am^2/kg$ (90 emu/g). In view of image density, iron powders (having a a saturation magnetization not less than 100 $Am^2/kg$ (100 emu/g) and magnetite having a saturation magnetization of from 75 to 120 $Am^2/kg$ (75 to 120 emu/g) are preferably used. In addition, copper-zinc materials having a saturation magnetization of from 30 to 80 $Am^2/kg$ (30 to 80 emu/g) can be preferably used because the impact of the magnetic brush against the photoreceptor is relatively weak and high quality images can be produced.

These carrier materials can be used alone or in combination.

The core material of the carrier preferably has a volume average particle diameter ($D_{50}$) of from 10 to 200 μm, and more preferably from 40 to 100 μm. When the volume average particle diameter is too small, a carrier scattering problem tends to occur because the particles have weak magnetization. When the particle diameter is too large, the surface area of the carrier per unit weight decreases and thereby a toner scattering problem tends to occur. In addition, another problem in that uneven solid images are formed tends to occur.

Specific examples of such resins to be coated on the carriers include amino resins, vinyl or vinylidene resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, silicone resins, etc.

These resins are used alone or in combination. Among these resins, silicone resins are preferably used.

The silicone resin for use in covering carrier particles is not particularly limited, and any known silicone resins can be used. Specific examples of the commercialized strait silicone resins include KR271, KR255, KR152 (which are manufactured by Shin-Etsu Chemical Co., Ltd.), SR2400, SR2406, and SR2410 (which are manufactured by Dow Corning Toray Silicone Co., Ltd.). Specific examples of the commercialized modified silicone resins include KR206 (alkyd-modified), KR5208 (acrylic-modified), ES1001N (epoxy-modified), KR305 (urethane-modified) (which are manufactured by Shin-Etsu Chemical Co., Ltd.), SR2115 (epoxy-modified), and SR2110 (alkyd-modified) (which are manufactured by Dow Corning Toray Silicone Co., Ltd.).

Although only a silicone resin can be used for forming the cover layer, additives such as crosslinking agents and charge controlling agents can be used in combination.

If desired, an electroconductive powder can be included in the resin layer of the carrier. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the coating layer.

The resin layer can be formed by coating a resin solution which is prepared by dissolving a resin in a solvent on a core material using any known coating method, followed by drying and baking. Suitable coating methods include dip coating methods, spray coating methods, brush coating methods, etc.

Specific examples of the solvent include toluene, xylene, methyl ethyl ketone, methyl isobutyl ketone, cellosolve, butyl acetate, etc.

The method for baking the coated resin layer is not particularly limited, and external heating methods and internal heating methods can be used. For example, methods using a heating device such as fixed electric furnaces, fluid electric furnaces, rotary electric furnaces, and burner furnaces, and methods using microwave, are preferably used.

The coated amount of the resin is preferably 0.01 to 5.0% by weight based on the weight of the carrier. When the coated amount is too small, a uniform resin layer cannot be formed. When the coated amount is too large, the carrier particles aggregate, and thereby the toner cannot be uniformly charged.

The weight ratio of the toner to the carrier in the two component developer is from 10/90 to 2/98, and preferably from 7/93 to 3/97.

Next, the developing device will be explained.

The developing device may be a dry developing device using a dry developer or a wet developing device using a liquid developer. In addition, the developing device may be a monochrome developing device or a multi-color developing device. For example, developing devices including an agitator for agitating a developer (or toner) and a developing roller having a magnet roller can be preferably used.

In the developing device, a toner and a carrier are mixed and agitated to frictionally charge the toner. The developer including the toner is borne on the surface of the developing roller due to the magnetic force of the magnet roller while forming a magnetic brush. Since the developing roller is set close to the latent image bearing member (such as photoreceptor drums), part of particles of the toner in the magnetic brush is electrically attracted by an electrostatic latent image on the latent image bearing member, resulting in transfer of the toner particles to the latent image. Thus, the latent image is developed with the toner, resulting in formation of a toner image on the surface of the latent image bearing member. In this regard, the developer may be a one-component developer or a two-component developer.

One-Component Developing Device Using One-Component Developer

Suitable one-component developing devices include devices including a developer bearing member to which a one-component developer is supplied, and a developer layer controlling member for forming a thin layer of the developer on the surface of the developer bearing member.

Figure 5:
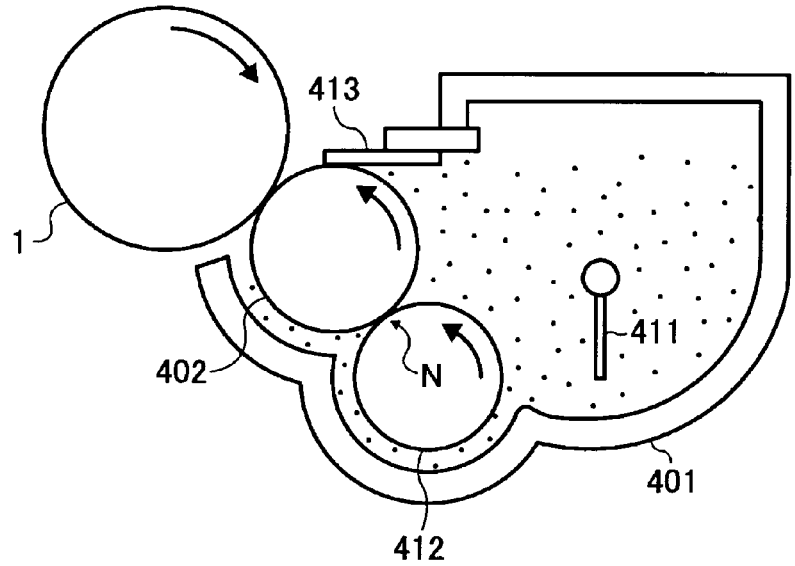
FIG. 5 is a schematic view illustrating a one-component developing device for use in the image forming apparatus of the present invention.

FIG. 5 is a schematic view of a one-component developing device. The one-component developing device use a one-component developer (i.e., a toner), and includes a developer bearing member 402 on which a thin toner layer is formed. The toner layer on the developer bearing member 402 is contacted with a photoreceptor drum 1 serving as a latent image bearing member to develop an electrostatic latent image thereon.

Referring to FIG. 5, the toner in a casing 401 is agitated by rotation of an agitator 411, and the agitated toner is supplied to a supply roller 412. The supply roller 412 is made of a foamed polyurethane and has a flexibility. Therefore, the toner can be easily held by cells with a diameter of from 50 to 500 μm, which are formed on the surface of the supply roller 412. In addition, since the supply roller 412 is soft and has a JIS-A hardness of from 10 to 30 degree, the supply roller can be uniformly contacted with the developing roller 402.

In FIG. 5, the supply roller 412 and the developing roller 402 are rotated in the same direction, namely the surface of the supply roller and the surface of the developing roller move in opposite directions at a nip N in which the supply roller is contacted with the developing roller. However, the supply roller 412 and the developing roller 402 may be rotated in the opposite direction. The ratio (S/D) of the linear speed (S) of the supply roller 412 to that (D) of the developing roller 402 is preferably from 0.5 to 1.5. In this developing device, the ratio (S/D) is set to 0.9. The surface portion of the supply roller 412 is deformed by the developing roller 402 at a depth of from 0.5 to 1.5 mm at the nip N. In this developing device, the torque needed for rotating the rollers is from 14.7 to 24.5 N·cm when the effective width of the developing device is 240 mm (i.e., A-4 size).

The developing roller 402 has a structure such that a rubber layer is formed on an electroconductive substrate and has a diameter of from 10 to 30 mm. The surface of the rubber layer is roughened so as to have a ten-point mean roughness Rz of from 1 to 4 μm. In this regard, the roughness Rz is preferably 13 to 80% of the average particle diameter of the toner used so that the toner can be well transported. More preferably, the roughness Rz is 20 to 30% of the average particle diameter of the toner so that the toner on the developing roller is sufficiently charged.

Specific examples of the rubber materials for use in the rubber layer of the developing roller include silicone rubbers, butadiene rubbers, NBRs, hydrin rubbers, EPDM rubbers, etc. It is preferable to form a cover layer on the rubber layer. Specific examples of the materials for use in the cover layer include silicone-based materials and fluorine-containing materials such as TEFLON. Silicone-based materials can well charge a toner, and fluorine-containing materials have good releasability. Carbon blacks can be included in the cover layer to impart electroconductivity to the layer. The thickness of the cover layer is preferably from 5 to 50 μm. When the thickness is out of the range, a problem in that the cover layer is cracked tends to occur.

The toner, which is located on the surface of the supply roller 412 (and located in the cells formed on the supply roller) and which has a predetermined polarity, is nipped by the developing roller 402 and the supply roller 412 at the nip N, resulting in frictional charging of the toner. Due to this charging and the roughened surface of the developing roller 402, the toner is borne on the surface of the developing roller 402. In this case, the toner layer thus formed on the developing roller 402 is thick (about 1 to 3 mg/cm$^2$) and uneven.

By contacting a thickness controlling blade 413 (hereinafter referred to as a blade) with the surface of the developing roller 402, a uniform thin toner layer is formed on the surface of the developing roller. In FIG. 5, the blade 413 is set in such a manner that the developing roller trails the blade. However, the blade 413 may be set to counter the developing roller or may be subjected to edge contact with the developing roller.

It is preferable that the blade 413 is made of a metal such as stainless steels (such as SUS 304) and has a thickness of from 0.1 to 0.15 mm. Alternatively, the blade 413 may be made of a relatively hard resin or rubber having a thickness of from 1 to 2 mm. By applying a voltage to the blade 413, an electric field can be formed between the blade and the developing roller. In this regard, when a resin or rubber is used for the blade, electroconductive materials such as carbon blacks are preferably included therein to impart electroconductivity to the blade.

The blade 413 preferably has a free end portion (which is not contacted with a holder) having a length of from 10 to 15 mm. When the length of the free end portion is too long, the size of the developing device increases. When the length is too short, the blade 413 is vibrated when contacted with the developing roller 402, resulting in formation of a toner layer with uneven thickness, thereby forming uneven-density stripe images.

The contact pressure at which the blade 413 is contacted with the developing roller 402 is preferably from 0.049 to 2.45 N/cm. When the contact pressure is too high, the thickness (i.e., weight) of the developer layer formed on the developing roller 402 excessively decreases, and in addition the charge quantity of the toner excessively increases, resulting in decrease of the image density. When the contact pressure is too low, the thickness of the developer layer varies (i.e., a developer layer with an even thickness cannot be formed) and in addition aggregates of toner particles pass the nip between the developing roller 402 and the blade 413, resulting in serious deterioration of image qualities.

The conditions of this example of the developing device are as follows.

Hardness of rubber layer of developing roller: 30° (JIS-A hardness)

Material of blade: Stainless steel (SUS) with thickness of 0.1 mm

Contact pressure of blade: 0.588 N/cm (60 gf/cm) (linear pressure)

Under these conditions, a developer layer with a desired weight can be formed on the developing roller 402.

The angle formed by the free end portion of the blade 413 and the tangent line of a point of the developing roller to which the blade is contacted is preferably 10 to 45°.

Under these conditions, a developer layer (i.e., a toner layer) having a weight of from 0.4 to 0.8 mg/cm$^2$ is formed on the developing roller 402. In this case, the toner has a charge of from −10 to −30 μC/g. Therefore, electrostatic images on the photoreceptor 1 are well developed with the toner.

In this example of the one-component developing device, the gap between the surface of the photoreceptor 1 and the surface of the developing roller 402 is narrower than those of conventional two-component developing devices. Therefore, the developing device has better developing ability than conventional two-component developing devices, namely, the developing device can develop electrostatic latent images even when the latent images have low potentials.

Two-Component Developing Device

Two-component developing devices having a developer bearing member which has a magnetic field generation member therein and which bears a two-component developer including a magnetic carrier and a toner on the surface thereof are preferably used for the image forming apparatus of the present invention.

Figure 6:
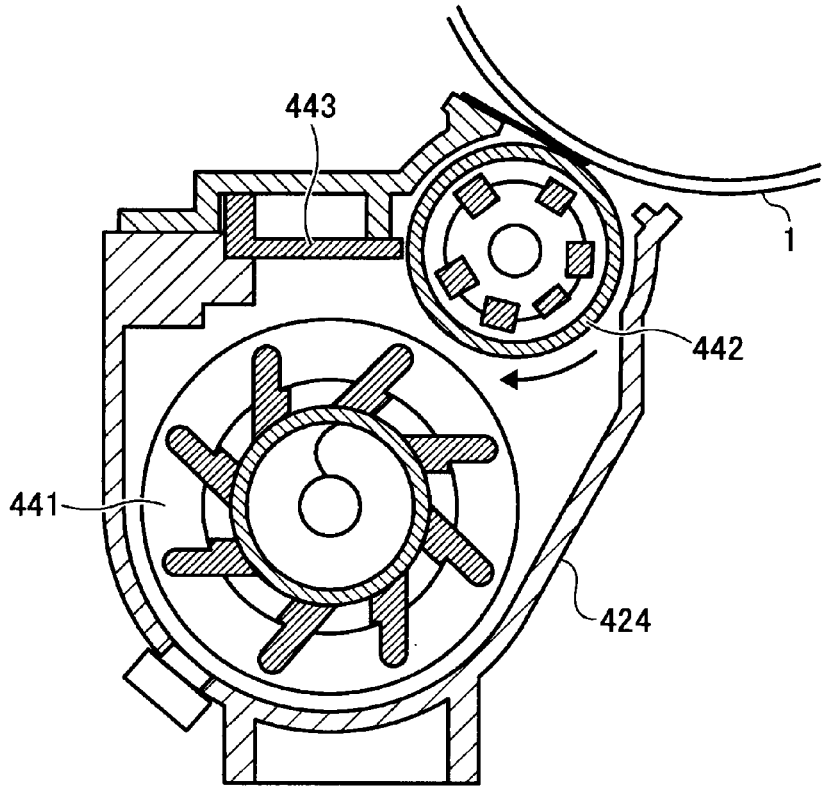
FIG. 6 is a schematic view illustrating a two-component developing device for use in the image forming apparatus of the present invention.

A two-component developing device is illustrated in FIG. 6. In a developing device 424 illustrated in FIG. 6, the developer is agitated and fed by a screw 441 to a development sleeve 442 serving as a developer bearing member. The developer thus fed to the development sleeve 442 is regulated by a developer layer thickness controlling blade 443 (hereinafter referred to as a doctor blade). The thickness of the developing layer is controlled by adjusting the gap (i.e., doctor gap) between the development sleeve 442 and the doctor blade 443. When the doctor gap is too narrow, the thickness of the developer layer excessively decreases, resulting in formation of low density images. When the doctor gap is too wide, a problem in that a thick developer layer is formed on the developing sleeve, and thereby the particles of the carrier are adhered to the electrostatic latent images on the photoreceptor 1 is caused.

Since a magnetic field generating member (e.g., magnets) is arranged in the development sleeve, the developer on the developing sleeve forms a magnetic brush (i.e., chains of the developer) along the magnetic lines of the magnets (i.e., the normal lines of the development sleeve).

The development sleeve 442 is arranged so as to be close to the photoreceptor 1, and a gap (development gap) is formed therebetween. Thus a development region in which the developing sleeve is opposed to the photoreceptor is formed. The development sleeve is a cylinder made of a nonmagnetic material such as aluminum, brass, stainless steel and electroconductive resins, and is rotated by a rotation driving device (not shown). The magnetic brush formed on the development sleeve is fed to the development region due to rotation of the development sleeve. Since a development bias is applied to the development sleeve by a power source (not shown) and thereby an electric field is formed between the development sleeve and the photoreceptor, the toner in the magnetic brush is separated from the carrier particles and adhered to the electrostatic latent images, resulting in formation of toner images. The development bias is typically a DC voltage or a DC voltage overlapped with an AC voltage.

The development gap is preferably from 5 to 30 times the particle diameter of the carrier particles included in the developer. Specifically, when the carrier particles have a diameter of 50 μm, the development gap is preferably from 0.5 to 1.5 mm. When the development gap is too wide, low density images are formed.

The doctor gap is preferably the same as or slightly greater than the development gap.

Although the diameters and linear speeds of the photoreceptor drum 1 and the development sleeve 442 are determined on the basis of the size and reproduction speed of the image forming apparatus, the ratio (D/S) of the linear speed (D) of the photoreceptor drum 1 to the linear speed (S) of the development sleeve is preferably not less than 1.1. It is preferable that a position sensor is provided after the developing device to determine the weight (or thickness) of toner adhered to latent images by measuring the optical reflectance of the toner image. On the basis of the data of the reflectance (i.e., the weight of the adhered toner), the development conditions are adjusted if necessary.

Transfer Process and Transfer Device

In the transfer process, a toner image formed on the image bearing member (photoreceptor) is transferred to a receiving material using a transfer device. The transfer device is broadly classified into direct transfer devices which transfer a toner image to a receiving material, and indirect transfer devices in which a toner image on the photoreceptor is primarily transferred to an intermediate transfer medium (primary transfer) and the toner image is then transferred to a receiving material (secondary transfer).

In the transfer process, the toner image is typically charged with a charger so as to be well transferred to a receiving material or an intermediate transfer medium. When multiple color images are formed, indirect transfer devices are preferably used. Specifically, plural color toner images formed on one or more photoreceptors are transferred to an intermediate transfer medium to form a combined color toner image, and the combined color toner image is then transferred to a receiving material.

Intermediate Transfer Medium

The intermediate transfer medium is not particularly limited, and any known intermediate transfer media such as transfer belts and rollers can be used.

The surface of the intermediate transfer medium preferably has a static friction coefficient of from 0.1 to 0.6, and more preferably from 0.3 to 0.5. The intermediate transfer medium preferably has a volume resistivity of from few Ω·cm to $10^3$ Ω·cm. In this case, charging of the intermediate transfer medium can be prevented, and the charges formed on the intermediate transfer medium by a charger to well transfer the toner image hardly remain thereon, resulting in prevention of occurrence of uneven transfer of toner images in the secondary transfer process. In addition, a secondary transfer bias can be effectively applied to the intermediate transfer medium.

The material constituting the intermediate transfer medium is not particularly limited, and any known materials can be used therefor. Specific examples of the materials are as follows.

(1) Single-layered belts made of a material with high Young's modulus such as polycarbonate resins (PC), polyvinylidene fluoride (PVDF), polyalkylene terephthalate (PAT), mixtures of PC and PAT, mixtures of an ethylene-tetrafluoroethylene copolymer (ETFE) and PC, mixtures of ETFE and PAT, polyimides containing carbon black, etc. These single-layered belts have advantages such that the belts are hardly deformed even when receiving a high stress, and shift of the belts in the width direction is hardly caused in a color image forming process.

(2) Multi-layered belts in which one or two layers are formed on a single-layered belt mentioned above in (1). The belts have advantages such that formation of hollow images due to high hardness of the single-layered belt can be prevented.

(3) Elastic belts made of an elastic material (such as resins, rubbers and elastomers) and having a low Young's modulus. The belts have an advantage such that formation of hollow line images can be prevented due to their high softness. In addition, by using a belt having a width greater than the width of the rollers for driving or stretching the belt, meandering of the belt can be prevented due to elastic force of the side edge portions without using ribs and a meandering preventing device, resulting in reduction of costs of the transfer device.

Among these intermediate transfer media, the elastic belts are preferable. The elastic belts are deformed when contacted with a receiving material at the transfer nip. Therefore, layered toner images (i.e., combined color toner image) on the intermediate transfer medium can be well transferred to a receiving material even when the receiving material has a rough surface because the surface of the intermediate transfer medium is elastically deformed so as to be contacted with recessed portions of the receiving material. Therefore, formation of hollow images can be prevented without excessively increasing the transfer pressure at the transfer nip even when receiving materials having a rough surface are used.

The material used for the elastic belts is not particularly limited. Specific examples of the resins for use in the elastic belts include polycarbonate resins, fluorine-containing resins (e.g., ETFE and PVDF), styrene resins such as polystyrene resins, chloropolystyrene resins, poly-α-methylstyrene resins, styrene-butadiene copolymers, styrene-vinyl chloride copolymers, styrene-vinyl acetate copolymers, styrene-maleic acid copolymers, styrene-(meth)acrylate copolymers (e.g., styrene-methyl (meth)acrylate copolymers, styrene-ethyl (meth)acrylate copolymers, styrene-butyl (meth)acrylate copolymers, styrene-octyl (meth)acrylate copolymers, and styrene-phenyl (meth)acrylate copolymers), styrene-methyl α-chloroacrylate, and styrene-acrylonitrile-acrylate copolymers; methyl methacrylate resins, butyl methacrylate resins, ethyl acrylate resins, butyl acrylate resins, butyl acrylate resins, modified acrylic resins (e.g., silicone-modified acrylic resins, vinyl chloride-modified acrylic resins, and acrylic urethane resins), vinyl chloride resins, vinyl chloride-vinyl acetate copolymers, rosin-modified maleic resins, phenolic resins, epoxy resins, polyester resins, polyethylene resins, polypropylene resins, polybutadiene resins, ionomer resins, polyurethane resins, silicone resins, ketone resins, ethylene-ethyl acrylate copolymers, xylene resins, polyvinyl butyral resins, polyamide resins, polyphenylene oxide resins, etc. These materials can be used alone or in combination.

Specific examples of the rubbers for use in the elastic belts include natural rubbers, butyl rubbers, fluorine-containing rubbers, acrylic rubbers, EPDM rubbers, NBRs, ABS rubbers, isoprene rubbers, SB rubbers, butadiene rubbers, ethylene-propylene rubbers, ethylene-propylene terpolymers, chloroprene rubbers, chlorosulfonated polyethylene rubbers, chlorinated polyethylene rubbers, urethane rubbers, syndiotactic 1,2-polybutadiene rubbers, epichlorohydrin rubbers, silicone rubbers, fluorine-containing rubbers, polysulfide rubbers, polynorbornene rubbers, hydrogenated nitrile rubbers, etc. These materials can be used alone or in combination.

Specific examples of the elastomers for use in the elastic belts include polystyrene-based thermoplastic elastomers, polyolefin-based thermoplastic elastomers, polyvinyl chloride-based thermoplastic elastomers, polyurethane-based thermoplastic elastomers, polyamide-based thermoplastic elastomers, polyurea-based thermoplastic elastomers, polyester-based thermoplastic elastomers, fluorine-containing thermoplastic elastomers, etc. These materials can be used alone or in combination.

Specific examples of the resistivity controlling agents for use in the elastic belts include carbon black, graphite, powders of metals (e.g., aluminum and nickel), metal oxides (e.g., tin oxide, titanium oxide, antimony oxide, indium oxide, potassium titanate, antimony oxide-tin oxide complexes (ATO), and indium oxide-tin oxide complexes (ITO)), etc. In addition, electroconductive particles in which particles of an insulating material such as barium sulfate, magnesium silicate, and calcium carbonate are covered with one or more electroconductive materials can also be used.

The surface of the elastic belt (intermediate transfer medium) preferably has a low friction coefficient to prevent contamination of the belt with toner particles, to well remove toner particles remaining on the belt after a secondary transfer process, and to well transfer toner images to receiving materials. For example, a layer including a binder resin such as polyurethane resins, polyester resins, and epoxy resins, and a particulate lubricating material having a low surface energy such as fluorine-containing resins, fluorine-containing compounds, carbon fluoride, titanium oxide, and silicone carbide, is formed on the surface of the elastic belt. Further, a layer, which is prepared by subjecting a fluorine-containing rubber to a heat treatment so that a large amount of fluorine atoms are present therein and which has a low surface energy, can also be used.

The method for preparing the elastic belts is not particularly limited, and for example the following methods can be used.

(1) Centrifugal molding methods in which a coating liquid (such as melted belt-forming materials and solutions of belt-forming materials) is fed into a rotating cylinder to form an endless film (i.e., belt) of the belt-forming material;
(2) Spray coating methods in which a coating liquid is sprayed against a plate or a cylinder to form a film of the belt-forming material;
(3) Dipping methods in which a cylinder is dipped into a coating liquid, followed by pulling up (and drying) to form an endless film of the belt-forming material on the surface of the cylinder;
(4) A coating liquid is fed into a gap between an inner mold and an outer mold to form an endless film of the belt-forming material; and
(5) A compound is wound around the surface of a cylinder and then the compound is subjected to a vulcanization polishing treatment to form an endless film of the belt-forming material on the surface of the cylinder.

The method for preventing elongation of the elastic belt is not particularly limited, and for example, the following methods can be used.

(1) Methods in which an elongation preventing material is included in the main (core) layer; and
(2) Methods in which a rubber layer is formed on a core layer which hardly elongates.

Specific examples of the elongation preventing materials include natural fibers such as cotton fibers and silk fibers; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, and phenolic fibers; fibers of inorganic materials such as carbon fibers, glass fibers, and boron fibers; metal fibers such as iron fibers and copper fibers; etc. Webs and strings of these fibers are preferably used for the core layer.

The method for preparing the core layer is not particularly limited, and for example, the following methods can be used.

(1) Methods in which an endless web is set on a cylinder and a cover layer is formed on the web;
(2) Methods in which an endless web is dipped into a coating liquid such as liquefied rubbers to form a rubber layer on one or both sides of the web; and
(3) Methods in which strings are wounded around a cylinder and a cover layer is formed on the strings.

The thickness of the cover layer is determined on the basis of the hardness of the material used therefor. When the cover layer is too thick, cracks are formed in the cover layer, and in addition the resultant intermediate transfer medium are largely elongated and contracted, resulting in formation of elongated or contracted images. Therefore, the thickness of the cover layer is preferably not greater than about 1 mm.

The transfer device (primary transfer device and secondary transfer device) preferably includes one or more transfer members for transferring toner images on the image bearing member (photoreceptor) to a receiving material. Specific examples of the transfer members include corona chargers, transfer belts, transfer rollers, pressure transfer rollers, adhesive transfer members, etc.

Receiving Material

The receiving material used for the image forming apparatus of the present invention is not particularly limited. In general, papers are used therefor, and one or more white inorganic pigments such as calcium carbonate are included in papers or a coating liquid including such white pigments is applied on papers in order to increase the whiteness thereof. Among the white inorganic pigments, calcium carbonate is typically used for the receiving material. However, the present inventors discover that receiving papers including a large amount of calcium carbonate cause problems such that toner images on a receiving paper sheet are scratched or rubbed by the backside of the following receiving paper sheet on the tray of the image forming apparatus. Therefore, the amount of calcium carbonate included in receiving papers, which is determined by a FTIR-ATR method using AVATOR 370 from Thermo Electron Co., and the equation (2) mentioned below, is preferably not greater than 0.6, and more preferably not greater than 0.5.

$$\text{Amount of } CaCO_3 = H(\text{peak } 1421\ cm^{-1})/H(\text{peak } 1036\ cm^{-1}) \qquad \text{formula (2)}$$

wherein H(peak 1421 $cm^{-}$) represents the height of the peak which is specific to calcium carbonate and which is observed at 1421 $cm^{-1}$, and H(peak 1036 $cm^{-1}$) represent the height of the peak which is specific to cellulose included in the paper and which is observed at 1036 $cm^{-1}$.

The penetration depth of the FTIR-ATR method depends on the wave number of the light used. When light with a wave number of 1421 $cm^{-1}$ is used, the penetration depth is about 0.6 μm. In this regard, the penetration depth ($d_p$) is defined as a depth at which the strength of the incident light decreases to 1/e, and is represented by the following equation.

$$d_p = \lambda_1 / 2\pi(\sin^2\theta - n_{21}^2)^{1/2}$$

wherein $n_{21}$ is n2/n1 wherein n1 represents the refractive index of the ATR crystal (i.e., 4.0 for Ge crystal) and n2 represents the refractive index of the sample, and $\lambda_1$ is λ/n1 and represents the wavelength of the light in the ATR crystal.

The receiving material is not limited to papers, and other materials such as polyethylene terephthalate films (for overhead projection (OHP) sheets) can also be used.

Transfer Device for Tandem Image Forming Apparatus

Tandem image forming apparatus include a plural image forming units each including at least an image bearing member, a charging device, a developing device, and a transfer device. In general, four image forming units are provided for forming yellow, magenta, cyan and black toner images. The four color images are prepared in parallel, and then overlaid on a receiving material optionally via an intermediate transfer medium. Therefore, full color images can be produced at a high speed.

Specific examples of the tandem image forming apparatus include the following.

Figure 7:
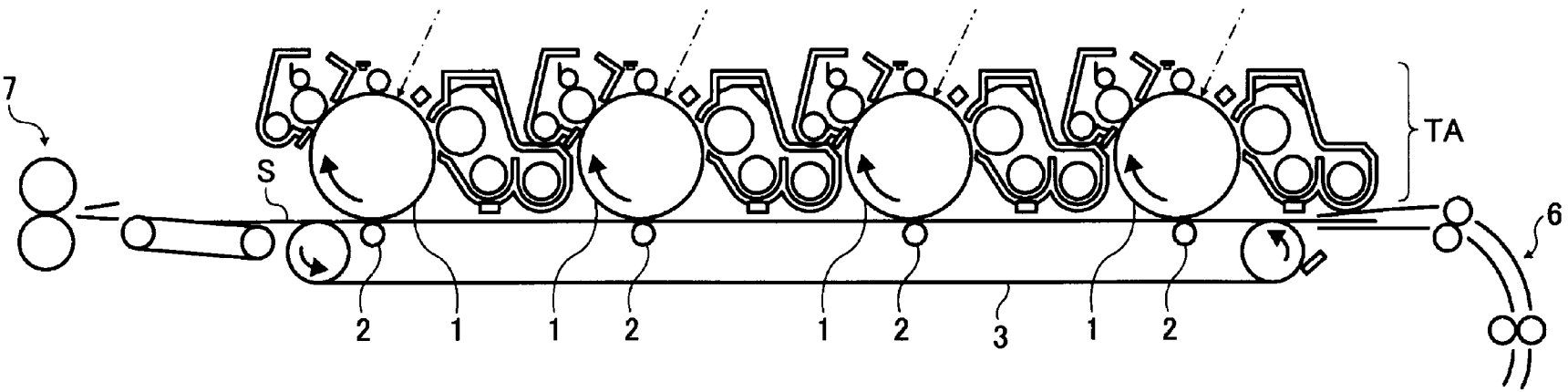
FIG. 7 is a schematic view illustrating another example of the image forming apparatus of the present invention, which uses a direct image transfer method.

(1) Image forming apparatus using a direct transfer method, an example of which is illustrated in FIG. 7. In the apparatus, color toner images formed on the plural photoreceptors 1 serving as image bearing members are transferred one by one by transfer devices 2 onto a receiving material S which is fed by a feeding belt 3. Thus a combined color toner image is formed on the receiving material S. The color toner image is then fixed by a fixing device 7, resulting in formation of a fixed full color toner image on the receiving material S.

Figure 8:
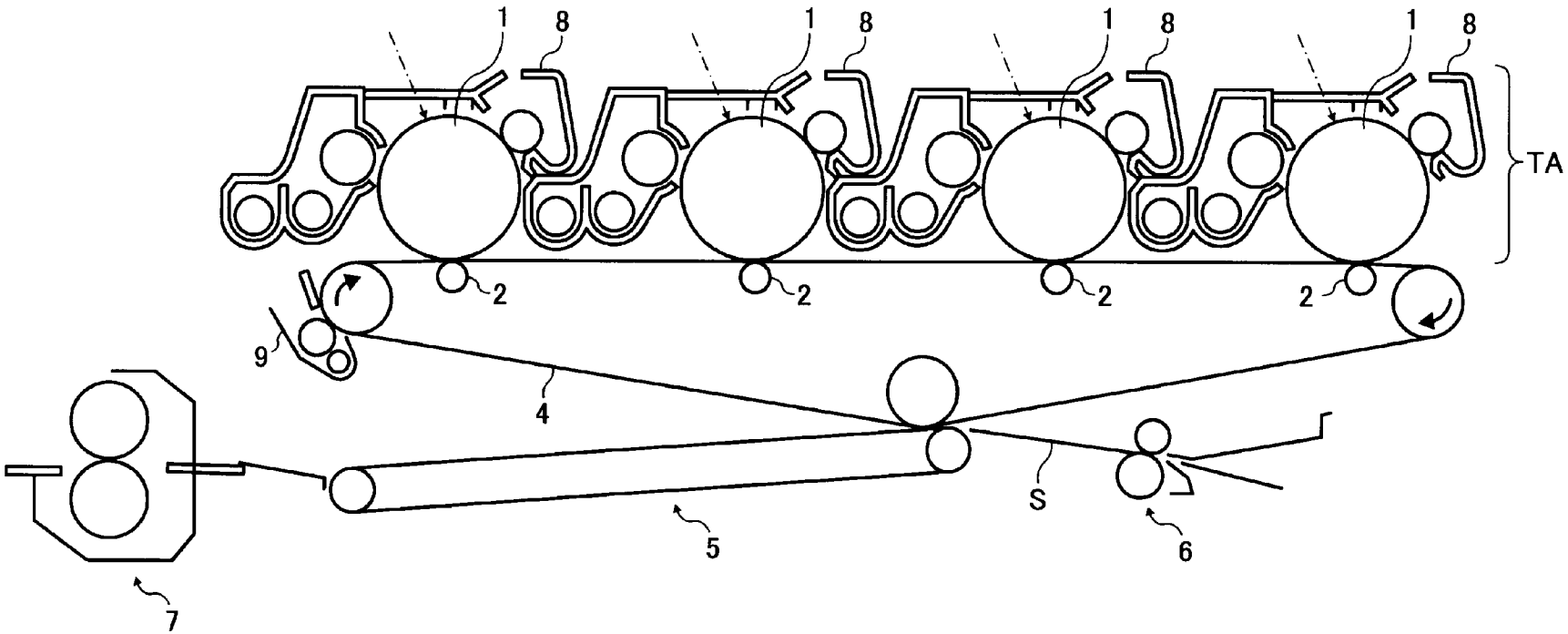
FIG. 8 is a schematic view illustrating another example of the image forming apparatus of the present invention, which uses an indirect image transfer method.

(2) Image forming apparatus using an indirect transfer method, an example of which is illustrated in FIG. 8. In the apparatus, color toner images formed on the plural photoreceptors 1 are transferred one by one by transfer devices 2 onto an intermediate transfer medium 4. Thus a combined color toner image is formed on the intermediate transfer medium 4. The combined color toner image is then transferred by a secondary transfer device 5 to the receiving material S. Although the secondary transfer device 5 has a belt form, the device is not limited thereto, and roller-form transfer devices can also be used therefor.

In the apparatus illustrated in FIG. 7, a feeding device 6 and the fixing device 7 have to be arranged at an upstream side and a downstream side of the tandem image forming units TA relative to the feeding direction of the receiving material, respectively. Therefore, the apparatus tends to be jumboized. In contrast, the apparatus illustrated in FIG. 8 has a flexibility in configuration, and the feeding device 6 and the fixing device 7 can be arranged below the tandem image forming units TA. Therefore, the apparatus can be miniaturized.

In addition, in the apparatus illustrated in FIG. 7, the fixing device 7 has to be set close to the tandem image forming units TA to prevent jumboization of the apparatus. Therefore, the receiving material sheet S straightly enters into the fixing device while the rear end of the sheet S is sandwiched by the photoreceptor 1 and the transfer device 2, resulting in occurrence of problems in that toner images on the sheet S are easily damaged by the impact caused by collision of the tip edge of the sheet S against the fixing device and abnormal images such as elongated or contracted images are formed due to the difference in speed between the transfer belt 3 and the fixing device 7. In contrast, in the apparatus illustrated in FIG. 8, the receiving material sheet S can be bent before the fixing device 7 and thereby the sheet S can enter into the fixing device 7 without influenced by the secondary transfer device 5. Therefore, the above-mentioned problems are hardly caused.

For the reasons mentioned above, the indirect transfer methods attract attention recently. In the image forming apparatus using an indirect transfer method, toner particles remaining on the image bearing member 1 are removed with a cleaning device 8 so that the surface of the image bearing member is cleaned so as to be ready for the next image forming operation. In addition, toner particles remaining on the surface of the intermediate transfer medium 4 is removed with a second cleaning device 9 so that the surface of the intermediate transfer medium is cleaned so as to be ready for the next image forming operation.

Fixing Process and Fixing Device

In the fixing process, toner images transferred on a receiving material sheet are fixed thereto by a fixing device. The fixing device is not particularly limited, but fixing devices including a fixing member and a heater for heating the fixing member are preferably used.

The fixing member of the fixing device is not particularly limited as long as the fixing member forms a nip. For example, combinations of an endless belt and a roller, and combinations of two rollers can be used. Among these fixing members, combinations of an endless belt and a roller are preferably used to save energy. With respect to the heating method, induction heating (IH) is preferably used to save energy.

When the fixing member includes an endless belt, it is preferable for the endless belt to be made of a material having a low heat capacity, and to have a structure such that an offset preventing layer is formed on a substrate. Suitable materials for use in the substrate include nickel and polyimide resins. Suitable materials for use in the offset preventing layer include silicone rubbers and fluorine-containing resins.

When the fixing member includes one or more rollers, the cores of the rollers are preferably made of an non-elastic material so that the rollers are not deformed even when receiving a high pressure. Suitable non-elastic materials for use in the cores of the fixing rollers include metals having a high heat conductivity such as aluminum, iron, stainless steel, and brass. In addition, an offset preventing layer is preferably formed overlying the core. Suitable materials for use in the offset preventing layer include RTV silicone rubbers, tetrafluoroethylene-perfluoroalkyl vinyl ether copolymers (PFA), polytetrafluoroethylene (PTFE), etc.

In the fixing process, toner images transferred onto a receiving material sheet are passed through the nip formed by the fixing members. In this regard, the toner image transferring operation and the fixing operation may be performed at the same time. When a multi-color image constituted of plural color toner images is formed, the plural color toner images may be individually fixed after each color toner image is transferred (i.e., a fixing operation is performed plural times), or the plural toner images may be fixed only by one fixing operation after forming a combined color toner image.

The nip is formed by contacting two fixing members (such as belt-roller and roller-roller). The pressure (surface pressure) at the nip of the fixing members is not particularly limited, but is preferably not less than 5 N/cm$^2$, more preferably from 7 to 100 N/cm$^2$, and even more preferably from 10 to 60 N/cm$^2$. When the pressure is too high, the life of the fixing members shortens. In contrast, when the pressure is too low, toner images cannot be sufficiently fixed to receiving materials.

The fixing temperature is not particularly limited, but is preferably from 120 to 170° C., and more preferably from 120 to 160° C. When the fixing temperature is too low, toner images cannot be sufficiently fixed. In contrast, fixing at a too high a temperature is not preferable in view of energy saving.

The fixing devices are broadly classified into internal heating devices in which a fixing member (a roller or a belt) heated from the backside thereof (i.e., the side not contacting toner images) fixes toner images upon application of heat and pressure thereto, and external heating devices in which a fixing member (a roller or a belt) heated from the front side thereof (i.e., the side contacting toner images) fixes toner images upon application of heat and pressure thereto. Combinations of the internal heating devices and the external heating devices can also be used.

In the internal heating fixing devices, the fixing member has a heat source (such as heaters and halogen lamps) inside thereof.

In the external heating fixing devices, it is preferable that a part of the fixing member is heated with a heat source. The heat source is not particularly limited, and for example, electromagnetic induction heating devices are used. The electromagnetic induction heating device is not particularly limited, and devices including a magnetic field generation member and a heat generation member capable of generating heat utilizing electromagnetic induction.

Suitable devices for use in electromagnetic induction heating include devices having an induction coil which is set close to a fixing member (such as heat rollers), a shield layer on one side of which the coil is arranged, and an insulating layer which is formed on the opposite side of the shield layer. In this case, the heat roller serving as a fixing member is preferably a magnetic roller or a heat pipe.

The induction coil is preferably set so as to face half of the heat roller, wherein a fixing member (such as pressure rollers and endless belts) is contacted with a portion of the other half of the heat roller.

Next, the internal heating fixing devices will be explained by reference to drawings.

Figure 9:
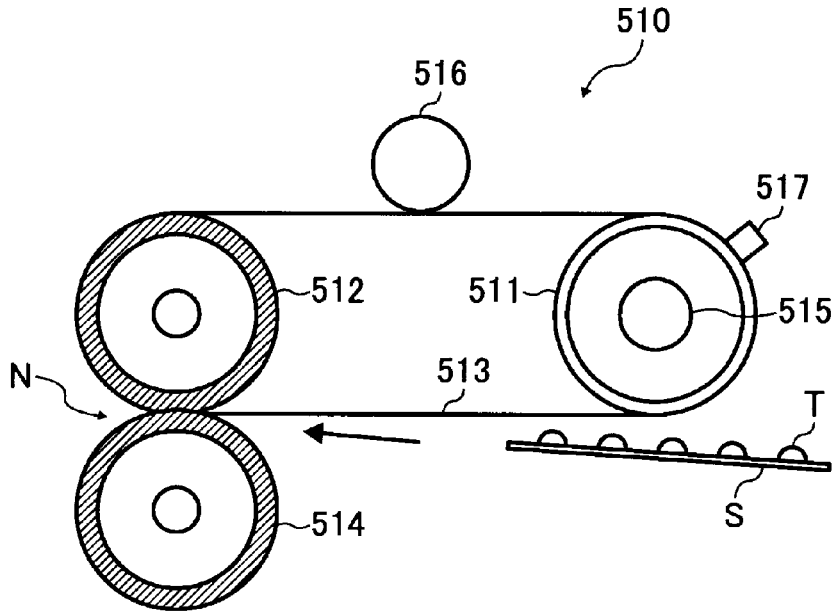
FIG. 9 is a schematic view illustrating a fixing device using a belt for use in the image forming apparatus of the present invention.

FIG. 9 illustrates a belt fixing device which is an internal heating fixing device. Referring to FIG. 9, a belt fixing device 510 includes a heat roller 511, a fixing roller 512, a fixing belt 513, and a pressure roller 514.

The fixing belt 513 is rotated while tightly stretched by the heat roller 511 and the fixing roller 512, which are rotatable, and is heated to a predetermined temperature by the heat roller 511. The heat roller 511 has a heat source 515 therein. The temperature of the heat roller 511 is measured with a sensor 517 to be controlled. The fixing roller 512 is rotatably set while contacted with the inner surface of the fixing belt 513. The pressure roller 514 is rotatably set while contacted with the outer surface of the fixing belt 513 and pressing the fixing belt to the fixing roller 512. Since the hardness of the surface of the fixing belt 513 is lower than that of the pressure roller 514, the fixing belt is deformed toward the fixing roller 512 at the nip N as illustrated in FIG. 9.

In the belt fixing device 510, the receiving material sheet S bearing thereon a toner image T to be fixed is fed to the heat roller 511. The toner image T is heated by the heat roller 511 which is heated to the predetermined temperature by a heat source 515, and the fixing belt 513, and thereby the toner image T is melted. The receiving material sheet S bearing the melted toner image is fed into the nip N, at which the toner image is pressed to the sheet S by the fixing roller 512 and the pressure roller 514 while the toner image is contacted with the surface of the fixing belt 513, resulting in fixation of the toner image on the sheet S.

After passing the nip N, the receiving material sheet S is then released from the fixing belt 513 to be fed to a tray (not shown). In this regard, since the nip N is curved as mentioned above, the receiving material sheet S is discharged toward the pressure roller 514, and thereby occurrence of a winding problem in that the sheet S is wound around the fixing belt 513, resulting in jamming of the sheet can be prevented. The surface of the fixing belt 513 is cleaned by a cleaning roller 516.

Figure 10:
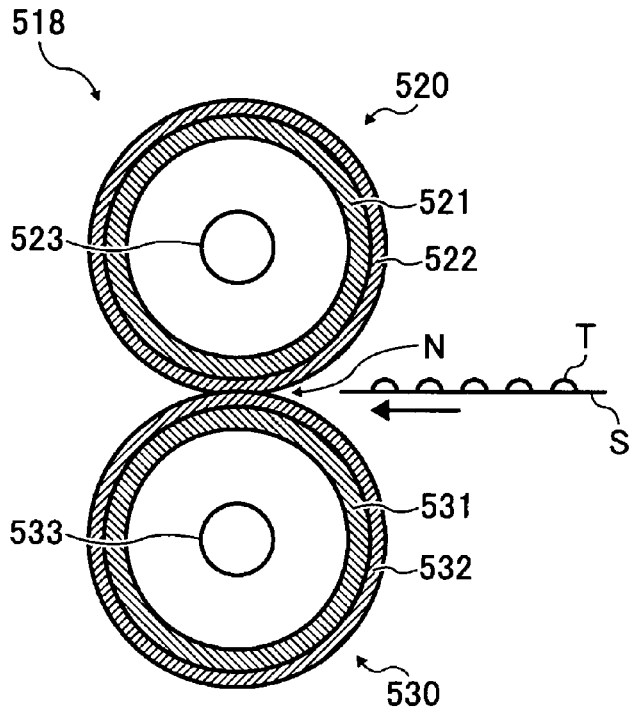
FIG. 10 is a schematic view illustrating a fixing device using heat rollers for use in the image forming apparatus of the present invention.

FIG. 10 illustrates a heat roller fixing device. Referring to FIG. 10, a fixing device 518 includes a heat roller 520 and a pressure roller 530.

The heat roller 520 has a metal cylinder 521, which is covered with an offset preventing layer 522 and inside which a heat lamp 523 is arranged. The pressure roller 530 has a metal cylinder 531, which is covered with an offset preventing layer 532. The pressure roller 530 may have a heat lamp 533 therein as illustrated in FIG. 10.

The heat roller 520 and the pressure roller 530 are rotated while pressed to each other by a spring (not shown). The hardness of the offset preventing layer 522 of the heat roller 520 is lower than that of the offset preventing layer 532 of the pressure roller 530, and therefore the offset preventing layer 522 is deformed (i.e., recessed) at the nip N as illustrated in FIG. 10.

In the heat roller fixing device 518, the receiving material sheet S bearing thereon the toner image T to be fixed is fed to the nip N. The toner image T is heated by the heat roller 520 which is heated to the predetermined temperature by the heat lamp 523, and thereby the toner image is melted. In addition, the toner image T is pressed to the sheet S by the pressure roller 530, and thereby the toner image is fixed on the sheet S.

After passing the nip N, the receiving material sheet S is then fed to a tray (not shown). In this regard, since the nip N is curved as mentioned above, the receiving material sheet S is discharged toward the pressure roller 530, and thereby occurrence of a winding problem in that the sheet S is wound around the heat roller 520 can be prevented. The surface of the heat roller 520 is cleaned with a cleaning roller (not shown).

Next, the external heating fixing devices will be explained by reference to drawings.

Figure 11:
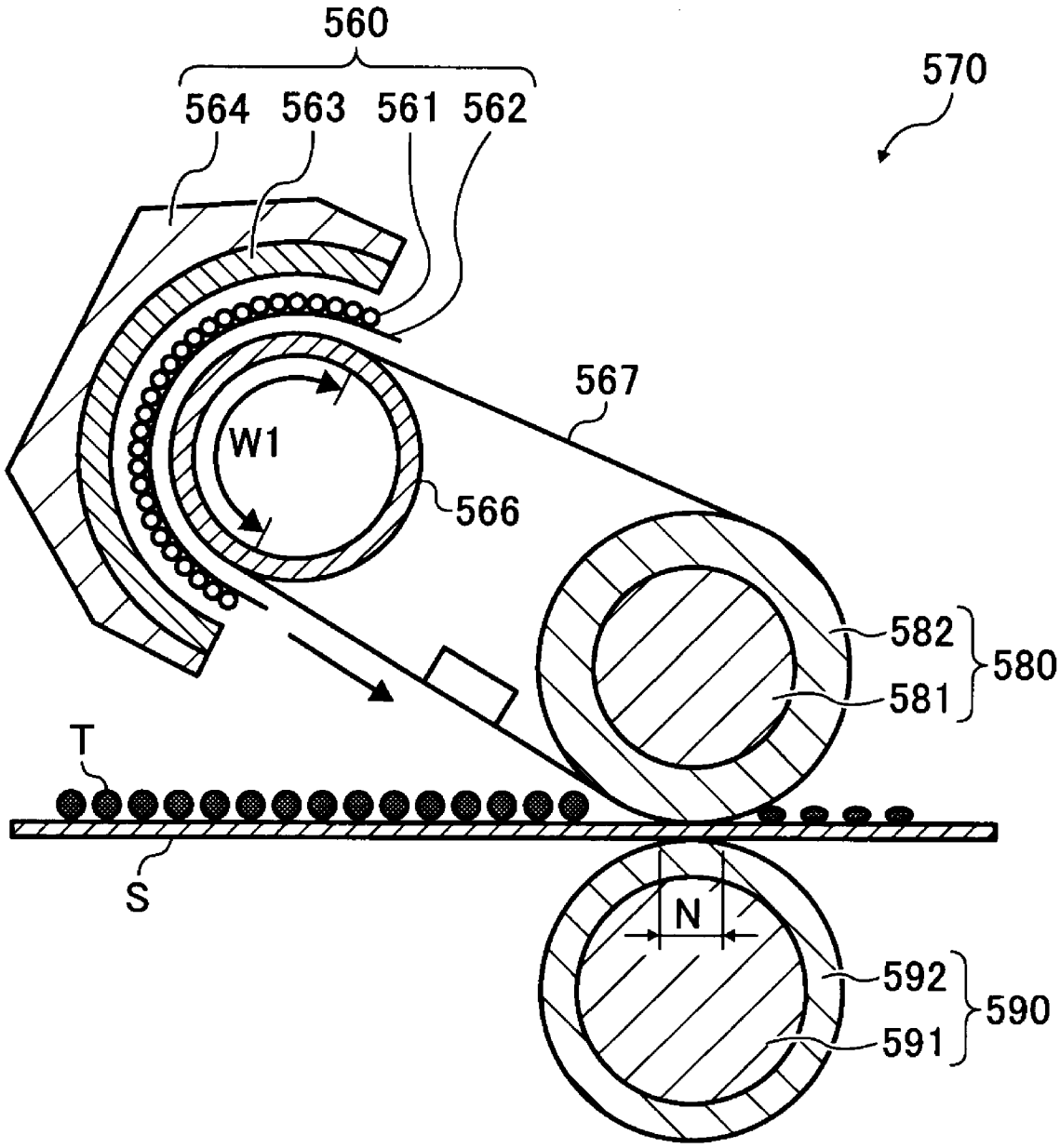
FIGS. 11 and 12 are schematic views illustrating fixing devices utilizing electromagnetic induction heating for use in the image forming apparatus of the present invention.

FIG. 11 illustrates an electromagnetic induction heat fixing device which is an external heating fixing device and which uses a fixing belt, a fixing roller and a pressure roller. Referring to FIG. 11, an electromagnetic induction heat fixing device 570 includes a heat roller 566, a fixing roller 580, a fixing belt 567, a pressure roller 590 and an electromagnetic induction heat member 560. The fixing belt 567 is tightly stretched by the heat roller 566 and the fixing roller 580, which are rotatable, and is heated to a predetermined temperature by the heat roller 566.

The heat roller 566 includes a magnetic metal cylinder, which is made of a magnetic metal (such as iron, cobalt and nickel) or a magnetic metal alloy (such as alloys of the above-mentioned metals) and which has an outside diameter of from 20 to 40 mm and a thickness of from 0.3 to 1.0 mm. Therefore, the heat roller 566 has a low heat capacity and thereby the roller can be rapidly heated to the predetermined temperature.

The fixing roller 580 includes a metal cylinder 581 made of a metal such as stainless steel, and an elastic layer 582 which is formed on the metal cylinder 581 using a heat resistant elastic material such as solid silicone rubbers and foamed silicone rubbers. The fixing roller 580 is rotated while contacted with the inner surface of the fixing belt 567. The fixing roller 580 and the pressure roller 590 form a nip N having a predetermined width. Therefore, the fixing roller has an outside diameter of from 20 to 40 mm, which is greater than that of the heat roller 566. The elastic layer 582 has a thickness of from 4 to 6 mm. Thus the fixing roller 580 is designed so as to have a large heat capacity than the heat roller 566, and thereby the warm-up time of the heat roller 566 is reduced.

The pressure roller 590 includes a metal cylinder 591 made of a metal having a high heat conductivity such as copper, aluminum and stainless steel, and an elastic layer 592 which is formed on the metal cylinder 591 using a heat resistant elastic material having a good toner releasability. The pressure roller 590 is rotated while contacted with the inner surface of the fixing belt 567 so as to press the fixing belt to the fixing roller 580.

The electromagnetic induction heat member 560 is set close to the heat roller 566, and extends in a direction parallel to the axis of the heat roller 566. The heat member 560 includes an exciting coil 561 serving as a magnetic field generation device, and a coil guide plate 562, around which the coil is wound. The coil guide plate 562 has a half pipe form and is set close to the heat roller 566. The exciting coil 561 is prepared by winding a single wire along the surface of the coil guide plate 562 in a reciprocating manner so that the wire extends in the longitudinal direction of the coil guide plate 562. The oscillating circuit of the exciting coil 561 is connected with a frequency-changeable driving power source (not shown). On the outside of the exciting coil 561, an exciting coil core 563 which is made of a ferromagnetic material such as ferrites and which has a half pipe form is set close to the exciting coil 561 while supported by a support 564.

In the electromagnetic induction heat fixing device 570 illustrated in FIG. 11, when an electric power is applied to the exciting coil 561 of the electromagnetic induction heat member 560 is heated, an alternating magnetic field is formed in the vicinity of the induction heat member 560, and thereby the heat roller 566, which is close to the exciting coil 561 and which is surrounded by the coil 561, is efficiently heated due to eddy current generated therein. On the other hand, the receiving material sheet S is fed to the nip N formed between the fixing roller 580 and the pressure roller 590. The toner image T on the receiving material sheet S is heated by the fixing belt 567, which is heated by the heat roller 566 at a contact portion W1 of the heat roller, and thereby the toner image T is melted. The sheet S bearing the melted toner image is fed to the nip N, and the toner image is pressed by the pressure roller 590 toward the fixing roller 580 while contacted with the surface of the fixing belt 567, resulting in fixation of the toner image T on the sheet S.

After passing the nip N, the receiving material sheet S bearing the fixed toner image thereon is released from the fixing belt 567 and is then fed to a tray (not shown). In this regard, since the nip N is curved similarly to the case illustrated in FIG. 9, the receiving material sheet S is discharged toward the pressure roller 590, and thereby occurrence of a winding problem in that the sheet S is wound around the fixing belt 567 can be prevented. The surface of the fixing belt 567 is cleaned with a cleaning roller (not shown).

Figure 12:
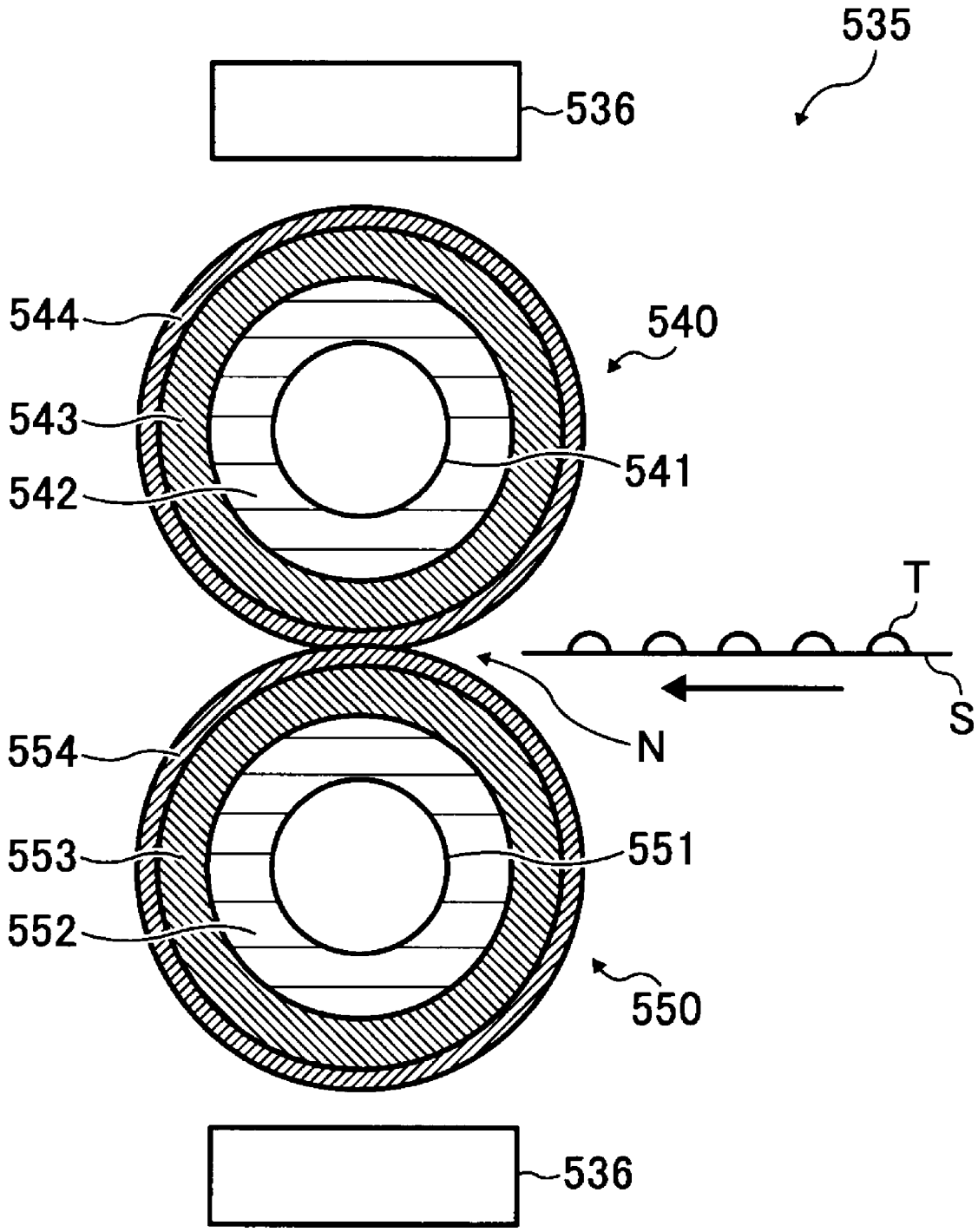

FIG. 12 illustrates another electromagnetic induction heat fixing device which is an external heating fixing device and which uses two rollers. Referring to FIG. 12, a fixing device 535 includes a fixing roller 540, a pressure roller 550 contacted with the fixing roller 540, and electromagnetic induction heating sources 536.

The fixing roller 540 includes a metal cylinder 541, and a heat insulating elastic layer 542, a heat generation layer 543, and a release layer 544 which are overlaid on the metal cylinder 541 in this order. The pressure roller 550 also includes a metal cylinder 551, and a heat insulating elastic layer 552, a heat generation layer 553, and a release layer 554, which are overlaid on the metal cylinder 551 in this order. Each of the release layers 544 and 554 are made of a tetrafluoroethylene-perfluoroalkyl vinyl ether copolymer (PFA).

The fixing roller 540 and the pressure roller 550 are rotated while pressed to each other by a spring (not shown). Thus, the nip N is formed therebetween.

The electromagnetic induction heating sources 536 are set close to the fixing roller 540 and the pressure roller 550, respectively, to heat the heat generation layers 543 and 553 by electromagnetic induction heating. The fixing device 535 illustrated in FIG. 12 has advantages such that the fixing roller 540 and the pressure roller 550 are evenly and efficiently heated, and a high surface pressure can be applied to the nip N because of a combination of rollers is used.

Oil Application Device and Oil Application Process

In the oil application process, an oil is applied to the fixing member such as fixing belts and fixing rollers using an oil application device.

The oil application device is not particularly limited, and for example, application devices including an oil application roller having a heat resistant felt or a heat resistant porous layer on the surface thereof, which is soaked with an oil, is pressed to the fixing roller to apply the oil to the fixing roller are used.

Figure 13:
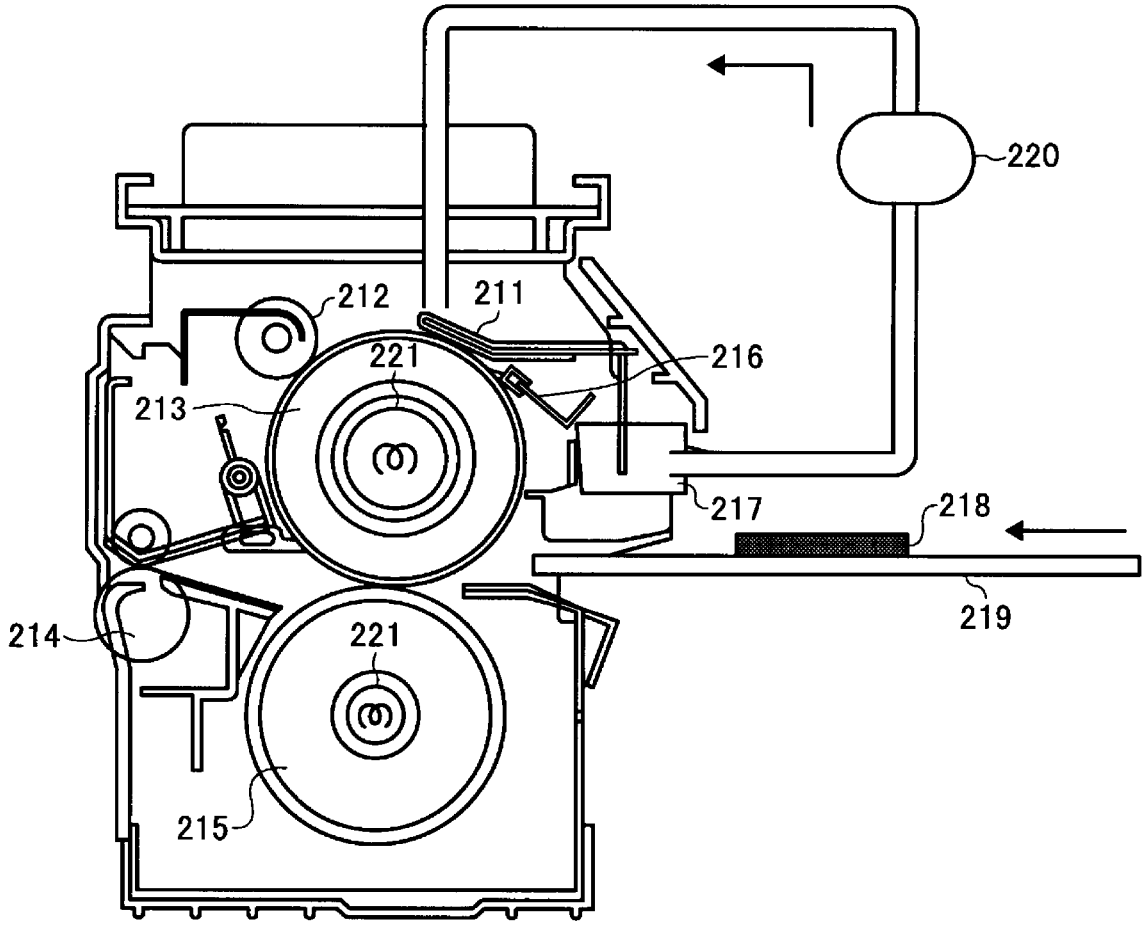
FIG. 13 is a schematic view illustrating an oil applicator for use in the image forming apparatus of the present invention.

FIG. 13 illustrates an oil application device set on a fixing device for use in the image forming apparatus of the present invention. Referring to FIG. 13, an oil supplied from an oil container 217 to a felt 211 by a pump 220 is coated on the surface of a fixing roller 213. The amount of the oil on the surface of the fixing roller 213 is controlled by a blade 216. The coating amount of the oil can be changed by changing the pressure of the blade 216 to the fixing roller 213. Specifically, by increasing the pressure of the blade 216, the coating amount of the oil can be decreased. In contrast, by decreasing the pressure of the blade, the coating amount of the oil can be increased. Since the fixing roller 213 and a pressure roller 215 are heated by respective halogen heaters 221, a toner image 218 formed on a receiving material 219 is fixed by the fixing roller 213 and the pressure roller 215 when the receiving material 219 passes through the nip between the two rollers. Numerals 212 and 214 respectively denote a cleaning roller for cleaning the surface of the fixing roller 213, and a discharging roller for discharging the receiving material 219 bearing thereon the fixed toner image from the fixing device.

The oil application roller preferably has a porous outermost layer made of a polytetrafluoroethylene resin. Suitable oils to be applied to the fixing roller include oils having high heat resistance. Among the heat resistant oils, silicone oils are preferably used. Specific examples of the silicone oils include polydimethylsilicones, polyphenylmethylsilicones, etc. Among the silicone oils, amino-modified silicone oils are preferably used because of having a good wettability to fixing rollers. The viscosity of the oils is preferably from 1 Pa·s (1,000 cps) to 100 Pa·s (100,000 cps). When the viscosity is too low, a large amount of oil is exuded from the application roller at a time. In order The amount of oil applied to the fixing member is preferably from 0.1 to 10 $\mu g/cm^2$ and more preferably from 0.2 to 7 $\mu g/cm^2$. When the amount is too small, the releasability of the fixing member is deteriorated when the fixing speed is high. When the amount is too large, problems such that receiving papers become transparent due to penetration of the oil into the papers, and thereby formation of additional images using a pencil or ball point pen or inkjet printing cannot be well performed on such oil-penetrated receiving papers occur.

Cleaning Process and Cleaning Device

In the cleaning process, toner particles remaining on the surface of the image bearing member without being transferred are removed therefrom by a cleaning device.

It is possible to use a developing device, which not only develops electrostatic latent images on the image bearing member to form toner images but also collects such residual toner particles instead of a cleaning device. Namely, this is a cleaning-less developing method.

The cleaning device is not particularly limited, and known cleaning devices can be used. Specific examples thereof include magnetic brush cleaners, electrostatic brush cleaners, magnetic roller cleaners, blade cleaners, brush cleaners, and web cleaners, etc. Among these cleaners, blade cleaners are preferably used because of having a good cleanability, low costs and small size.

Suitable materials for use in the cleaning blades include urethane rubbers, silicone rubbers, fluorine-containing rubbers, chloroprene rubbers, butadiene rubbers, etc. Among these materials, urethane rubbers are preferable.

Figure 14:
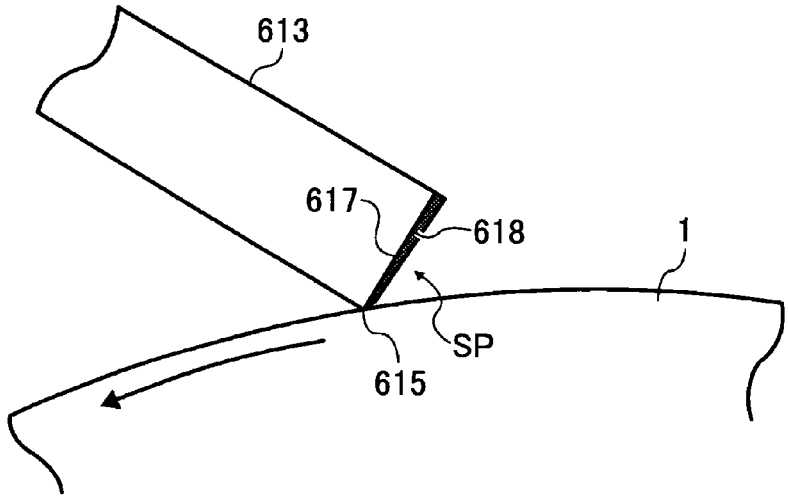
FIG. 14 is a schematic view illustrating a cleaning blade for use in the image forming apparatus of the present invention.

FIG. 14 illustrate a cleaning blade. Referring to FIG. 14, a cleaning blade 613 is contacted with the photoreceptor 1 serving as an image bearing member at a contact point 615. The cleaning blade 613 is set so as to counter the photoreceptor 1, and a surface 617 (i.e., toner blocking surface) of the cleaning blade 613 and the surface of the photoreceptor form a space SP, which is preferably an acute angle.

The surface 617 has an outermost layer 618 thereon, which has a higher friction coefficient than the cleaning blade 613. Specific examples of the materials having a high friction coefficient for use in the outermost layer 618 include diamond-like carbon (DLC), but are not limited thereto. It is preferable that the outermost layer 618 is formed on a portion of the surface 617 so as not to contact the surface of the photoreceptor 1.

The cleaning device including the cleaning blade 613 also includes a toner collection blade for collecting toner particles scraped off by the blade 613, a toner collection coil for feeding the collected toner particles to a residual toner collector, etc., which are not shown in FIG. 14.

Cleaning-Less Image Forming Apparatus

Figure 15:
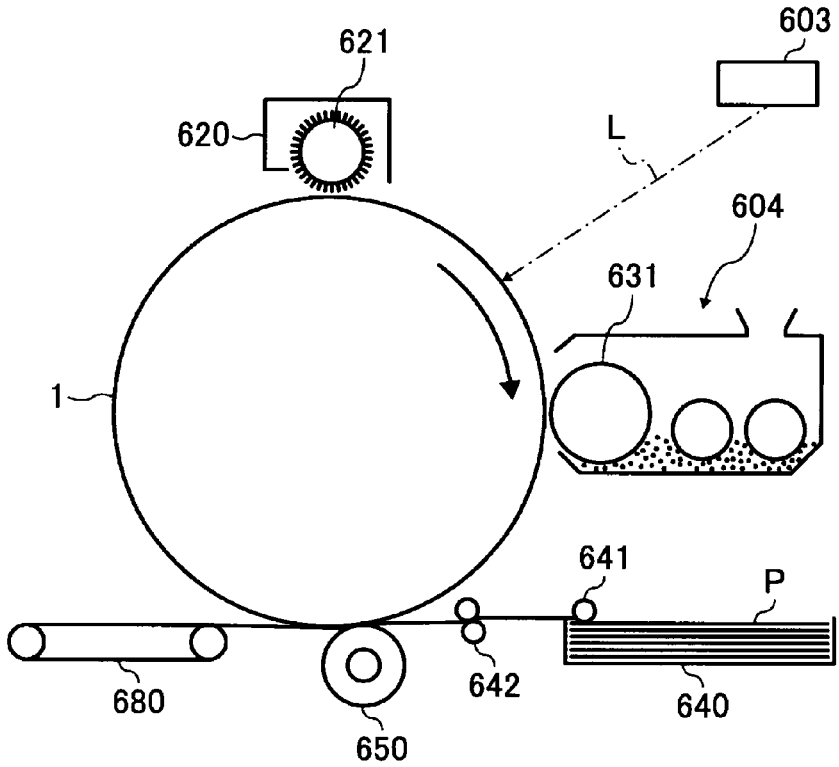
FIG. 15 is a schematic view illustrating another example of the image forming apparatus of the present invention (i.e., a cleaner-less image forming apparatus)

FIG. 15 illustrates a cleaning-less image forming apparatus including a developing device having a cleaning function.

Referring to FIG. 15, the image forming apparatus includes the photoreceptor 1 serving as the image bearing member, a brush charger 620 serving as a contact charger for charging the photoreceptor 1, a light irradiating device 603 for irradiating the photoreceptor 1 with light L to form an electrostatic latent image on the photoreceptor 1, a developing device 604 for developing the electrostatic latent image with a developer including a toner to form a toner image on the photoreceptor 1, a receiving material feeding device 640 for feeding a receiving material sheet P, a transfer device 650 for transferring the toner image onto the receiving material sheet, and a feeder 680 for feeding the receiving material sheet.

In the image forming apparatus, toner particles remaining on the surface of the photoreceptor 1 without being transferred to the receiving material sheet P are transported to the brush charge 620. The residual toner particles are temporarily collected by a magnetic brush of a charging member 621 of the brush charge 620. The thus collected toner particles are discharged from the magnetic brush to the surface of the photoreceptor 1, and the discharged toner particles are collected by a developer bearing member 631 together with the developer on the developer bearing member. Thus, the toner particles are returned to the developing device 604 to be reused for developing. Numerals 641 and 642 denote a feeding roller and a pair of registration rollers.

In the developing device 604 having a cleaning function, toner particles remaining on the photoreceptor 1 are collected due to a development bias (i.e., the potential difference between the DC voltage applied to the developer bearing member 631 and the surface potential of the photoreceptor 1). Thus, residual toner particles are collected by the developing device to be reused, i.e., the image forming apparatus is free from maintenance. In addition, the apparatus is a cleaner-less system, and therefore the size of the image forming apparatus can be reduced.

Other Processes and Devices

The image forming apparatus optionally performs a discharging process. In the discharging process, charges remaining on the image bearing member (photoreceptor) are discharged using a discharging device. The discharging device is not particularly limited, and any known dischargers can be used. For example, discharging lamps are used for the discharging device.

A toner recycle process can be optionally performed. The toner recycle process is such that toner particles collected by the cleaning device are fed to the developing device by a recycling device to be recycled. Any known powder feeding devices can be used for the recycling device.

Further, a controlling process is performed by a controller to control the above-mentioned processes. Specific examples of the controller include sequencers, and computers.

Image Forming Apparatus and Image Forming Method

The image forming processes and image forming apparatus of the present invention will be explained in detail referring to drawings.

Figure 16:
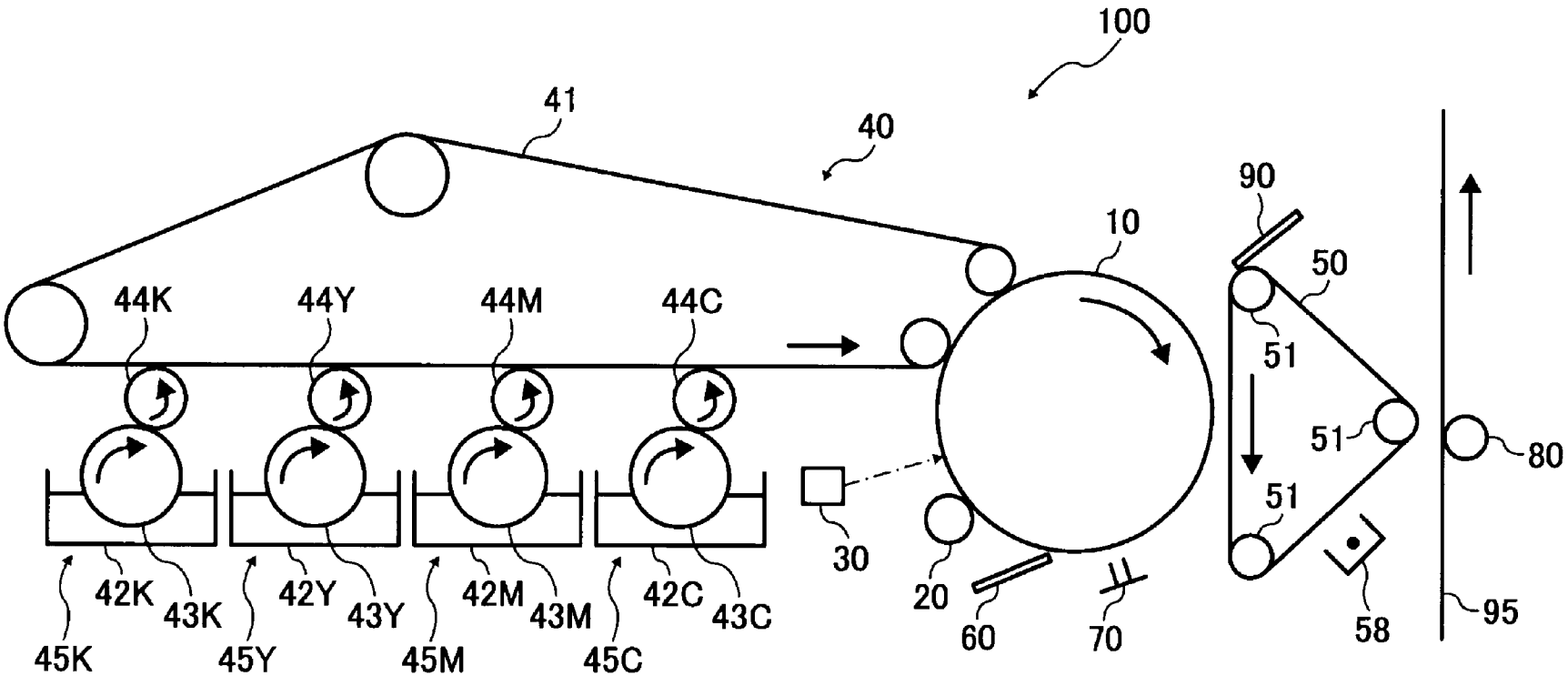
FIGS. 16-18 are schematic views illustrating other examples of the image forming apparatus of the present invention.

FIG. 16 is a schematic view illustrating an embodiment of the image forming apparatus of the present invention.

In FIG. 16, an image forming apparatus 100 includes a photoreceptor drum 10 (hereinafter referred to as a photoreceptor 10) serving as the image bearing member; a charging roller 20 serving as the charging device; a light irradiator 30 serving as the latent image forming device; a developing device 40 serving as the image developing device; an intermediate transfer medium 50; a cleaner 60 serving as the cleaning device and including a cleaning blade; and a discharging lamp 70 serving as the discharging device.

The intermediate transfer medium 50 is an endless belt which is rotated in a direction indicated by an arrow by three rollers 51 arranged therein while tightly stretched by the rollers. At least one of the three rollers 51 applies a transfer bias (first transfer bias) to the intermediate transfer medium 50. A cleaner 90 is provided to clean the surface of the intermediate transfer medium 50.

On the upper side of the intermediate transfer medium 50, a transfer roller 80 is provided which applies a transfer bias (a second transfer bias) to a receiving material 95 on which a toner image is to be transferred. In addition, a corona charge 58 is provided to charge the toner image on the intermediate transfer medium 50 before the toner image is transferred to the receiving material 95.

A developing device 40 includes a developing belt 41; a black developing unit 45K; a yellow developing unit 45Y; a magenta developing unit 45M; and a cyan developing unit 45C. Each of the developing units includes a developer containing portion 42 (42K, 42Y, 42M or 42C), a developer supplying roller 43 (43K, 43Y, 43M or 43C), and a developing roller 44 (44K, 44Y, 44M or 44C). The developing belt 41 is rotatably supported by plural rollers and is contacted with the photoreceptor 10.

In the image forming apparatus 100, the surface of the photoreceptor 10 is uniformly charged with the charging roller 20. The light irradiator 30 irradiates the charged surface of the photoreceptor 10 with imagewise light to form an electrostatic latent image on the photoreceptor 10. The developing device 40 develops the latent image with color toners to sequentially form color toner images on the photoreceptor 10. The color toner images are transferred to the intermediate transfer medium 50 (first transfer) to form a toner image (e.g., a full color toner image) thereon while at least one of the rollers 51 applies a transfer bias thereto. The toner image formed on the intermediate transfer medium 50 is then transferred to the receiving material 95 (second transfer). Particles of the toner remaining on the photoreceptor 10 are removed with the cleaner 60 and charges remaining on the photoreceptor 10 are removed by irradiating the photoreceptor 10 with light using the discharging lamp 70.

Figure 17:
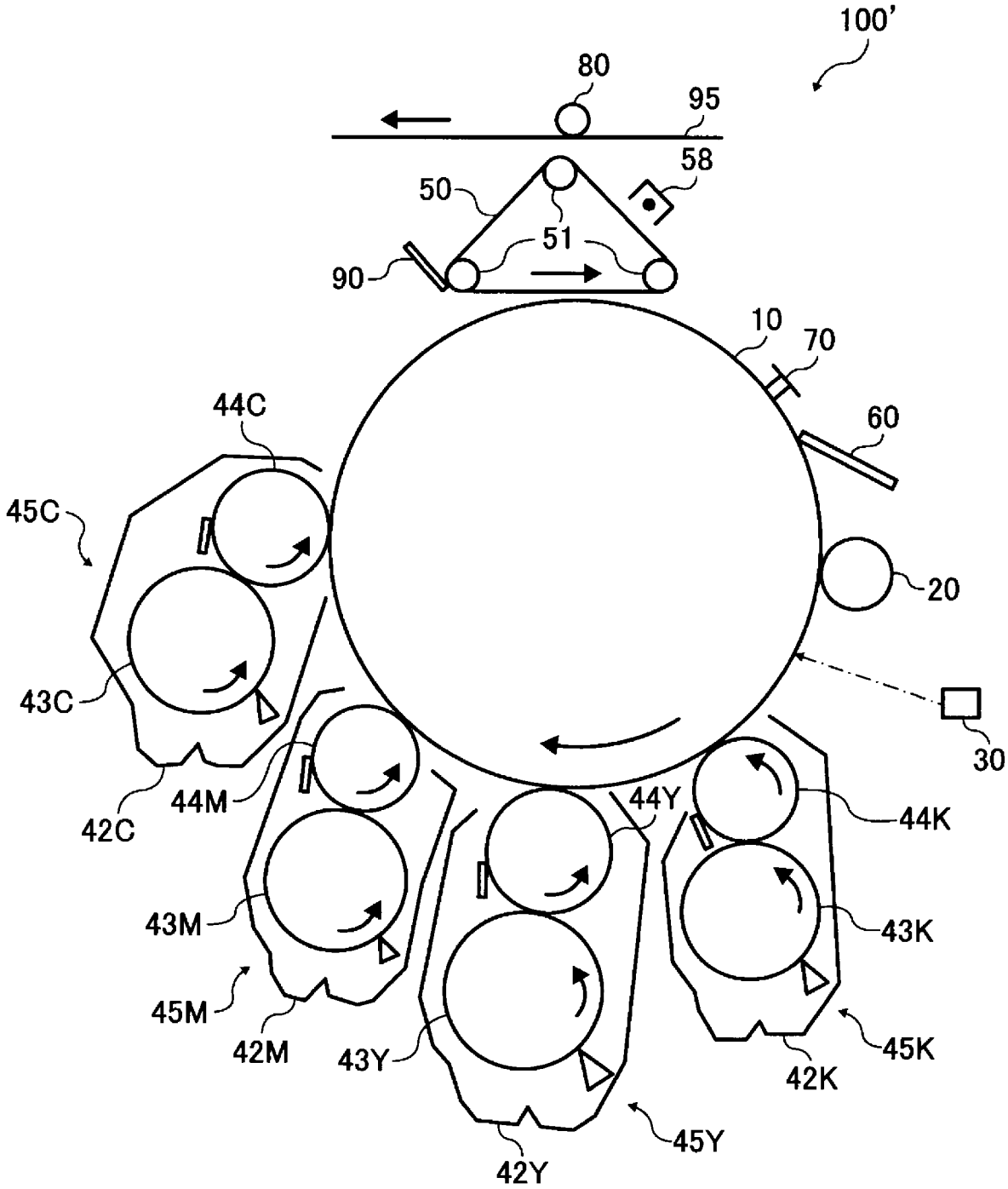

Another image forming apparatus is illustrated in FIG. 17. In FIG. 17, an image forming apparatus 101' has the same configuration as that of the image forming apparatus illustrated in FIG. 16 except that the black, yellow, magenta and cyan developing units 45K, 45Y, 45M and 45C are directly contacted with the photoreceptor 10 without using the developing belt 41. The action of the image forming apparatus is also the same as that of the image forming apparatus illustrated in FIG. 16.

Figure 18:
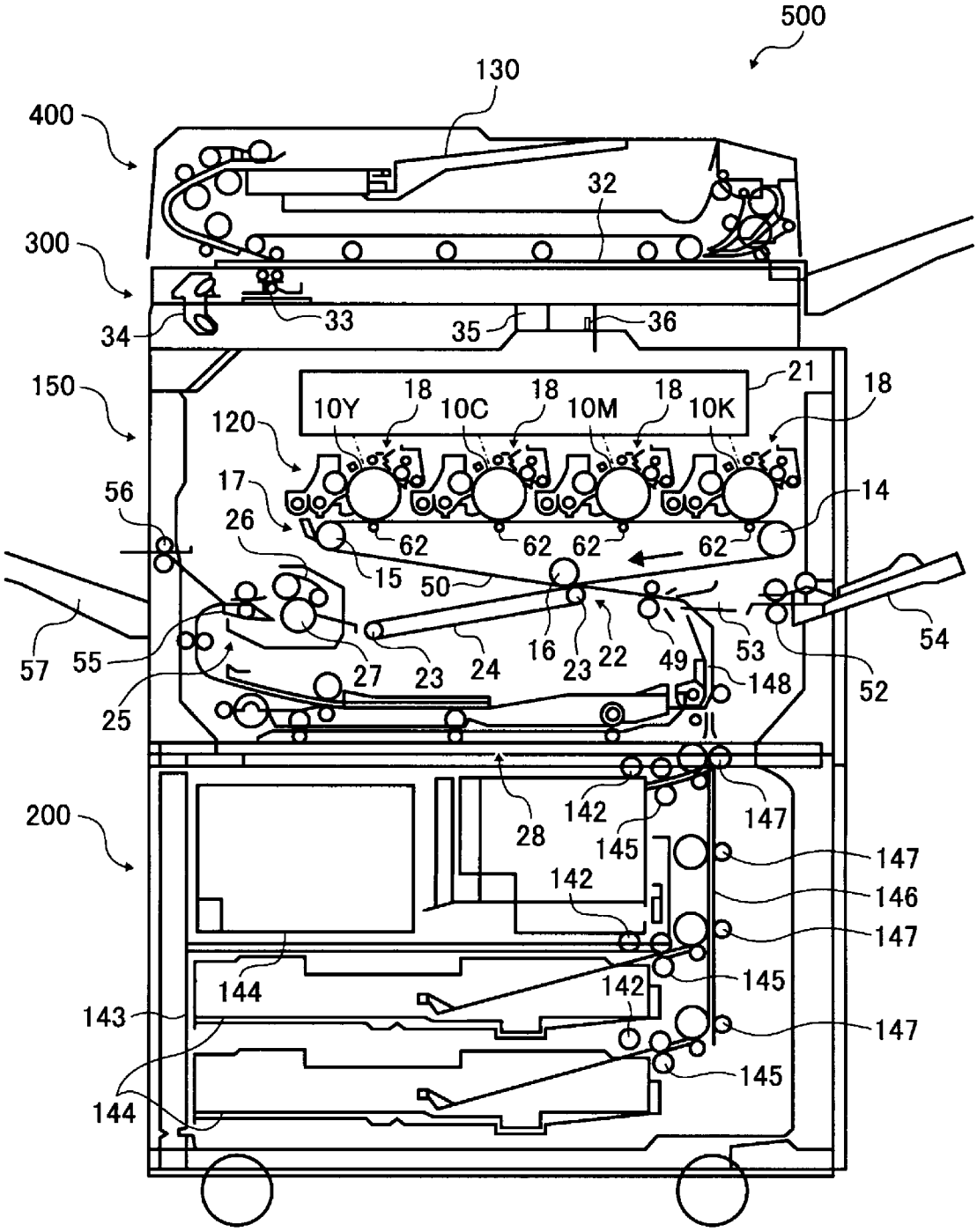

FIG. 18 is the overview of another embodiment of the image forming apparatus of the present invention, which is a tandem-type color image forming apparatus.

In FIG. 18, a tandem-type color image forming apparatus 500 includes an image forming section 150, a paper feeding section 200, a scanner 300 and an automatic document feeder 400.

The image forming section 150 includes an endless intermediate transfer medium 50 which is provided in the center of the image forming section 150. The intermediate transfer medium 50 is rotated in the clockwise direction by rollers 14, 15 and 16 while tightly stretched by the rollers. A cleaner 17 is provided near the roller 15 to remove particles of the toner remaining on the surface of the intermediate transfer medium.

Four image forming units 18 for forming yellow, magenta, cyan and black toner images are arranged side by side on the intermediate transfer medium 50. The image forming units 18 include respective photoreceptors 10Y, 10M, 10C and 10K. Numeral 120 denotes a tandem type developing device. The developing device 120 includes four developing devices arranged in the respective four image forming units 18. A light irradiator 21 is arranged at a location over the image forming units 18.

A second transfer device 22 is provided below the intermediate transfer medium 50. The second transfer device 22 includes an endless belt 24 which is rotatably stretched a pair of rollers 23. The endless belt 24 feeds a receiving material so that the toner images on the intermediate transfer medium 50 are transferred to the receiving material while sandwiched by the intermediate transfer medium 50 and the endless belt 24.

A fixing device 25 is arranged at a position near the second transfer device 22. The fixing device 25 includes an endless fixing belt 26 and a pressure roller 27 which presses the fixing belt 26.

In addition, a sheet reversing device 28 configured to reverse the receiving material is provided at a position near the fixing device 25, to produce double-sided copies.

Then the full color image forming operation of the tandem-type color image forming apparatus 500 will be explained.

An original to be copied is set on an original table 130 of the automatic document feeder 400. Alternatively, the original is directly set on a glass plate 32 of the scanner 300 after the automatic document feeder 400 is opened, followed by closing of the automatic document feeder 400. When a start button (not shown) is pushed, the color image on the original on the glass plate 32 is scanned with a first traveler 33 and a second traveler 34 which move in the right direction. In the case where the original is set on the table 130 of the automatic document feeder 400, at first the original is fed to the glass plate 32, and then the color image thereon is scanned with the first and second travelers 33 and 34. The first traveler 33 irradiates the color image on the original with light and the second traveler 34 reflects the light reflected from the color image to send the color image light to a sensor 36 via a focusing lens 35. Thus, color image information (i.e., black, yellow, magenta and cyan color image data) is provided.

The black, yellow, magenta and cyan color image data are sent to the respective black, yellow, magenta and cyan color image forming units 18, and black, yellow, magenta and cyan color toner images are formed on the respective photoreceptors 10K, 10Y, 10M and 10C. The toner image forming operation is the same as that mentioned in the image forming apparatus illustrated in FIG. 16.

Figure 19:
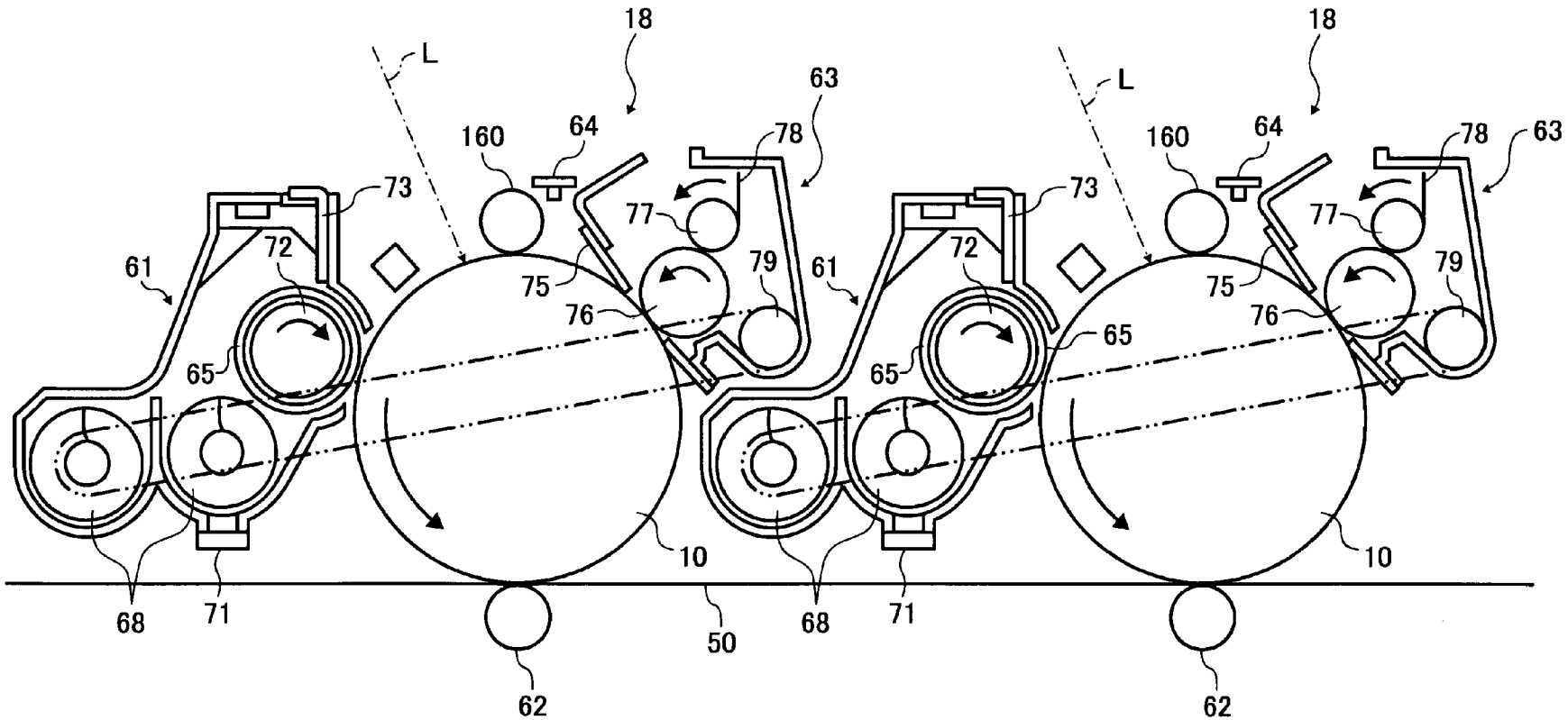
FIG. 19 is an enlarged view illustrating the image forming units of the image forming apparatus illustrated in FIG. 18.

FIG. 19 is a schematic view illustrating a part of the image forming units 18.

Numeral 160, 61, 62, 63 and 64 denote a charger, a developing device, a transfer roller, a cleaner and a discharger.

The developing device 61 includes agitators 68, a developing roller 72, and a regulating blade 73 configured to form a developer layer 65 on the surface of the developing roller. Numeral 71 denotes a toner sensor configured to determine the toner concentration. Character L denotes imagewise light.

The cleaner 63 includes cleaning blade 75, a cleaning brush 76, a roller 77, a blade 78 and a toner recycling device 79 configured to feed the collected toner particles to the developing device 61.

Referring back to FIG. 18, the thus prepared black, yellow, magenta and cyan color toner images are transferred one by one to the intermediate transfer medium 50 which is rotated by the rollers 14, 15 and 16, resulting in formation of a full color toner image on the intermediate transfer medium 50. Numeral 62 denotes a transfer charger.

On the other hand, one of paper feeding rollers 142 is selectively rotated to feed the top paper sheet of paper sheets stacked in a paper cassette 144 in a paper bank 143 while the paper sheet is separated one by one by a separation roller 145 when plural paper sheets are continuously fed. The paper sheet is fed to a passage 148 in the image forming section 150 through a passage 146 in the paper feeding section 200, and is stopped once by a registration roller 49. Numeral 147 denotes feed rollers. A paper sheet can also be fed from a manual paper tray 54 to a passage 53 by a separation roller 52. The thus fed paper sheet is also stopped once by the registration roller 49. The registration roller 49 is generally grounded, but a bias can be applied thereto to remove paper dust therefrom.

The thus prepared full color toner image on the intermediate transfer medium 50 is transferred to the paper sheet, which is timely fed by the registration roller 49, at the contact point of the second transfer device 22 with the intermediate transfer medium 50. Particles of the toner remaining on the surface of the intermediate transfer medium 50 even after the second image transfer operation are removed therefrom by the cleaner 17.

The paper sheet having the full color toner image thereon is then fed by the second transfer device 22 to the fixing device 25, and the toner image is fixed on the paper sheet upon application of heat and pressure. Then the paper sheet is discharged from the image forming section 150 by a discharge roller 56 while the path is properly selected by a paper path changing pick 55. Thus, a copy is stacked on a tray 57. When a double sided copy is produced, the paper sheet having a toner image on one side thereof is fed to the sheet reversing device 28 to be reversed. Then the paper sheet is fed to the second transfer device 24 so that an image is transferred to the other side of the paper sheet. The image is also fixed by the fixing device 25 and then the copy is discharged to the tray 57 by the discharge roller 56.

Toner Container

The image forming apparatus can include a toner container containing a toner or a developer therein, which is to be fed to the developing device.

The container is not particularly limited, and known containers can be used. For example, containers having a main body (bottle) and a cap. The main body (bottle) is not particularly limited with respect to the size, shape, structure and constitutional material. For example, a cylindrical bottle is used. Preferably, the bottle has a spiral groove inside surface thereof so that the toner or developer therein is fed to the exit of the bottle when rotated. It is preferable that the body of the bottle having a spiral groove is shrunk like an accordion.

Suitable materials for constituting the bottle include materials with a high dimensional accuracy. Specific examples of such materials include resins such as polyester resins, polyethylene resins, polypropylene resins, polystyrene resins, polyvinyl chloride resins, polyacrylic resins, polycarbonate resins, ABS resins, polyacetal resins, etc.

The toner container is detachably attached to the image forming apparatus to supply a toner or a developer to the image forming apparatus. The container has good combination of preservability, feedability and handleability.

Process Cartridge

The process cartridge for use in the present invention includes at least an image bearing member configured to bear an electrostatic latent image, and a developing device configured to develop the electrostatic latent image with a developer including a toner to form a toner image on the image bearing member, and optionally includes one or more of a charging device for charging the image bearing member, a light irradiating device for irradiating the charged image bearing member to form the electrostatic latent image, a transfer device for transferring the toner image onto a receiving material, a cleaning device for cleaning the surface of the image bearing member, and a discharging device for discharging residual charges on the image bearing member.

The developing device included in the process cartridge includes at least a developer containing section for containing the developer, and a developer bearing member for bearing and feeding the developer to the photoreceptor to develop an electrostatic latent image, and optionally includes a developer layer controlling member for forming a uniform developer layer on the developer bearing member. The developer is a one-component developer or a two-component developer.

In addition, the above-mentioned devices for use in the image forming apparatus of the present invention can be used for the charging device, light irradiating device, transfer device, cleaning device, and discharging device of the process cartridge.

The process cartridge of the present invention is detachably attached to electrophotographic image forming apparatus such as copiers, printers and facsimiles, and preferably to the image forming apparatus of the present invention.

Figure 20:
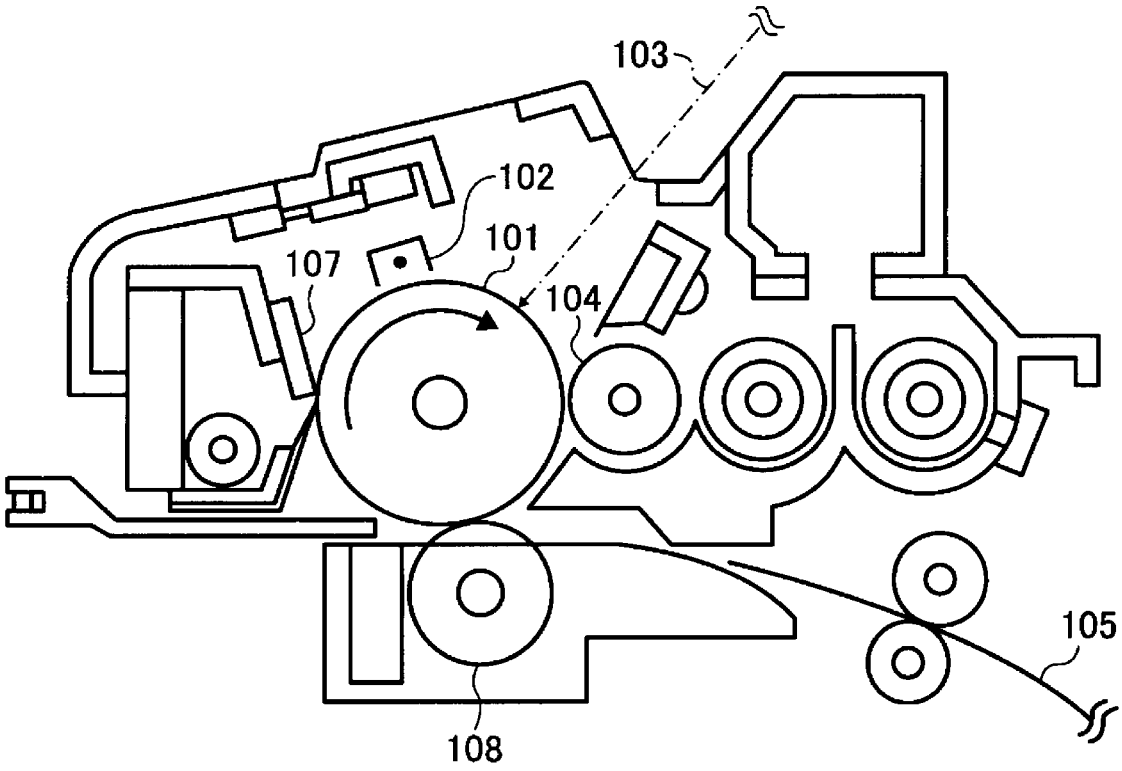
FIG. 20 is a schematic view illustrating an example of the process cartridge of the present invention.

FIG. 20 illustrates a process cartridge for use in the present invention. Referring to FIG. 20, the process cartridge includes an image bearing member 101 bearing an electrostatic latent image, a charging device 102, a developing device 104, a transfer device 108 and a cleaning device 107. The process cartridge can optionally include other devices if necessary. In FIG. 20, numerals 103 and 105 denote light from a light irradiator and a receiving material, respectively.

The image forming operations of the process cartridge is the same as those mentioned above in the image forming apparatus of the present invention. Specifically, the image bearing member 101 is rotated in the direction indicated by an arrow, and is charged by the charging device 102, followed by light irradiation 103 by the light irradiating device (not shown) to form an electrostatic latent image thereon. The developing device 104 develops the electrostatic latent image to form a toner image on the image bearing member, and the transfer device 108 transfers the toner image onto the receiving material 105. Thus, an image is printed out. The surface of the image bearing member 101 is cleaned by the cleaning device 107, and residual charges on the image bearing member are removed by the discharging device (not shown). These image forming operations are repeated to produce the next image.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the following examples and comparative examples, the methods for evaluating the properties of the resins and waxes used for the toners and the content of $CaCO_3$ in a receiving material are as follows.

1. Measurement of Softening Point of Resin

A flow tester CFT-500D from Shimadzu Corp. The conditions of the flow tester are as follows:

(1) diameter and length of the die: 1 mm, and 1 mm, respectively (2) pressure applied to the sample (resin) using plunger: 0.98 MPa (3) temperature rising speed: 3° C./minute (4) weight of sample: 1 g The softening point of a resin is defined as the mid-temperature of the flow starting temperature of the resin and the flow ending temperature of the resin when the resin is subjected to a heat analysis using the flow tester, namely, the temperature at which half of the resin is flown out.

2. Glass Transition Temperature (Tg) of Resin

The glass transition temperature (Tg) of a resin can be measured with a differential scanning colorimeter DSC210 from Seiko Instruments, Inc. The method is as follows.

(1) about 5 mg of a sample is contained in an aluminum pan;

(2) the sample is heated from room temperature to 200° C. at a heating speed of 10° C./min, followed by cooling to 0° C. at a cooling speed of 10° C./min; and (3) the sample is heated again to 200° C. at a heating speed of 10° C./min to obtain a DSC curve.

The glass transition temperature is defined as the temperature at which the tangent line at a point of the highest endothermic curve, which has a largest slanting angle, crosses the base line of the DSC curve.

3. Acid Value

The acid value of a resin is determined by the method described in JIS K0070 except that a mixture solvent of acetone and toluene (mixing ratio of 1:1) is used as the solvent instead of the mixture solvent of ethanol and ether.

4. Melting Point of Wax

The melting point of a resin can be measured with a differential scanning colorimeter DSC210 from Seiko Instruments, Inc. The method is as follows.

(1) about 5 mg of a sample is contained in an aluminum pan;

(2) the sample is heated from room temperature to 200° C. at a heating speed of 10° C./min, followed by cooling to 0° C. at a cooling speed of 10° C./min; and (3) the sample is heated again to 200° C. at a heating speed of 10° C./min to obtain a DSC curve.

The melting point is defined as the temperature at which the endothermic peak is observed.

5. Volume Average Particle Diameter of Toner

The volume average particle diameter is determined by an instrument COULTER MULTISIZER II from Beckman Coulter Inc. The measurement method is mentioned above.

6. Content of Calcium Carbonate in Receiving Material

The amount of calcium carbonate included in a receiving material is determined by analyzing the surface of a receiving material with a Fourier transform infrared spectrometer (FT-IR) AVANTOR 370 from Thermo Electron Co., and making calculation using the equation (2) mentioned above.

Synthesis Examples 1 and 2

The alcohol component, carboxylic acid component (other than trimellitic anhydride), and esterification catalyst listed in Table 1 were fed into a 5-litter four-necked flask equipped with a nitrogen feed pipe, a dewatering pipe, an agitator and a thermocouple. The mixture was subjected to condensation polymerization for 10 hours at 230° C. under a nitrogen gas flow, followed by a reaction for 1 hour at 230° C. under a pressure of 8.0 kPa. After the reaction product was cooled to 220° C., trimellitic anhydride was added to the reaction product, and the mixture was reacted for 1 hour under a normal pressure. The reaction product was further reacted at 220° C. under a pressure of 20 kPa so that the reaction product has the predetermined softening point. Thus, a polyester resin 1 (Synthesis Example 1) and a polyester resin 2 (Synthesis Example 2) were prepared.

TABLE 1

| | | Synthesis Example 1 Polyester 1 | Synthesis Example 2 Polyester 2 |
|---|---|---|---|
| Alcohol component | BPA-PO*[2] | 2800 g (80*) | 2450 g (70*) |
| | BPA-EO*[3] | 650 g (20*) | 975 g (30*) |
| Carboxyl acid component | Terephthalic acid | 1494 g (90*) | 1162 g (70*) |
| | Trimellitic anhydride | 192 g (10*) | 384 g (20*) |
| Esterification catalyst | Tin (II) dioctanate | 0.5 g | 0.5 g |
| Properties of polyester resin | Softening point (° C.) | 98.2 | 148.1 |
| | Tg (° C.) | 63.5 | 61.3 |
| | Acid value (mgKOH/g) | 24.5 | 25.3 |

Note

*Molar ratio provided that the total of the alcohol components is 100 moles.

*[2]polyoxypropylene(2.2)-2,2-bis(4-hydroxyphenyl)propane

*[3]polyoxyethylene(2.2)-2,2-bis(4-hydroxyphenyl)propane

Synthesis Example 3

The following components were fed into a 5-litter four-necked flask equipped with a nitrogen feed pipe, a dewatering pipe, an agitator and a thermocouple.

| | |
|---|---|
| 1,4-Butanediol | 23.75 mol |
| Ethylene glycol | 1.25 mol |
| Fumaric acid | 22.75 mol |
| Trimellitic anhydride | 1.65 mol |
| Hydroquinone | 4.8 g |

The mixture was reacted for 5 hours at 160° C. under a nitrogen gas flow, followed by a reaction for 1 hour at 200° C. The reaction product was further reacted for 1 hour under a pressure of 8.3 kPa. Thus, a crystalline polyester resin 3 having a softening point of 118° C. and a glass transition temperature (Tg) of 115° C. was synthesized.

Toner Preparation Example 1

The following components were mixed.

| | |
|---|---|
| Polyester resin 1 (R1) | 50 parts |
| Polyester resin 2 (R2) | 50 parts |
| Carbon black (CB) | 10 parts |
| Carnauba wax (CW) | 2 parts |
| N-stearylstearamide (SA) | 2 parts |
| Zinc salicylate (ZS) | 1 part |

The mixture was fully mixed with a HENSCHEL MIXER mixer MF20C/I from Mitsui Miike Machinery Co., Ltd. under the following mixing conditions.

Revolution: 1,500 rpm

Agitation: A cycle of agitation for 60 seconds followed by pause for 60 seconds is repeated 5 times.

The mixture was kneaded with a double-axis extruder from Toshiba Machine Co., Ltd., followed by cooling on a steel belt. In this regard, the kneading operation was performed so that the temperature of the kneaded mixture at the exit of the extruder is 120° C.

The kneaded mixture was then pulverized with a jet mill so that the resultant powder has a volume average particle diameter of 8.0 μm±0.5 μm. The powder was then subjected to air classification to prepare toner particles. One hundred (100) parts of the thus prepared toner particles were mixed with 1.0 part of a silica (R-972 from Nippon Aerosil Co.) serving as an external additive using a HENSCHEL MIXER mixer. Thus, a toner 1 was prepared.

Toner Preparation Examples 2 to 13

The procedure for preparation of the toner 1 was repeated except that the formulation of the toner was changed as illustrated in Tables 2 to 4. Thus toners 2 to 13 were prepared. In Tables 2 to 4, the numerals in parentheses represent the added amounts (parts by weight). In addition, the melting points of the waxes used are illustrated in Table 5.

TABLE 2

| | Toner Prep. Ex. 1 Toner 1 | Toner Prep. Ex. 2 Toner 2 | Toner Prep. Ex. 3 Toner 3 | Toner Prep. Ex. 4 Toner 4 | Toner Prep. Ex. 5 Toner 5 |
|---|---|---|---|---|---|
| Resin | R1 (50) | R1 (50) | R1 (40) | R1 (50) | R1 (50) |
| | R2 (50) | R2 (50) | R2 (40) | R2 (50) | R2 (50) |
| | — | — | R3 (20) | — | — |
| colorant | CB (10) | CB (10) | CB (10) | CB (10) | CB (10) |
| Wax | CW (2) | CW (2) | CW (2) | CW (2) | CW (2) |
| | SA (2) | SA (0.5) | SA (2) | ESA* (2) | ESA* (5) |
| Charge controlling agent | ZS (1) | ZS (1) | ZS (1) | ZS (1) | ZS (1) |

ESA*: ethylenebisstearamide

TABLE 3

| | Toner Prep. Ex. 6 Toner 6 | Toner Prep. Ex. 7 Toner 7 | Toner Prep. Ex. 8 Toner 8 | Toner Prep. Ex. 9 Toner 9 | Toner Prep. Ex. 10 Toner 10 |
|---|---|---|---|---|---|
| Resin | R1 (50) | R1 (50) | R1 (50) | R1 (50) | R1 (50) |
| | R2 (50) | R2 (50) | R2 (50) | R2 (50) | R2 (50) |
| | — | — | — | — | — |
| colorant | CB (10) | CB (10) | CB (10) | CB (10) | CB (10) |
| Wax | CW (5) | CW (2) | CW (2) | CW (2) | CW (2) |
| | ESA (5) | MSA*2 (2) | ECA*3 (2) | ESA (6) | — |
| Charge controlling agent | ZS (1) | ZS (1) | ZS (1) | ZS (1) | ZS (1) |

MSA*2: Methylenebisstearamide

ECA*3: Ethylenebiscapramide

TABLE 4

| | Toner Prep. Ex. 11 Toner 11 | Toner Prep. Ex. 12 Toner 12 | Toner Prep. Ex. 13 Toner 13 |
|---|---|---|---|
| Resin | R1 (40) | R1 (40) | R1 (50) |
| | R2 (40) | R2 (40) | R2 (50) |
| | R3 (20) | R3 (20) | — |
| colorant | CB (10) | CB (10) | CB (10) |
| Wax | CW (2) | CW (2) | PW*4 (0.5) |
| | — | MSA (2) | SA (0.5) |
| Charge controlling agent | ZS (1) | ZS (1) | ZS (1) |

PW*4: Paraffin wax

TABLE 5

| Wax | Melting point (° C.) |
|---|---|
| Carnauba wax (CW) | 81 |
| Paraffin wax (PW) | 77 |
| N-stearylstearamide (SA) | 95 |
| Methylenebisstearamide (MSA) | 141 |
| Ethylenebisstearamide (ESA) | 146 |
| Ethylenebiscapramide (ECA) | 161 |

Evaluation of Amide Wax

Thirty (30) milligrams of each toner was pressed under a pressure of 100 kg/cm$^2$ using a pelletizing machine to prepare pellets of the toners each having a diameter of 5 mm. The pellets were set on an aluminum foil set on a hot plate (PC-400D from Corning) to be heated for 5 minutes at 180° C. under an environmental conditions of 23° C. and 55% RH. After heating, the pellets were allowed to settle on a flat place together with the aluminum foil to be cooled to room temperature. The amount of nitrogen atoms present in a surface portion of the pellet was determined by X-ray photoelectron spectroscopy (XPS). The measurement conditions are as follows.

Instrument: AXIS-ULTRA from Kratos

X-ray source: A1 (monochromator)

Measurement power: 45 W (15 kV and 3 mA)

Measurement area: 900×600 μm$^2$

Pass energy: 160 eV (wide scan), 20 eV (narrow scan)

Energy step: 1 eV (wide scan), 0.1 eV (narrow scan)

Neutralization Condition

Filament current: 1.6 A, Charge valance: 1.7 V

In this regard, the amount of nitrogen atoms is classified into the following categories.

◎: The amount is not less than 2.0% and not greater than 3.0%.

○: The amount is not less than 1.0% and less than 2.0%.

Δ: The amount is not less than 0.5% and less than 1.0%.

X: The amount is less than 0.5%.

The results are shown in Tables 6-10.

Carrier Preparation Example 1

The following components were mixed for 10 minutes using a HOMOMIXER mixer from Tokushu Kika Kogyo Co., Ltd. to prepare a carrier coating liquid including a particulate alumina.

| | |
|---|---|
| Acrylic resin solution (solid content of 50% by weight) | 21.0 parts |
| Guanamine solution (solid content of 70% by weight) | 6.4 parts |
| Particulate alumina (average particle diameter of 0.3 μm, and resistivity of $10^{14}$ Ω · cm) | 7.6 parts |
| Silicone resin solution (SR2410 from Dow Corning Toray Silicone Co., Ltd., solid content of 23% by weight) | 65.0 parts |
| Aminosilane (SH6020 from Dow Corning Toray Silicone Co., Ltd., solid content of 100% by weight) | 0.3 parts |
| Toluene | 60 parts |
| Butylcellosolve | 60 parts |

A calcined ferrite powder which serves as a core material of the carrier and which has a formula of $(MgO)_{1.8}(MnO)_{49.5}(Fe_2O_3)_{48.0}$ and an average particle diameter of 35 μm was coated with the coating liquid prepared above using a coating machine SPIRA COTA from Okada Seiko Co., Ltd. The thickness of the cover layer was 0.15 μm. The coated carrier was calcined at 150° C. for 1 hour using an electric furnace. After cooling, the coated carrier, was sieved using a screen with openings of 106 μm.

Thus, a coated carrier was prepared.

Developer Preparation Examples 1-14

Five parts of each of the toners 1 to 14 was mixed with 95 parts of the coated cattier, and each of the mixtures was agitated for 5 minutes using a TURBULA MIXER mixer T2F From Willy A. Bachofen AG Maschinenfabrik. Thus, developers 1-14 were prepared.

Examples 1-17 and Comparative Examples 1-8

Each of the developers was set in a color laser printer (IPSIO CX8200 from Ricoh Co., Ltd.), and images were produced under the conditions mentioned below in Tables 6-10. The color printer can freely change the linear speed thereof, and has an oil applicator, which can freely change the coating amount of oil.

The toners and developers were evaluated as follows.

1. Oil Spread Property of Toner

Two grams of each toner was pressed under a pressure of 100 kg/cm$^2$ using a pelletizing machine to prepare pellets of the toners each having a diameter of 40 mm and a thickness of 2 mm. The pellets were set on an aluminum foil set on a hot plate (PC-400D from Corning) to be heated for 300 seconds at 180° C. under an environmental conditions of 23° C. and 55% RH. After heating, the pellets were allowed to settle on a flat place together with the aluminum foil to be cooled to room temperature. Next, 9 mg of the oil used for the oil applicator was dropped by a micro syringe on the surface of each pellet from a point 1 cm above the pellet. Soon after the oil is dropped, the area (A1) of the oil on the surface of the pellet was measured (the drop was photographed). Further, the area (A2) of the oil was also measured at a time 24 hours after dropping the oil to determine how the drop spread. In this regard, the oils used for this test are described in Tables 6-10 below. In addition, the oil spread property (OSP) of the toner is graded as follows.

◎: The ratio (W2/W1)×100 is less than 125.

○: The ratio (W2/W1)×100 is not less than 125 and less than 150.

Δ: The ratio (W2/W1)×100 is not less than 150 and less than 200.

X: The ratio (W2/W1)×100 is not less than 200.

2. Fixability

An image with a size of 20 cm×20 cm which consists of plural character string images and has an image area proportion of 25% was output. In this regard, the image density of the solid image was controlled so as to be 1.3 (measured by a densitometer X-RITE 938 from X-Rite Inc.), and the oil applicator was activated. The oils used for the oil applicator are described in Tables 6-10 below.

The produced image was rubbed with a smear cloth (defined in JIS L0849) set on a clock meter (Model 1 from Atlas Electric Device Co.) The optical density of the portion of the smear cloth rubbing the image was measured with the densitometer X-RITE 938. The fixability of the toner is graded as follows.

◎: The optical density is less than 0.08.

○: The optical density is not less than 0.08 and less than 0.10.

Δ: The optical density is not less than 0.10 and not greater than 0.15.

X: The optical density is greater than 0.15.

The evaluation results are shown in Tables 6-10.

TABLE 6

| | | Ex. 1 | Ex. 2 | Ex. 3 | Ex. 4 | Ex. 5 | Ex. 6 |
|---|---|---|---|---|---|---|---|
| Number of toner (developer) | | 1 | 1 | 1 | 1 | 1 | 1 |
| Amount of amide wax | | ○ | ○ | ○ | ○ | ○ | ○ |
| Oil used** | | A | B | A | A | A | A |
| Oil spread property | | ○ | ○ | ○ | ○ | ○ | ○ |
| RC* | Linear speed (mm/sec) | 1950 | 1950 | 1950 | 1950 | 1950 | 1950 |
| | Coating amount of oil (μg/cm$^2$) | 0.3 | 0.3 | 6 | 11 | 0.3 | 0.3 |

TABLE 6-continued

| | | Ex. 1 | Ex. 2 | Ex. 3 | Ex. 4 | Ex. 5 | Ex. 6 |
|---|---|---|---|---|---|---|---|
| | Content of $CaCO_3$ in receiving material | 0.49 | 0.49 | 0.49 | 0.49 | 0.02 | 0.62 |
| Fixability | | ○ | ○ | ○ | ○ | ◎ | Δ |

RC*: Image recording conditions
Oil**
A: Silicone oil type SS from Ricoh Co., Ltd.
B: Silicone oil FUSER OIL HA from IBM, which is partially modified by an amino group.

TABLE 7

| | | Ex. 7 | Ex. 8 | Ex. 9 | Ex. 10 | Ex. 11 | Ex. 12 |
|---|---|---|---|---|---|---|---|
| Number of toner (developer) | | 1 | 1 | 2 | 3 | 4 | 5 |
| Amount of amide wax | | ○ | ○ | Δ | ○ | ○ | ◎ |
| Oil used | | A | A | A | A | A | A |
| Oil spread property | | ○ | ○ | Δ | ○ | ○ | ◎ |
| RC | Linear speed (mm/sec) | 500 | 450 | 1950 | 1950 | 1950 | 1950 |
| | Coating amount of oil ($\mu g/cm^2$) | 0.3 | 0.3 | 0.3 | 0.3 | 0.3 | 0.3 |
| | Content of $CaCO_3$ in receiving material | 0.49 | 0.49 | 0.49 | 0.49 | 0.49 | 0.62 |
| Fixability | | ○ | ○ | Δ | ○ | ○ | ◎ |

TABLE 8

| | | Ex. 13 | Ex. 14 | Ex. 15 | Ex. 16 | Ex. 17 |
|---|---|---|---|---|---|---|
| Number of toner (developer) | | 6 | 7 | 8 | 9 | 12 |
| Amount of amide wax | | ◎ | ○ | ○ | ◎ | ○ |
| Oil used | | A | A | A | A | A |
| Oil spread property | | ◎ | ○ | ○ | ◎ | ○ |
| RC | Linear speed (mm/sec) | 1950 | 1950 | 1950 | 1950 | 1950 |
| | Coating amount of oil ($\mu g/cm^2$) | 0.3 | 0.3 | 0.3 | 0.3 | 0.3 |
| | Content of $CaCO_3$ in receiving material | 0.62 | 0.49 | 0.49 | 0.49 | 0.49 |
| Fixability | | ◎ | ○ | ○ | ◎ | ○ |

TABLE 9

| | | Comp. Ex. 1 | Comp. Ex. 2 | Comp. Ex. 3 | Comp. Ex. 4 |
|---|---|---|---|---|---|
| Number of toner (developer) | | 10 | 10 | 10 | 10 |
| Amount of amide wax | | X | X | X | X |
| Oil used | | A | B | A | A |
| Oil spread property | | X | X | X | X |
| RC | Linear speed (mm/sec) | 1950 | 1950 | 1950 | 1950 |
| | Coating amount of oil ($\mu g/cm^2$) | 0.3 | 0.3 | 6 | 0.3 |
| | Content of $CaCO_3$ in receiving material | 0.49 | 0.49 | 0.49 | 0.02 |
| Fixability | | X | X | X | X |

TABLE 10

| | | Comp. Ex. 5 | Comp. Ex. 6 | Comp. Ex. 7 | Comp. Ex. 8 |
|---|---|---|---|---|---|
| Number of toner (developer) | | 10 | 10 | 11 | 13 |
| Amount of amide wax | | X | X | X | X |

TABLE 10-continued

| | | Comp. Ex. 5 | Comp. Ex. 6 | Comp. Ex. 7 | Comp. Ex. 8 |
|---|---|---|---|---|---|
| Oil used | | A | A | A | A |
| Oil spread property | | X | X | X | X |
| RC | Linear speed (mm/sec) | 500 | 500 | 1950 | 1950 |
| | Coating amount of oil ($\mu g/cm^2$) | 0.3 | 11 | 0.3 | 0.3 |
| | Content of $CaCO_3$ in receiving material | 0.49 | 0.62 | 0.49 | 0.49 |
| Fixability | | X | X | X | X |

It is clear from Tables 6-10 that the images produced in Examples 1-17 are superior to the images produced in Comparative Examples 1-8 with respect to fixability even when the images are produced at a high linear speed.

Toner Preparation Example 14

The procedure for preparation of the toner in Toner Preparation Example 1 was repeated except that the added amounts of the resins 1 and 2 were changed to 55 parts and 45 parts, respectively, and N-stearylstearamide was replaced with N-palmitylpalmitamide. Thus, a toner 14 was prepared.

Toner Preparation Examples 15-24

The procedure for preparation of the toner 14 was repeated except that the formulation of the toner was changed as illustrated in Tables 11-13. Thus, toners 15 to 24 were prepared. In Tables 11 to 13, the numerals in parentheses represent the added amounts (parts by weight). In addition, the melting points of the waxes used for the toners are illustrated in Table 14.

TABLE 11

| | Toner Prep. Ex. 14 Toner 14 | Toner Prep. Ex. 15 Toner 15 | Toner Prep. Ex. 16 Toner 16 | Toner Prep. Ex. 17 Toner 17 |
|---|---|---|---|---|
| Resin | R1 (55)<br>R2 (45)<br>— | R1 (55)<br>R2 (45)<br>— | R1 (45)<br>R2 (45)<br>R3 (10) | R1 (55)<br>R2 (45)<br>— |
| colorant | CB (10) | CB (10) | CB (10) | CB (10) |
| Wax | CW (2)<br>PPA* (2) | CW (2)<br>PPA* (0.5) | CW (2)<br>PPA* (2) | CW (2)<br>ESA (2) |
| Charge controlling agent | ZS (1) | ZS (1) | ZS (1) | ZS (1) |

PPA*: N-palmitylpalmitamide

TABLE 12

| | Toner Prep. Ex. 18 Toner 18 | Toner Prep. Ex. 19 Toner 19 | Toner Prep. Ex. 20 Toner 20 | Toner Prep. Ex. 21 Toner 21 |
|---|---|---|---|---|
| Resin | R1 (55)<br>R2 (45)<br>— | R1 (55)<br>R2 (45)<br>— | R1 (45)<br>R2 (45)<br>R3 (10) | R1 (55)<br>R2 (45)<br>— |
| colorant | CB (10) | CB (10) | CB (10) | CB (10) |
| Wax | CW (2)<br>ESA (5) | CW (2)<br>MSA (2) | CW (2)<br>ECA (2) | CW (5)<br>— |
| Charge controlling agent | ZS (1) | ZS (1) | ZS (1) | ZS (1) |

TABLE 13

| | Toner Prep. Ex. 22 Toner 22 | Toner Prep. Ex. 23 Toner 23 | Toner Prep. Ex. 24 Toner 24 |
|---|---|---|---|
| Resin | R1 (55)<br>R2 (45)<br>— | R1 (45)<br>R2 (45)<br>R3 (10) | R1 (55)<br>R2 (45)<br>— |
| colorant | CB (10) | CB (10) | CB (10) |
| Wax | CW (2)<br>— | CW (2)<br>— | PW* (0.5)<br>PPA (0.5) |
| Charge controlling agent | ZS (1) | ZS (1) | ZS (1) |

PW*: paraffin wax

TABLE 14

| Wax | Melting point (° C.) |
|---|---|
| Carnauba wax (CW) | 81 |
| Paraffin wax (PW) | 77 |
| N-palmitylpalmitamide (PPA) | 91 |
| Methylenebisstearamide (MSA) | 141 |
| Ethylenebisstearamide (ESA) | 146 |
| Ethylenebiscapramide (ECA) | 161 |

Developer Preparation Examples 14-24

Five parts of each of the toners 14 to 24 was mixed with 95 parts of the coated cattier prepared in Carrier Preparation Example 1, and each of the mixtures was agitated for 5 minutes using a TURBULA MIXER mixer T2F From Willy A. Bachofen AG Maschinenfabrik. Thus, developers 14-24 were prepared.

Examples 18-30 and Comparative Examples 9-15

Each of the developers was set in a color laser printer (IPSIO CX8200 from Ricoh Co., Ltd.), and images were produced under the conditions mentioned below in Tables 15-18. The color printer can freely change the linear speed (process speed) thereof, and has an oil applicator, which can freely change the coating amount of oil.

Evaluation of the Toners and Developers (1) Fixability

The evaluation method is the same as the method mentioned above.

(2) Amounts of Si Atoms Present on Solid Images

Each of the developers was set in a color laser printer (IPSIO CX8200 from Ricoh Co., Ltd.) having an oil applicator applying a silicone oil to the fixing member of the fixing device, and images including a solid image were produced under the conditions mentioned below in Tables 15-18. The fixed solid image was subjected to X-ray photoelectron spectroscopy (XPS) 5 minutes after fixation of the toner image to determine the initial amount (X1) of silicon (Si) atoms which are present on the solid image and which are included in the silicone oil used. In addition, at a time 24 hours after fixation of the toner image, the solid image was also subjected to X-ray photoelectron spectroscopy to determine the amount (X2) of silicone atoms at the time. In this regard, a scanning X-ray photoelectron spectrometer QUANTUM 2000 from PHI using an X-ray of AlK $\alpha$ and an electron gun was used. The amounts X1 and X2 were determined from the peaks obtained by XPS (such as the peaks illustrated in FIG. 21). When the amounts X1 and X2 were calculated, the data of the relative sensitivity factors provided by PHI were used.

Since the toners include a silica as an external additive, a Si peak specific to the silica is observed when the toner image is subjected to XPS. However, as mentioned above by reference to FIG. 21, the Si peak can be separated from the Si peak specific to the silicone oil applied to the fixing member because the positions of the peaks are different from each other. Therefore, the amounts X1 and X2 can be determined from the Si peak specific to the silicone oil.

TABLE 15

| | | Ex. 18 | Ex. 19 | Ex. 20 | Ex. 21 | Ex. 22 |
|---|---|---|---|---|---|---|
| Number of toner (developer) | | 14 | 14 | 14 | 14 | 14 |
| X1 (atomic %) | | 1.8 | 1.7 | 2.5 | 1.8 | 1.9 |
| X2 (atomic %) | | 1.5 | 1.4 | 2.1 | 1.6 | 1.5 |
| X1 − X2 | | 0.3 | 0.3 | 0.4 | 0.2 | 0.4 |
| RC | Linear speed (mm/sec) | 1950 | 1950 | 1950 | 1950 | 1950 |
| | Oil* used | A | B | A | A | A |
| | Coating amount of oil ($\mu g/cm^2$) | 0.3 | 0.3 | 6 | 0.3 | 0.3 |
| | Content of $CaCO_3$ in receiving material | 0.49 | 0.49 | 0.49 | 0.02 | 0.62 |
| Fixability | | ○ | ○ | ○ | ◎ | Δ |

Oil*

A: Silicone oil type SS from Ricoh Co., Ltd.

B: Silicone oil FUSER OIL HA from IBM, which is partially modified by an amino group.

TABLE 16

| | Ex. 23 | Ex. 24 | Ex. 25 | Ex. 26 | Ex. 27 |
|---|---|---|---|---|---|
| Number of toner (developer) | 14 | 15 | 16 | 17 | 18 |
| X1 (atomic %) | 1.9 | 1.6 | 1.8 | 2.1 | 2.3 |
| X2 (atomic %) | 1.5 | 1.2 | 1.5 | 1.9 | 2.2 |
| X1 − X2 | 0.4 | 0.4 | 0.3 | 0.2 | 0.1 |
| RC Linear speed (mm/sec) | 500 | 1950 | 1950 | 1950 | 1950 |
| Oil* used | A | A | A | A | A |
| Coating amount of oil (μg/cm$^2$) | 0.3 | 0.3 | 0.3 | 0.3 | 0.3 |
| Content of $CaCO_3$ in receiving material | 0.49 | 0.49 | 0.49 | 0.49 | 0.62 |
| Fixability | ○ | Δ | ○ | ○ | ◎ |

TABLE 17

| | Ex. 28 | Ex. 29 | Ex. 30 | Comp. Ex. 9 | Comp. Ex. 10 |
|---|---|---|---|---|---|
| Number of toner (developer) | 19 | 20 | 21 | 22 | 22 |
| X1 (atomic %) | 2.0 | 2.2 | 1.5 | 1.1 | 0.9 |
| X2 (atomic %) | 1.8 | 2.0 | 1.1 | 0.3 | 0.3 |
| X1 − X2 | 0.2 | 0.2 | 0.4 | 0.8 | 0.6 |
| RC Linear speed (mm/sec) | 1950 | 1950 | 1950 | 1950 | 1950 |
| Oil* used | A | A | A | A | B |
| Coating amount of oil (μg/cm$^2$) | 0.3 | 0.3 | 0.3 | 0.3 | 0.3 |
| Content of $CaCO_3$ in receiving material | 0.49 | 0.49 | 0.49 | 0.49 | 0.49 |
| Fixability | ○ | ○ | ○ | X | X |

TABLE 18

| | Comp. Ex. 11 | Comp. Ex. 12 | Comp. Ex. 13 | Comp. Ex. 14 | Comp. Ex. 15 |
|---|---|---|---|---|---|
| Number of toner (developer) | 22 | 22 | 23 | 22 | 24 |
| X1 (atomic %) | 1.6 | 1.2 | 1.0 | 2.1 | 1.6 |
| X2 (atomic %) | 0.8 | 0.4 | 0.2 | 1.1 | 1.0 |
| X1 − X2 | 0.8 | 0.8 | 0.8 | 1.0 | 0.6 |
| RC Linear speed (mm/sec) | 1950 | 1950 | 500 | 500 | 1950 |
| Oil* used | A | A | A | A | A |
| Coating amount of oil (μg/cm$^2$) | 6 | 0.3 | 0.3 | 11 | 0.3 |
| Content of $CaCO_3$ in receiving material | 0.49 | 0.02 | 0.49 | 0.62 | 0.49 |
| Fixability | X | X | X | X | X |

It is clear from Tables 15-18 that the images produced by the method of the present invention in Examples 14-30 are superior to the images produced by comparative methods in Comparative Examples 9-15 with respect to fixability even when the images are produced at high linear speed.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming method comprising:

forming an electrostatic image on an image bearing member;

developing the electrostatic image with a developer including a toner to form a toner image on the image bearing member;

transferring the toner image onto a receiving material optionally via an intermediate transfer medium;

fixing the toner image to the receiving material with a fixing member; and applying an oil to the fixing member, wherein the toner includes a binder resin, a colorant, and an amide wax, and satisfies either a relationship (A) or a relationship (B), which relationships are defined as $$OSP=(A2/A1)\times 100<200, \quad (A)$$

wherein OSP represents an oil spreading property of the toner, A1 represents an area of the oil dropped on a first pellet of the toner measured 30 seconds after dropping the oil, and A2 represents an area of the dropped oil measured 24 hours after dropping the oil, wherein the OSP is determined by a method including pressing about 2 g of the toner at a pressure of 100 kg/cm$^2$ to form the first pellet of the toner having a cylindrical form with a diameter of about 40 mm and a thickness of about 2 mm, heating the first pellet for 5 minutes on a hot plate heated to 180° C. under an environmental condition of 23° C. and 55% RH, setting the first pellet on a horizontal plane so that a flat surface of the first pellet faces upward to cool the first pellet under the environmental condition, dropping 9 mg of the oil on the flat surface of the first pellet from a point 1 cm above the flat surface of the first pellet, and measuring the areas A1 and A2 of the oil dropped on the flat surface of the first pellet 30 seconds after dropping the oil and 24 hours after dropping the oil to determine the OSP, and $$(X1-X2)<0.5 \text{ atomic percent}, \quad (B)$$

wherein X1>1.0 atomic percent, and X2>1.0 atomic percent, wherein X1 and X2 represent amounts of Si atoms, from the oil, which are present on and/or in the toner image after fixing the toner image, X1 and X2 being measured by subjecting the toner image fixed on the receiving material to X-ray photoelectron spectroscopy at times 5 minutes and 24 hours, respectively, after fixing the toner image, wherein the amide wax includes an amount of nitrogen atoms between 0.5 to 3.0 atomic percent of all atoms detected, and wherein determining the amount of nitrogen atoms in the amide wax includes pressing about 30 mg of the toner for 1 minute at a pressure of 100 kg/cm$^2$ to form a second pellet of the toner having a cylindrical form with a diameter of about 5 mm, heating the second pellet for 5 minutes on a hot plate heated to 180° C. under the environmental condition of 23° C. and 55% RH, cooling the second pellet, and subjecting a flat surface of the second pellet to X-ray photoelectron spectroscopy to determine the amount of nitrogen atoms in the amide wax in the second pellet of the toner.

2. The image forming method according to claim 1, wherein the toner includes an amount of the amide wax between 1.5 to 9.0 parts by weight per 100 parts by weight of the binder resin.

3. The image forming method according to claim 1, wherein the toner includes an amount of the amide wax between 0.5 to 5.0 parts by weight per 100 parts by weight of the binder resin.

4. The image forming method according to claim 3, wherein the amide wax has a melting point between 70 to 165° C.

5. The image forming method according to claim 1, wherein the oil applied to the fixing member includes a silicone oil.

6. The image forming method according to claim 5, wherein the oil applied to the fixing member includes an amino-modified silicone oil.

7. The image forming method according to claim 1, wherein an amount of the oil applied to the fixing member is between 0.1 to 10 $\mu g/cm^2$.

8. The image forming method according to claim 1, wherein the binder resin of the toner includes a polyester resin having a glass transition temperature between 55 to 70° C. and a softening point between 115 to 150° C.

9. The image forming method according to claim 1, wherein the receiving material is a paper including an amount of calcium carbonate no greater than 0.6, and wherein the amount of calcium carbonate is determined by a FTIR-ATR method and is defined by the following equation $$\text{Amount of } CaCO_3 = H(\text{peak } 1421\ cm^{-1})/H(\text{peak } 1036\ cm^{-1})$$

wherein H(peak 1421 $cm^{-1}$)represents a height of a peak which is specific to calcium carbonate and which is observed at 1421 $cm^{-1}$, and H(peak 1036 $cm^{-1}$) represents a height of a peak which is specific to cellulose included in the paper and which is observed at 1036 $cm^{-1}$.

10. The image forming method according to claim 1, wherein the toner satisfies relationship (A).

11. The image forming method according to claim 1, wherein the toner satisfies relationship (B).

* * * * *